US010832602B2

(12) United States Patent
Canon

(10) Patent No.: US 10,832,602 B2
(45) Date of Patent: Nov. 10, 2020

(54) INFORMATION CONVEYING APPARATUS

(71) Applicant: Craig Canon, Denver, CO (US)

(72) Inventor: Craig Canon, Denver, CO (US)

(73) Assignee: Craig Canon, Denver, CO (US)

( * ) Notice: Subject to any disclaimer, the term of this patent is extended or adjusted under 35 U.S.C. 154(b) by 291 days.

(21) Appl. No.: 14/557,770

(22) Filed: Dec. 2, 2014

(65) Prior Publication Data

US 2016/0086524 A1 Mar. 24, 2016

Related U.S. Application Data

(60) Provisional application No. 61/910,488, filed on Dec. 2, 2013, provisional application No. 61/984,560, filed on Apr. 25, 2014.

(51) Int. Cl.

| | |
|---|---|
| ***G09F 19/00*** | (2006.01) |
| ***G09F 13/16*** | (2006.01) |
| ***G09F 19/22*** | (2006.01) |
| *G09F 13/04* | (2006.01) |

(52) U.S. Cl.

CPC ..... *G09F 19/00* (2013.01); *G09F 13/16* (2013.01); *G09F 19/22* (2013.01); *G09F 2013/0472* (2013.01)

(58) Field of Classification Search

CPC ..... G09F 19/08; A63H 3/06; A63H 27/10

See application file for complete search history.

(56) References Cited

U.S. PATENT DOCUMENTS

| | | | | |
|---|---|---|---|---|
| 1,167,124 A * | 1/1916 | Sloper | B60B 7/0006 301/37.104 |
| 1,422,840 A | 7/1922 | De Grasse Consuelo | |
| 1,442,900 A * | 1/1923 | O'Connor | A63H 3/06 446/153 |
| D113,238 S | 2/1939 | Reighard | |
| D114,199 S | 4/1939 | Rettenmeyer | |
| D130,025 S | 10/1941 | Kilgariff | |
| 2,349,706 A * | 5/1944 | Collins | G09F 19/10 359/527 |

(Continued)

FOREIGN PATENT DOCUMENTS

FR 2675167 A1 * 10/1992

OTHER PUBLICATIONS

Application as filed for Design U.S. Appl. No. 29/489,108, filed Apr. 25, 2014, inventor: Craig Canon.

*Primary Examiner* — Cassandra Davis

(74) *Attorney, Agent, or Firm* — Dorsey & Whitney LLP

(57) ABSTRACT

An information conveying apparatus may include a stick figure structure. The stick figure structure may include an elongated torso member including a first end and a second end, a head member operably joined to the first end of the torso member, a first arm member and a second arm member operably joined to either side of the torso member between the first and second end of the torso member, and a first leg member and a second leg member operably joined to the second end of the torso member. The information conveying apparatus may further include a support structure for maintaining the stick figure structure in a substantially upright position. The support structure and the stick figure structure may be formed as an integral body. The support structure may be separate from the stick figure structure.

18 Claims, 69 Drawing Sheets

(56) References Cited

U.S. PATENT DOCUMENTS 2,698,496 A * 1/1955 Miller ..... A63H 3/06 446/226
D187,177 S 2/1960 Lawson
3,026,648 A * 3/1962 Lemelson ..... A63H 3/06 273/DIG. 5
3,098,317 A * 7/1963 Guzman ..... A63G 13/00 446/226
D197,427 S 2/1964 Jones et al.
3,234,685 A * 2/1966 Harrowe ..... A63H 15/06 446/177
3,357,610 A 12/1967 Quinby, Jr.
3,395,484 A 8/1968 Smith
3,854,448 A * 12/1974 Kromanaker ..... B05B 12/30 118/505
4,029,318 A * 6/1977 Boss ..... F41J 1/10 108/118
4,208,834 A * 6/1980 Lin ..... A63H 3/06 446/226
4,630,762 A 12/1986 Stringer
D294,843 S 3/1988 Lund
4,793,082 A 12/1988 Petrick et al.
D307,606 S 5/1990 Jervis, Sr.
D308,229 S 5/1990 Jervis, Sr.
5,255,457 A * 10/1993 Lipson ..... A47G 1/14 40/744
D388,724 S 1/1998 Victor et al.
D414,815 S * 10/1999 McDonald ..... D20/31
D419,309 S 1/2000 Leon
6,186,857 B1 * 2/2001 Gazit ..... G09F 15/0025 40/406
6,347,470 B1 * 2/2002 Radovich ..... G09F 15/0025 40/540
6,601,326 B1 8/2003 Bublitz et al.
6,746,303 B2 6/2004 Beidokhti et al.
D497,400 S * 10/2004 Dykstra ..... D11/160
D497,637 S 10/2004 Cetera
6,991,510 B2 * 1/2006 Nan ..... A47F 8/00 446/220
7,032,338 B2 * 4/2006 Sloot ..... G09F 21/045 301/37.41
7,077,301 B2 7/2006 Dudley
7,198,538 B2 * 4/2007 Chin-Cheng ..... A63H 3/06 446/220
7,210,685 B2 * 5/2007 Cheng ..... A63B 43/005 273/348.4
D553,196 S 10/2007 Canon
D589,092 S 3/2009 Glover
D620,319 S * 7/2010 Alexander ..... D7/619.2
D671,602 S * 11/2012 Bradford ..... D21/621
8,814,729 B2 * 8/2014 Hartigan ..... A63B 69/002 273/DIG. 30
D752,687 S 3/2016 Canon
2002/0111109 A1 * 8/2002 Kwan ..... A63H 3/06 446/220
2003/0046840 A1 5/2003 Evans et al.
2007/0277414 A1 * 12/2007 Canon ..... G09F 7/00 40/612
2009/0191787 A1 * 7/2009 Rubinstein ..... A63H 27/10 446/220
2009/0286449 A1 * 11/2009 Tsai ..... A63H 3/06 446/224
2010/0031546 A1 * 2/2010 Nwatu ..... G09F 15/0062 40/607.1

* cited by examiner

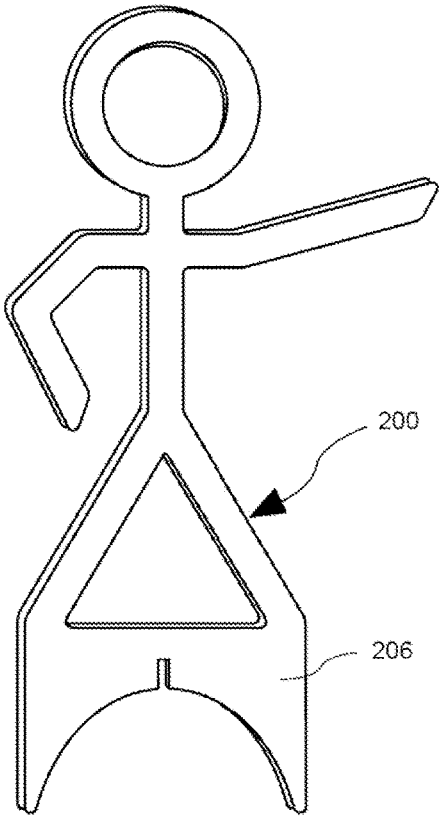
FIG. 8B-1
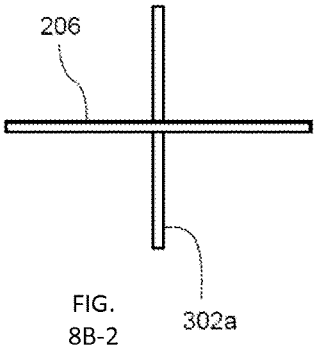
FIG. 8B-2
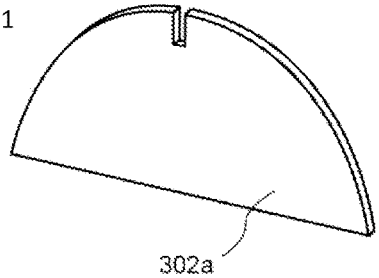
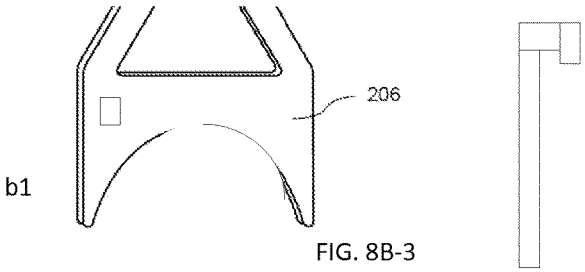
FIG. 8B-3
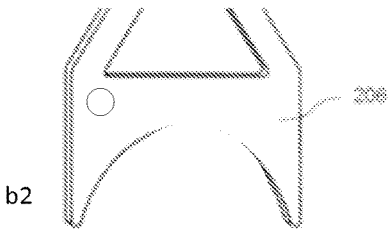

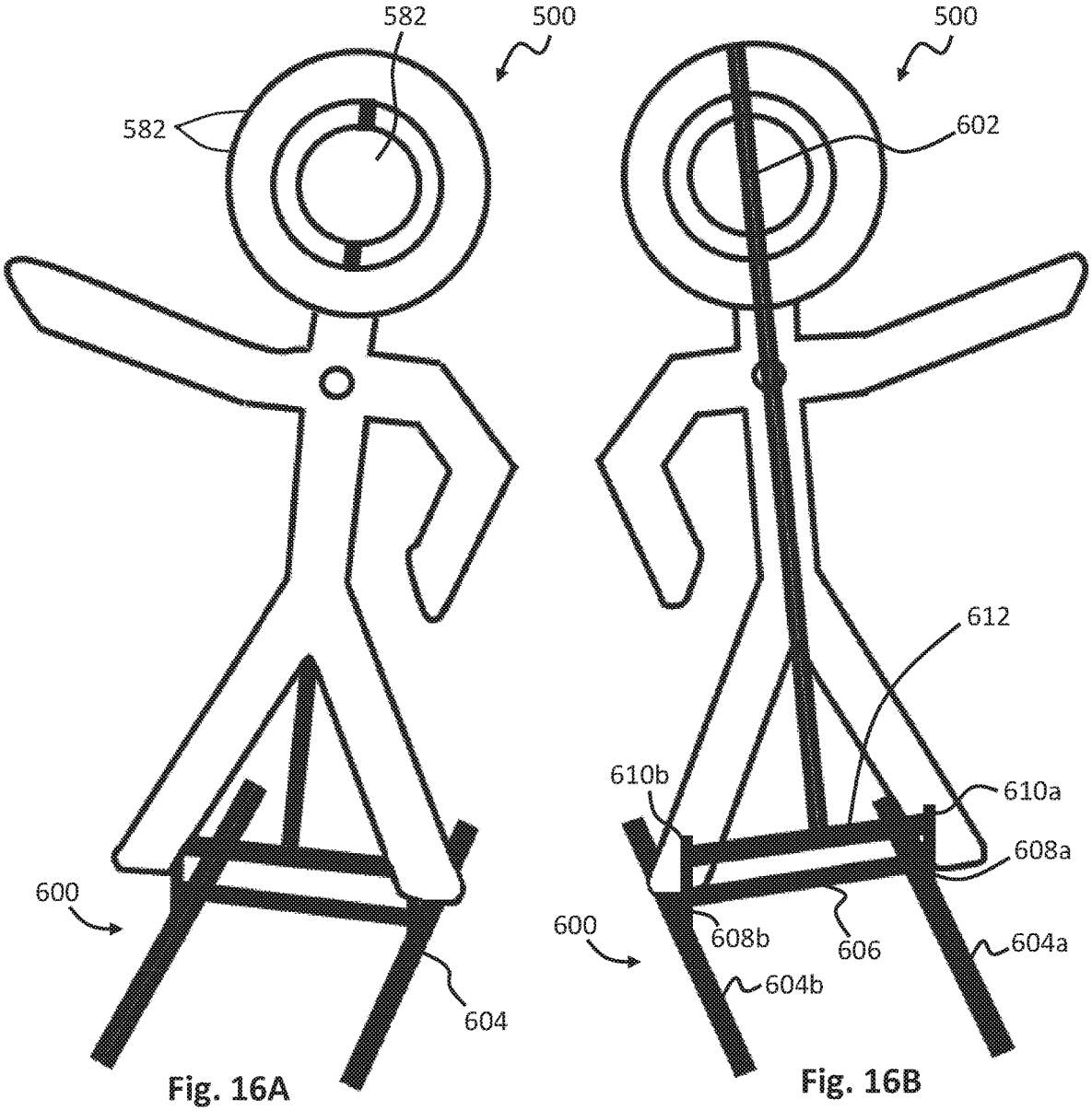
Fig. 16A
Fig. 16B
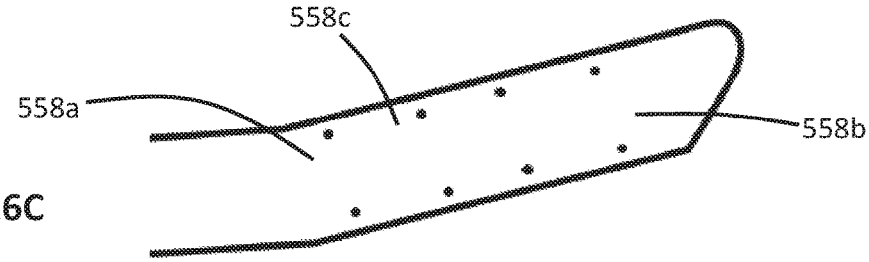
Fig. 16C

Fig. 43C
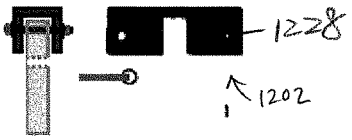
Fig. 43D
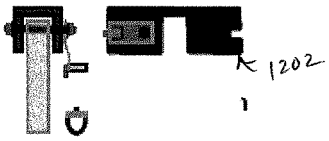
Fig. 43E
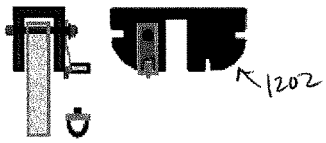
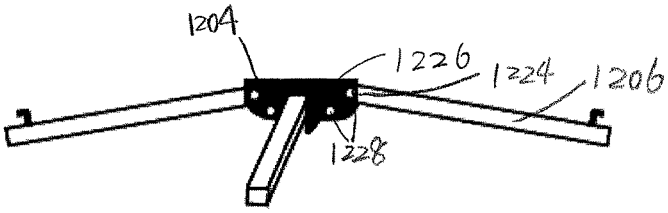
Fig. 43A
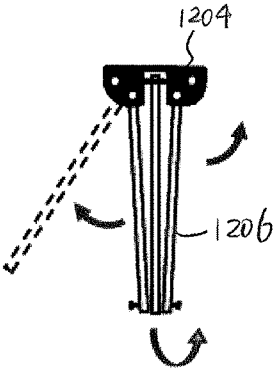
Fig. 43B

INFORMATION CONVEYING APPARATUS

CROSS REFERENCE TO RELATED APPLICATIONS

This application claims the benefit of priority to U.S. Application No. 61/910,488 entitled Wayfinding Marker Structure, filed Dec. 2, 2013, and to U.S. Application No. 61/984,560 entitled Information Conveying Apparatus, filed Apr. 25, 2014, both of which are hereby incorporated by reference.

TECHNOLOGICAL FIELD

The technological field generally relates to apparatuses for conveying information to an observer of the apparatuses and to structures for supporting the information conveying apparatuses.

BACKGROUND

Signs or structures for displaying information are useful to an observer for information on directions, locations, distances, routes, road conditions, ongoing events, etc. Such signs or structures may be placed in a particular location temporarily or for an extended period of time and can be removed and/or repositioned.

SUMMARY

Described herein are information conveying apparatuses and structures for supporting the information conveying apparatus.

In one aspect, an information conveying apparatus is disclosed. The apparatus includes an upper portion and a lower portion operably coupled to the upper portion; wherein the lower portion is configured to allow at least the upper portion of the apparatus to maintain a substantially upright position with respect to a surface defined by a first medium and a second medium, at least a part of the lower portion is configured to extend into and be supported by at least one of the first medium or the second medium. The upper portion and the lower portion may form an integral body or are formed from a single piece of material. The upper portion and the lower portion define a substantially planar structure. The apparatus may further include a retaining member configured such that, when the retaining member is coupled to the lower portion, the retaining member is oriented at an angle with respect to the lower portion. In some aspects, the retaining member is substantially planar. In some aspects, the retaining member includes at least one opening for receiving therein at least a portion of the lower portion of the apparatus. The at least one opening is configured adjacent to a periphery of the retaining member. In some aspects, the retaining member includes at least two openings diagonally positioned at a periphery of the retaining member. In some aspects, the at least one opening is configured with a width dimension substantially corresponding to a thickness of the portion of the lower portion received in the at least one opening such that, when the retaining member is coupled to the lower portion, the retaining member maintains the angle with respect to the lower portion. In some aspects, the lower portion comprises at least one projection for facilitating penetration of the at least one projection through the surface into at least one of the first medium or the second medium. The at least one projection may include a tapered end distal to the upper portion. In some aspects, the at least one projection comprises a first end proximal to the upper portion, a second end distal to the upper portion, and at least one engagement element proximal to the second end. In some aspects, the engagement element defines in part a tapered end or an apex of the at least one projection pointing away from the upper portion. In some aspects, the engagement element is configured to operably engage a retaining member such that, when the retaining member engages the engagement element of the lower portion of the apparatus, the engagement element restrains the retaining member from moving towards the tapered end of the apex of the at least one projection. In some aspects, the at least one projection comprises at least one first projection defining a first longitudinal axis and at least one second projection defining a second longitudinal axis, the at least one first projection and the at least second projection being spaced apart from each other. In some aspects, the lower portion comprises a horizontal structural element defining a horizontal axis and joining the at least one first projection and the at least one second projection. In some aspects, the horizontal structural element and at least one of the at least one first projection or the at least one second projection forms a smooth or curved joint. In some aspects, the horizontal structural element comprises an upper edge, the upper edge of the horizontal element being configured to withstand a force applied by a user to position at least a portion of the lower portion of the apparatus into at least one of the first medium or the second medium. In some aspects, the upper portion is configured to convey information to an observer. In some aspects, the upper portion resembles a stick figure. In some aspects, the upper portion comprises a torso member including a first end and a second end, a head member joined with the torso member near the first end of the torso member, at least one leg member joined with the torso member near the second end of the torso member and extending from the torso member, and at least one arm member joined with the torso member between the first and second ends of the torso member and extending from the torso member. In some aspects, the upper portion is substantially planar. In some aspects, the head member, the torso member, the at least one arm member, and the at least one leg member form an integral body or are formed from a single piece of material. The head member may include a handle portion. The head member may define an opening. In some implementations, the at least one leg member comprises a first leg member and a second leg member, the first leg member, the second leg member and an upper end portion of the lower portion of the apparatus forming an opening. In some implementations, at least a portion of the at least one arm member extends in a direction away from the torso member and tilts slightly towards the first end of the torso member. The first medium may be a fluid. The fluid may be a liquid or air. In some implementations, the second medium is a solid. In some implementations, a support base configured to removably engage the information conveying apparatus and to support the information conveying apparatus in a substantially upright position. In some implementations, the support base includes a first support structure and a second support structure, the first support structure and the second support structure being configured to removably engage each other. In some implementations, at least one of the first support structure or the second support is substantially planar. When the first support structure and the second support structure engage each other in a cross configuration, a bottom edge of the first support structure and a bottom edge of the second support structure are in one common plane, and the bottom edges of the first and second support structures are supportable by a support surface. The first support structure and the second support structure may engage each other in an interlocking configuration. The first support structure may include a front support member, a rear support member substantially parallel to the front support member, and at least one center support member positioned between the front and rear support members. The at least one center support member may include a middle support element, an edge portion of the middle support element configured to complement and align with an edge portion of the lower portion of the information conveying apparatus. The at least one center support member further comprises a first side support element and a second side support element positioned on either side of the middle support element and spaced apart from the middle support element, when the support base engages the information conveying apparatus, the first and second side support elements are configured to be spaced apart from the information conveying apparatus.

In another aspect, an information conveying apparatus comprising a stick figure structure is disclosed. The stick figure structure may include an elongated torso member including a first end and a second end; a head member operably joined to the first end of the torso member; a first arm member and a second arm member operably joined to either side of the torso member between the first and second end of the torso member; and a first leg member and a second leg member operably joined to the second end of the torso member. The apparatus may further include a first shoulder member operably joining the first arm member to one side of the torso member; and a second shoulder member operably joining the second arm member to the other side of the torso member. The apparatus may further include a head insert operably joined to the head member in a spaced apart configuration. The first arm member may further include a longitudinal extension operably joined thereto, the first arm member and the longitudinal extension define a substantially straight first arm. The first arm member may be substantially straight, the second arm member is bent. The first arm member and the second arm member may point in the same horizontal direction and point in opposite vertical directions. The first arm member may be tilted upward, and the second arm member is bent downward. In some implementations, at least the first arm member is configured to support an information conveying structure. The stick figure structure may define an integral body. The stick figure structure may be substantially planar. The at least one of the head member, torso member, the first arm member, the second arm member, the first leg member, or the second leg member may be movably joined to another one of the head member, torso member, the first arm member, the second arm member, the first leg member, or the second leg member. The first arm member may include a first upper arm portion and a first lower arm portion movably joined to the first upper arm portion, the second arm member includes a second upper arm portion and a second lower arm portion movably joined to the second lower arm portion. The at least one of the head member, torso member, the first arm member, the second arm member, the first leg member, or the second leg member may be pivotable to overlap at least one of another one of the head member, torso member, the first arm member, the second arm member, the first leg member, or the second leg member. The stick figure structure may be foldable, wherein when the stick figure structure is folded, the head member defines a substantial portion of a periphery of the folded stick figure structure. The stick figure structure may be foldable, wherein when the stick figure structure is folded, the head member defines a width dimension of the folded stick figure structure, and the torso member defines a length dimension of the folded stick figure structure. The at least one of the head member, torso member, the first arm member, the second arm member, the first leg member, or the second leg member may be pivotably joined to the another one of the head member, torso member, the first arm member, the second arm member, the first leg member, or the second leg member by an index rivet, the index rivet being configured to allow for select configurations of the stick figure structure. The at least one of the head member, torso member, the first arm member, the second arm member, the first leg member, or the second leg member includes one aperture, the another one of the head member, torso member, the first arm member, the second arm member, the first leg member, or the second leg member may include a plurality of apertures, the one aperture is configured to align with any one of the plurality of apertures, a connection member is positioned through the aligned apertures and secured thereto.

In some implementations, the apparatus may include a skeleton frame. The frame may include at least one layer of material removably joined to the skeleton frame to form a stick figure shape. The skeleton frame may include a plurality of skeleton segments connected by a plurality of connectors. The skeleton frame may be joined to the at least one layer of material by at least one end cap receiving therein at least one end portion of the skeleton frame. The at least one layer of material may include at least one exterior sleeve member, at least a portion of the skeleton frame is passed through or received in the at least one exterior sleeve member. The at least one layer of material may include at least one interior longitudinal channel, at least a portion of the skeleton frame is received in the at least one interior longitudinal channel. The at least one layer of material may include at least one access flap for passing through at least a portion of the skeleton frame, the at least one access flap is formed by two overlapping portions of the at least one layer of material, the at least one access flap defines an exterior opening and an interior opening. The at least one layer of material may include two layers of material; the two layers of material are sewn together along their edge portions to form the stick figure shape. The apparatus further includes reflector strips for joining the skeleton frame to the at least one layer of material. The at least one layer of material may be flexible. The stick figure shape may be formed by rolling out the at least one layer of material. The at least one layer of material may include a plurality of stiffeners.

In some implementations, the stick figure structure is an inflatable body. The stick figure structure may include at least one connection member at a waist portion of the stick figure structure, the at least one connection member configured to join to a support base. The at least one connection member may include a D ring. The stick figure structure may include at least one connection member at a distal end of one of the first or second leg members, the at least one connection member configured to join to a support base. The at least one connection member may include a foot strap. The structure may further include a support base operably joined to the stick figure structure and supporting the stick figure structure in a substantially upright position. The support base may be connected to a waist portion of the stick figure structure by a cable member. The support base may be integrally formed with the stick figure structure. The at least one of the first or second leg member may be joined to the support base, the at least one of the first or second leg member tapers from the portion joined to the support base to the portion joined to the torso member. The support base may be inflatable. The support base may include a plurality of inflatable segments. The support base may include at least one of tie-down tabs. In some implementations, the support base further includes a non-inflatable flat member; the non-inflatable flat member is configured to receive a weight element for holding the stick figure in place. In some implementations, the support base includes at least two cross members, two opposing ends of the at least two cross members are connected to two opposite waist portions of the stick figure structure by cable members.

In some implementations, the stick figure structure includes at least one slot formed at a waist portion of the stick figure structure, the at least one slot is configured to engage an elongated support stand.

BRIEF DESCRIPTION OF THE DRAWINGS

FIGS. 8B-1 through 8B-3 illustrate an alternative embodiment of the support base of FIG. 7.

FIG. 11B illustrates the head insert of FIG. 11A attached to a head portion of an information conveying apparatus.

FIGS. 16A and 16B illustrate front and rear perspective views of another embodiment of an information conveying apparatus and a support member for use with the information conveying apparatus.

FIG. 16C illustrates an enlarged partial view of the portion of the information conveying apparatus encircled by line 16C-16C in FIG. 16B.

FIGS. 19A-1 to 19A-5, 19A-1A, 19B, 19B-1 to 19B-3, 19C-1, 19C-1A-19C-1C, 19C-2, 19D-1 to 19D-2, and 19E-1 to 19E-2 illustrate various connection mechanisms used for the information conveying apparatus of FIG. 17A.

FIG. 36A, 36A-1, 36A-2, 36B, 36C illustrate schematically other embodiments of mounting sands used for the information conveying apparatus as described herein.

FIGS. 43A, 43B, 43C, 43D, and 43E illustrate schematically another support base used for the information conveying apparatus of FIG. 41A.

FIGS. 51A, 51B, 51C, 52A, 52B, 52B-1, 52B-2, 52C, 52D, 52E, and 52F illustrate schematically embodiments of various inflatable support bases used for the information conveying apparatus of FIG. 50A.

DETAILED DESCRIPTION

Described herein are examples of information conveying apparatuses and structures for supporting the information conveying apparatus.

In some examples, the information conveying apparatus may include an upper portion for conveying information whether in air or liquid to an observer and a lower portion configured to be placed into a medium and supported by the medium thereby supporting the upper portion in a substantially upright position for viewing. Accordingly, the upper portion may also be referred to as the information conveying portion, and the lower portion may also be referred to as the supporting portion. In some examples, the lower portion may be configured for easy placement into the support medium and/or removal out of the support medium. In some examples, the lower portion may be configured to engage a retaining member such that the information conveying apparatus may be kept in a set location without ease of removal or repositioning. In some examples, the lower portion of the information conveying apparatus may engage and be supported by a support base that rests on a support medium.

Yet in other examples, the information conveying apparatus may include a stick figure structure for conveying information to an observer. The stick figure structure may be supported by a support base on a support surface. The support base may be integrated to the stick figure structure or may be provided as a separate assembly to the stick figure structure. The stick figure structure may be made of relatively rigid, semi-flexible, relatively flexible or soft materials to create similar effects.

It should be noted that the various features and/or configurations as described herein with respect to any particular examples of the information conveying apparatus may advantageously be used for any information conveying apparatus as described herein separately in some instances or in combination in other instances.

Figure 1A:
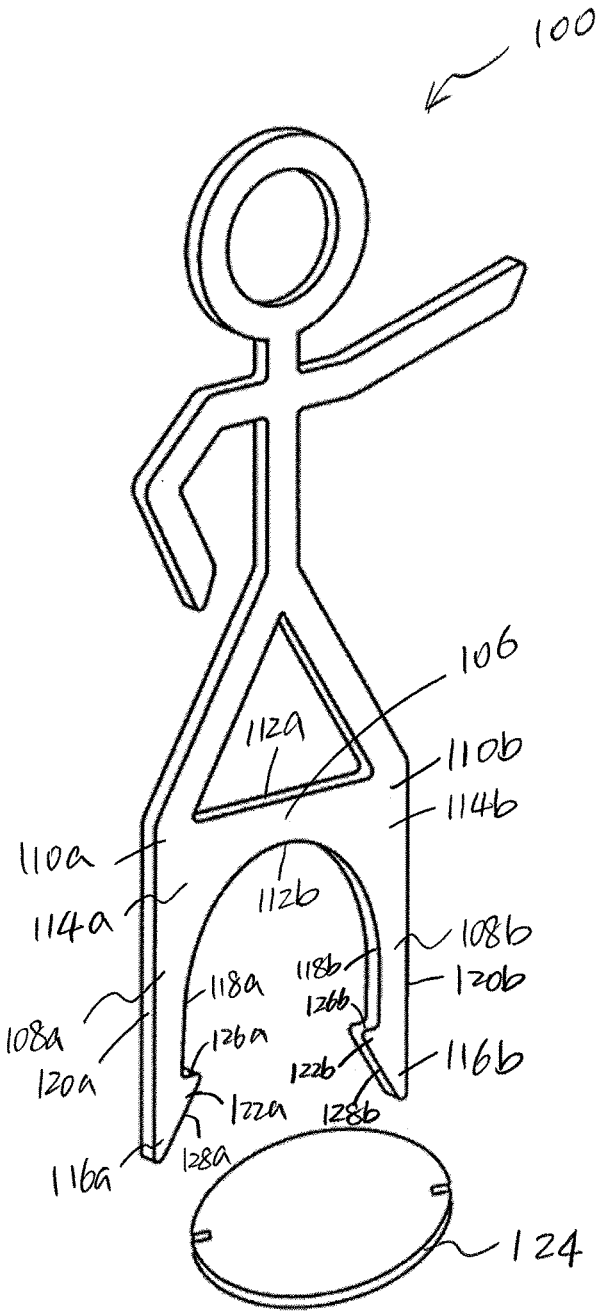
FIG. 1A illustrates a perspective view of an embodiment of an information conveying apparatus and a retaining member for use with the information conveying apparatus, with the retaining member disengaged from the information conveying apparatus.
Figure 1B:
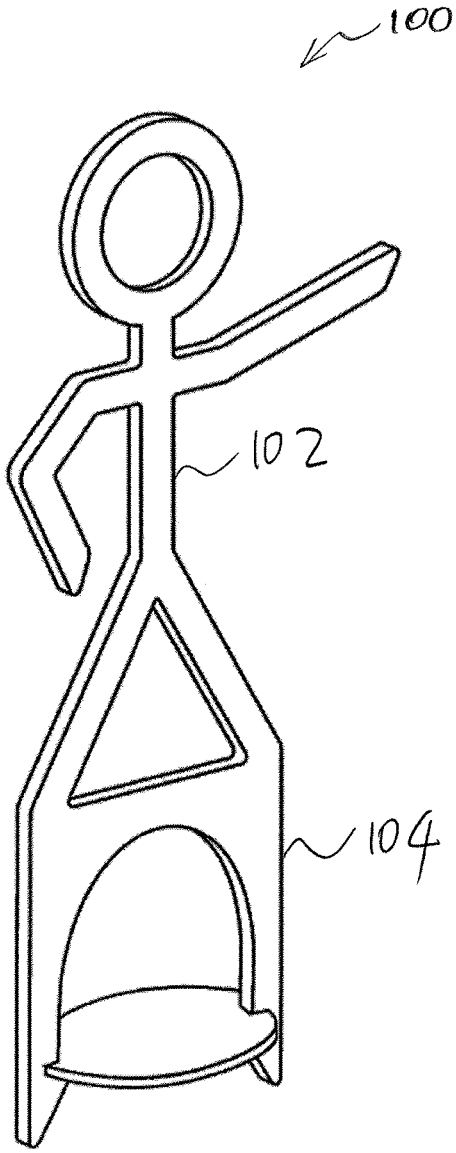
FIG. 1B illustrates another perspective view of the information conveying apparatus and the retaining member of FIG. 1A, with the retaining member engaged with the information conveying apparatus.
Figure 2:
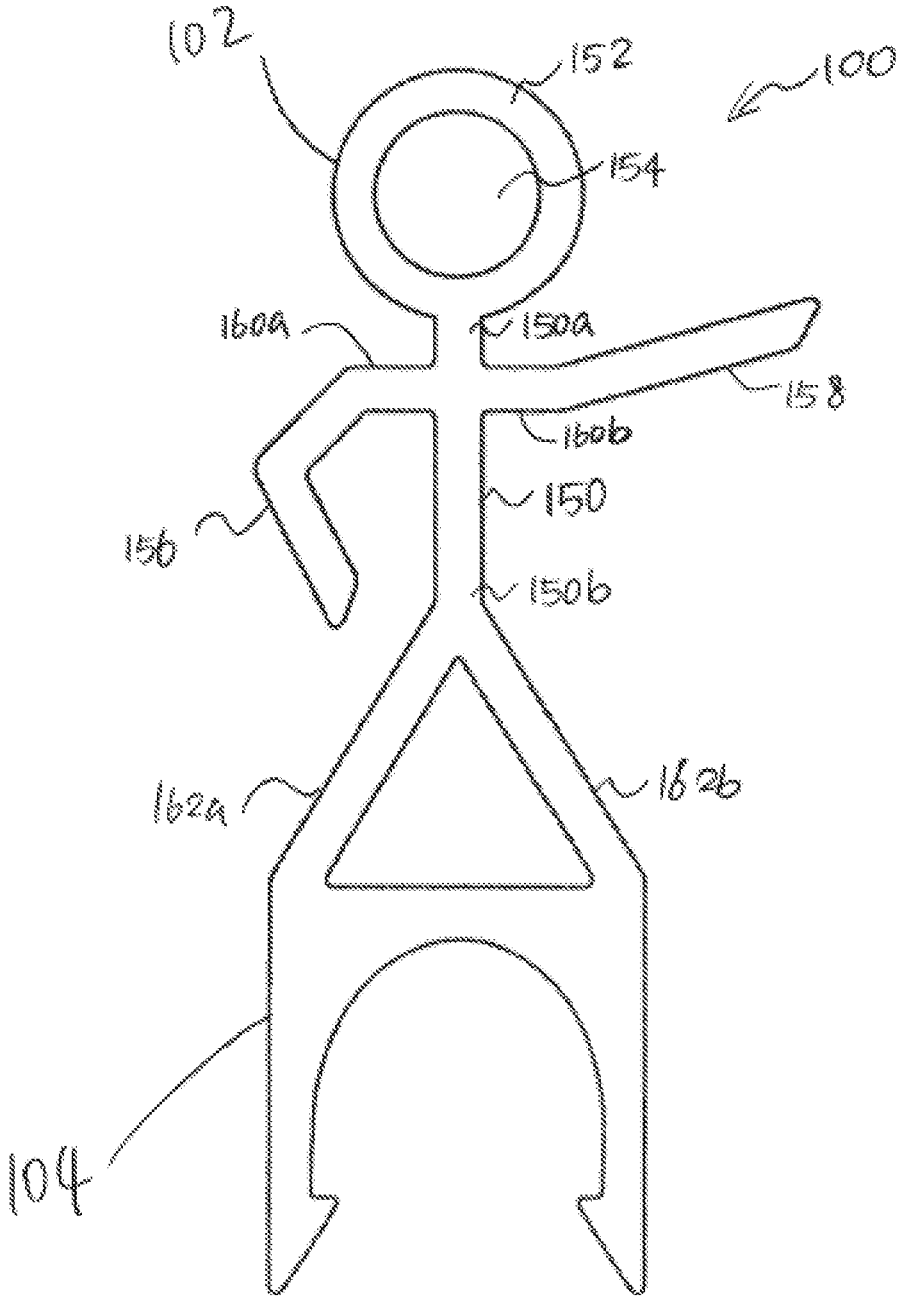
FIG. 2 illustrates an elevation view of the information conveying apparatus of FIGS. 1A and 1B.
Figure 3A:
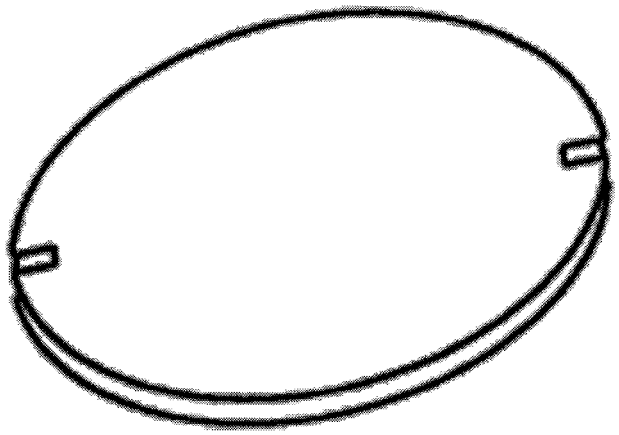
FIGS. 3A and 3B illustrate various views of the retaining member of FIGS. 1A and 1B.
Figure 3B:
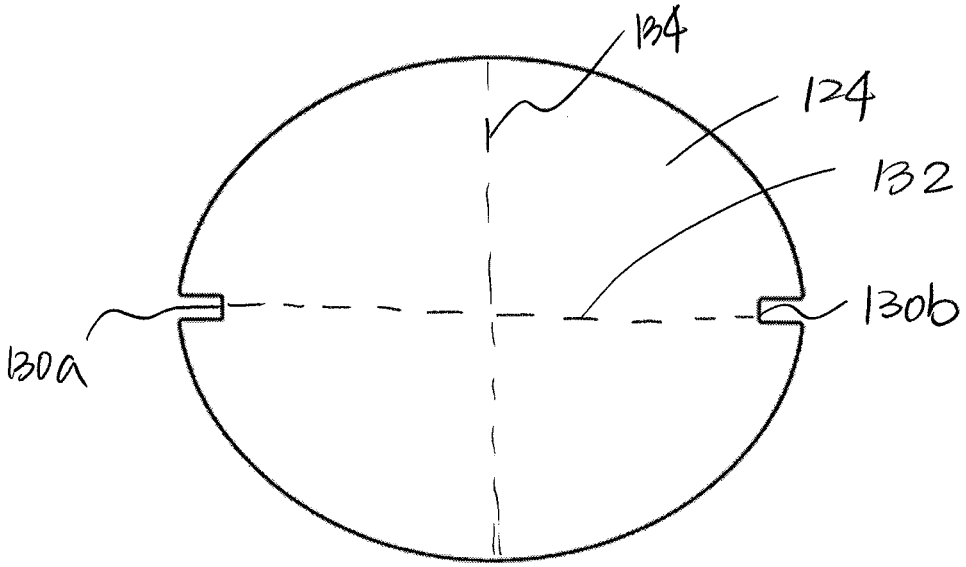

With reference to FIGS. 1A, 1B, and 2, one example of the information conveying apparatus 100 may include a substantially planar or two-dimensional object including an upper portion 102 and a lower portion 104 arranged along a first dimension, such as a longitudinal or vertical dimension, of the information conveying apparatus 100. The upper portion 102 of the information conveying apparatus 100 may be configured to convey or display information to an observer. Additionally, an insert could be placed inside the head 154 of upper portion 102. Also, a separate sign may be hung off arm 158. To maintain the information available to an observer in an environment, a portion of the information conveying apparatus 100, such as the lower portion 104 thereof, may be placed into a medium, such as soil, dirt, rocks, and/or gravel, so that the upper portion 102, or at least a portion thereof, may remain above a surface of the medium, such as the ground surface, for viewing.

The lower portion 104 may include a horizontal structural element 106, and a first projection 108*a* and a second projection 108*b* operably joined to and extending from the horizontal structural element 106. The horizontal structural element 106 may include a first end 110*a*, a second end 110*b*, and an upper edge 112*a* and a lower edge 112*b* extending between the first and second ends 110*a*, 110*b*. The upper portion 102 of the information conveying apparatus 100 may be operably joined to and supported by the upper edge 112*a* of the horizontal structural element 106. The first projection 108*a* and the second projection 108*b* may be operably joined to the lower edge 112*b* of the horizontal structural element 106 and extend from the lower edge 112*b* of the horizontal structural element 106 away from the upper portion 102 of the information conveying apparatus 100.

Each of the first and second projections 108*a*, 108*b* may include a first end 114*a*, 114*b* proximal to the horizontal structural element 106, a second end 116*a*, 116*b* distal to the horizontal structural element 106, an inside edge 118*a*, 118*b* facing the other of the first and second projections 108*a*, 108*b* and extending between the first and second ends 114*a*, 114*b*, 116*a*, 116*b*, and an outside edge 120*a*, 120*b* extending between the first and second ends 114*a*, 114*b*, 116*a*, 116*b*. The first end 114*a* of the first projection 108*a* may be operably joined to the horizontal structural element 106 near the first end 110*a* of the horizontal structural element 106. The first end 114*b* of the second projection 108*b* may be operably joined to the horizontal structural element 106 near the second end 110*b* of the horizontal structural element 106. As such, the horizontal structural element 106, the first projection 108*a*, and the second projection 108*b* may form a downward facing opening. More specifically, the downward facing opening may be defined by the lower edge 112*b* of the horizontal structural element 106 and the inside edges 118*a*, 118*b* of the first and second projections 108*a*, 108*b*. In some embodiments, ends 116*a* and 116*b* may be a series of saw blade-like grabbers such that it makes it more difficult to pull out of ground once inserted. Similarly, these ends could be extended with small diameter or toothpick-like rods to make it easier to insert into a firm surface like dirt, clay, thick grass, etc. These grounding rods could be cut or molded into the original part or attached later by fastener, insert slot into mating hole cut into 114*a* and 114*b*.

In some examples, the downward facing opening may generally define an inverted U shape. The inside edges 118*a*, 118*b* of the first and the second projections 108*a*, 108*b* and the lower edge 112*b* of the horizontal structural element 106 may form smooth or curved joints. This may be achieved by forming the lower edge 112*b* of the horizontal structural element 106 and at least the portions of the inside edges 118*a*, 118*b* of the projections 108*a*, 108*b* near the horizontal structural element 106 into concave arcs having common curvatures where they may meet or join. The smooth or curved joints between the lower edge 112*b* of the horizontal structural element 106 and the first and second projections 108*a*, 108*b* may increase the overall structural strength of the lower portion 104 of the information conveying apparatus 100 when positioned into a medium, such as soil or rocks. The lower edge 112*b* of the horizontal structural element 106 and the first and second projections 108*a*, 108*b* may form corners of other shapes for easy tooling and other considerations. Buttresses may be added to the horizontal structural element 106 and the downward projections 108*a*, 108*b* to enhance the structural strength of the lower portion 104 of the information conveying apparatus 100.

The upper edge 112*a* of the horizontal structural element 106 and the outside edges 120*a*, 120*b* of the first and second projections 108*a*, 108*b* may be substantially straight. Accordingly, the horizontal structural element 106, the first projection 108*a*, and the second projection 108*b* may include varied width profiles along their extensions. The horizontal structural element 106 may include width dimensions near its first and second ends 110*a*, 110*b* greater than a width dimension between its ends 110*a*, 110*b* because of the concave arc defined by the lower edge 112*b* of the horizontal structural element 106. Similarly, the first projection 108*a* and the second projection 108*b* may each include increased width dimensions near their respective first ends 114*a*, 114*b* joined to the horizontal structural element 106. The greater width dimensions at the joints between the horizontal structural element 106 and the first and second projections 108*a*, 108*b* further improve the structural strength of the lower portion 104 of the information conveying apparatus 100.

Each of the first and second projections 108*a*, 108*b* may include an engagement element 122*a*, 122*b* positioned near their respective second ends 116*a*, 116*b*. The engagement elements 122*a*, 122*b* may be configured to engage a retaining member 124, as described in more detail below, for keeping the information conveying apparatus 100 in place. Each of the engagement elements 122*a*, 122*b* may include a protrusion extending from the inner edge 118*a*, 118*b* of the first or second projection 108*a*, 108*b*. The protrusion may include a first edge or a base edge 126*a*, 126*b* extending from the inner edge 118*a*, 118*b* of the projection 108*a*, 108*b* in a substantially horizontal direction. The protrusion may also include a second edge or a side edge 128*a*, 128*b* extending from an end of the first edge 126*a*, 126*b* distal to the inner edge 118*a*, 118*b* of the projection 108*a*, 108*b* in a downward direction. In some examples, the second edge or the side edge 128*a*, 128*b* may be configured to extend towards the outside edge 120*a*, 120*b* of the projection 108*a*, 108*b*. The side edge 128*a*, 128*b* of the engagement element 122*a*, 122*b* and the outside edge 120*a*, 120*b* of the projection 108*a*, 108*b* may collectively define a tapered end of the projection 108*a*, 108*b* with a downward pointing apex. The tapered ends of the first and second projections 108*a*, 108*b* may facilitate the insertion of the projections 108*a*, 108*b* into the support medium.

With reference to FIGS. 1A, 1B, 3A, and 3B, the retaining member 124 may be configured as an elliptical plate. Other shapes of the plate, such as square, rectangle, triangle, circle, etc., may be contemplated. The retaining member 124 may include notches, slots, or openings formed near its periphery. In some examples, the retaining member 124 may include a first notch 130*a* and a second notch 130*b* formed at its periphery at either end of the major axis 132 of the elliptical plate. In some examples, the first notch 130*a* and the second notch 130*b* may be formed at either end of the minor axis 134 of the elliptical plate. The first notch 130*a* may be configured for slidably receiving therein a width portion of the first projection 108*a*. The second notch 130*b* may be configured for slidably receiving therein a width portion of the second projection 108*b*. The width dimension of each of the first and second notches 130*a*, 130*b* may substantially correspond to the thickness of the respective portions of the first or second projections 108*a*, 108*b* received therein. The first and second notches 130*a*, 130*b* may include width dimensions slightly greater than the thickness dimensions of the first and second projections 108*a*, 108*b* for easily engaging the elliptical plate and the projections 108*a*, 108*b*.

The elliptical plate may include a major axis 132 greater than the distance between the inner edge 118*a* of the first projection 108*a* and the inner edge 118*b* of the second projection 108*b*. Each of the notches 130*a*, 130*b* may be configured with an appropriate depth such that the distance between the closed ends of the notches 130*a*, 130*b* may be substantially the same as, or similar to, the distance between the inner edges 118*a*, 118*b* of the first and the second projections 108*a*, 108*b* measured near the engagement elements 122*a*, 122*b*. In some examples, the distance between the closed ends of the notches 130*a*, 130*b* may be smaller than the distance between the inner edges 118*a*, 118*b* of the first and the second projections 108*a*, 108*b*, but not smaller than the distance between the engagement elements 122*a*, 122*b* of the first and second projections 108*a*, 108*b*. As such, when the retaining member 124 engages the first projection 108*a* and the second projection 108*b*, an underside of the retaining member 124 may rest against and be supported by the engagement elements 122*a*, 122*b* of the first and second projections 108*a*, 108*b*.

To engage the retaining member 124 and the lower portion 104 of the information conveying apparatus 100, a width portion of the first projection 108*a* adjacent to its engagement element 122*a* may be slidably received within the first notch 130*a* of the retaining member 124, and a width portion of the second projection 108*b* adjacent to its engagement element 122*b* may be slidably received within the second notch 130*b* of the retaining member 124. Because the width dimensions of the notches 130*a*, 130*b* may substantially correspond to or be slightly greater than the thickness dimensions of portions of the first and second projections 108*a*, 108*b* received therein, the retaining member 124 may maintain its angular orientation with respect to the information conveying apparatus 100 when they engage. In some examples, the retaining member 124 may be oriented substantially perpendicular to the information conveying apparatus 100. In some examples, a slightly greater width dimension of the notches 130*a*, 130*b* may allow for easy engagement between the retaining member 124 and the projections 108*a*, 108*b*, but may leave the retaining member 124 to pivot or rock from side to side about its major axis 132. It is desirable to keep the rocking motion of the retaining member 124 within an appropriate range to prevent the retaining member 124 from accidental disengagement from the projections 108*a*, 108*b* of the information conveying apparatus 100.

As discussed earlier, the lower portion 104 of the information conveying apparatus 100 may be positioned or submerged under a ground surface and held in position by the surrounding medium, such as soil or rocks, so as to support the upper portion 102 above the surface for displaying information to a viewer. In some occasions, a greater resistance for removing the lower portion 104 out of the medium may be desired. Such greater resistance may be achieved by using the retaining member 124. To set up the information conveying apparatus 100, a person may first excavate a site where the information conveying apparatus 100 may be positioned by removing the soil below the ground surface. The excavation may create a hole or a well for positioning at least a portion of the lower portion 104 of the information conveying apparatus 100 and the engaged retaining member 124 inside the hole below the ground surface. The person may then backfill the hole and cover the retaining member 124 and at least a portion of the lower portion 104 of the information conveying apparatus 100 with soil.

Figure 4A:
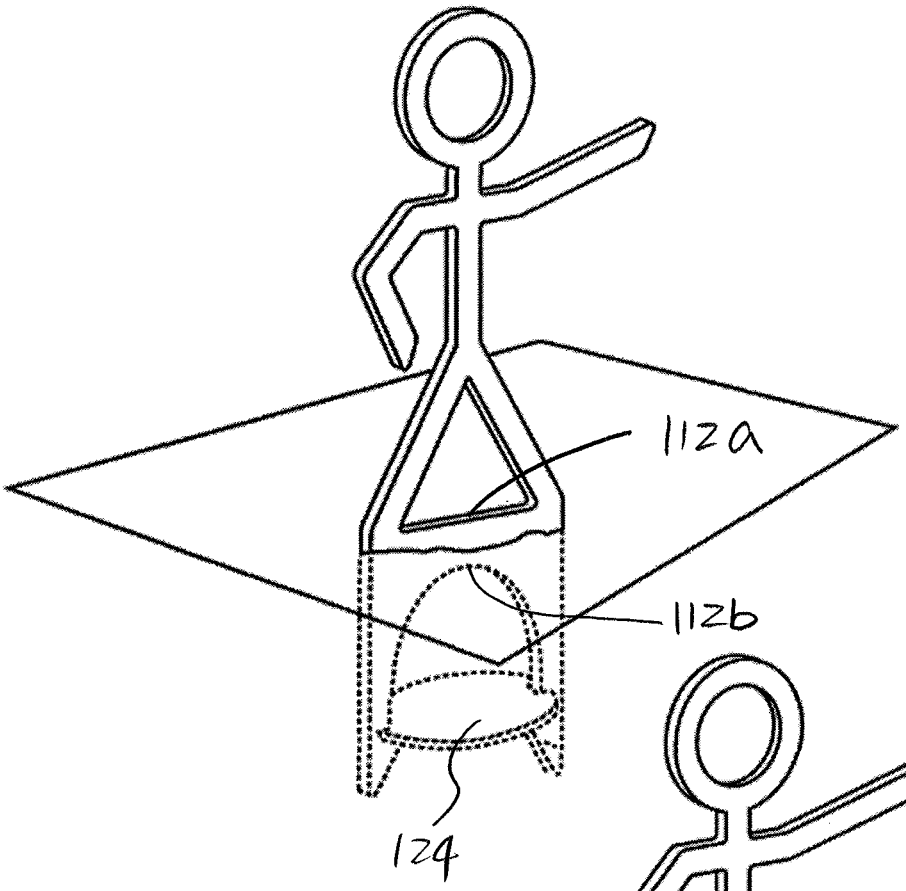
FIGS. 4A and 4B illustrate the information conveying apparatus of FIGS. 1A and 1B in use.

With reference to FIG. 4A, the lower edge 112*b* of the horizontal structural element 106 may be positioned below the ground surface and the upper edge 112*a* of the horizontal structural element 106 may be positioned above the ground surface. Such positioning may allow the planar information conveying apparatus 100 to form a greater contact area with the surrounding medium, such as soil, at the ground surface, which in turn may provide increased support and stability for the upper portion 102 exposed above the ground surface.

Figure 4B:
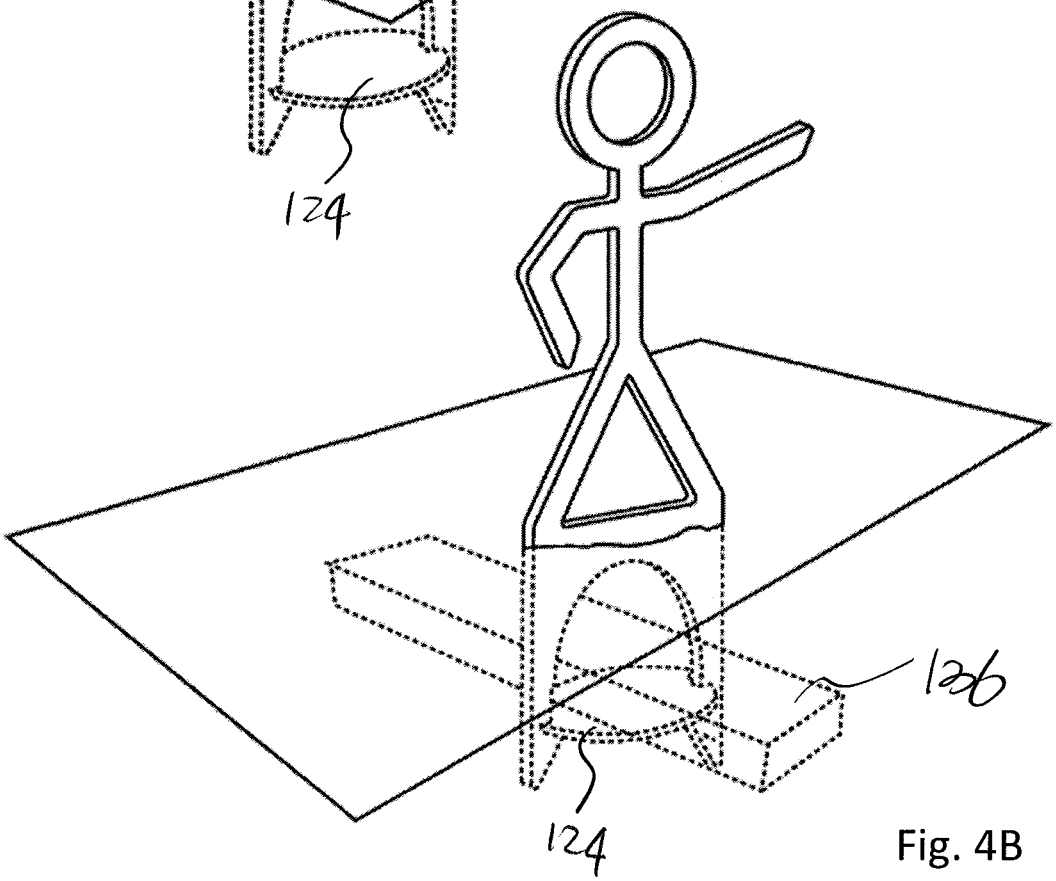

With reference to FIG. 4B, a user may place one or more additional retaining elements 136 on the upper side of the retaining member 124 for added resistance. The additional retaining elements may include a board, a plank, a rod, a bar, or any suitable weight objects. In some examples, the additional retaining element may be an existing structure in the ground, such as a pipe, which may not be excavated or removed. In this case, the person, after excavating the soil and before engaging the retaining member 124, may position the two projections 108*a*, 108*b* of the lower portion 104 of the information conveying apparatus 100 at either side of the pipe with the respective engagement elements 122*a*, 122*b* positioned lower than the pipe. The user then may engage the retaining member 124 and the engagement elements 122*a*, 122*b* of the projections 108*a*, 108*b* and backfill. In this case, the pipe may or may not rest on the retaining member 124. By using the retaining member 124 with or without additional retaining elements 136 as described herein, the information conveying apparatus 100 may be positioned in a set location without ease of removal or repositioning by a person or party without permission, knowledge or authorization. Problems associated with alteration of placement or misplacement may be avoided and reliable information may be provided by the information conveying apparatus 100 for an observer to gain pertinent information.

Although two downward projections 108*a*, 108*b* are described herein for engaging at two spaced apart locations at the periphery of the retaining member 124, it is contemplated that the lower portion 104 of the information conveying apparatus 100 may be configured with only one or more than two projections formed with engagement elements or side protrusions. The one or more projections may engage the retaining member 124 near a center of the retaining member 124 and/or at any suitable portion of the retaining member 124. Each of the one or more projections may be configured with one or more engagement elements or side protrusions configured to engage a notched portion of the retaining member 124. Upper edges of the one or more engagement elements or side protrusions may effectively form a platform that may support the retaining member 124.

Referring back to FIGS. 1A, 1B, and 2, the upper portion 102 may include an elongated torso member 150 having an upper end portion 150*a* and a lower end portion 150*b*. A circular head member 152 may be joined to the torso member 150 near the upper end portion 150*a* of the torso member 150. The head member 152 may include a center opening 154 and may be formed as a circular ring member with appropriate width dimension for sufficient structural strength. The circular ring member may enable ease of handling whether to hold, carry, hang up, or store the information conveying apparatus 100. For example, the ring of the head member 152 may be placed over a nail or hook on a wall for display or storage. The upper portion 102 of the information conveying apparatus 100 may further include first and second, or left and right, elongated arm members 156, 158 joined to the torso member 150 between its upper and lower end portions 150*a*, 150*b* by first and second shoulder members 160*a*, 160*b*, respectively. First and second, or left and right, elongated leg members 162*a*, 162*b* may be joined to the torso member 150 near its lower end portion 150*b*. The head member 152, torso member 150, shoulder members 160*a*, 160*b*, arm members 156, 158, and leg members 162*a*, 162*b* together may resemble a stick figure. The upper portion 102, or the stick figure in this example, may be supported by the lower portion 104 of the information conveying apparatus 100 by joining the ends of the leg members 162*a*, 162*b* to the upper edge 112*a* of the horizontal structural element 106. The leg members 162*a*, 162*b* and the horizontal structural element 106 may form an equilateral triangle, which may provide vertical and horizontal structural strength and stability to the information conveying apparatus 100.

Shaping and configuring the head, arm, and leg members 152, 156, 158, 162*a*, 162*b* to resemble a stick figure may result in a relatively easy structure to design and build. The relatively small width dimensions of the torso, arm, and leg members 150, 156, 158, 162*a*, 162*b* relative to the lengths of these members may result in a relatively small surface area for the stick figure structure, which may help minimize the risk of an upright standing stick figure structure falling over when it is windy. Shaping and configuring the head, arm, and leg members 152, 156, 158, 162*a*, 162*b* to resemble a stick figure may also enable the arm and leg members 156, 158, 162*a*, 162*b* to be further configured to convey information to an observer of the stick figure structure in a manner similar to how a person conveys non-verbal and non-written information to other people using the person's arms and legs. For example, one or both of the stick figure structure's arm members 158 may be arranged to point in a certain direction to convey information to observers of the stick figure structure about a direction to proceed, similar to a person directing traffic using the person's arms to point in a direction to proceed. Further, the mere presence of the stick figure structure may indicate that a person may be present, involved, in the area, and/or nearby whether working, standing, or walking.

With reference to FIG. 2, at least one of the arm members 158 may extend in a substantially horizontal direction while tilting and/or bending slightly upward to compensate for uneven placement of the information conveying apparatus 100. In some examples, additional signs, banners, and other objects of various shapes conveying written or other information to an observer may hang on the extended arm member 158. In some examples, two holes or slots may be formed in the extended arm 158. In some examples, ring members, such as D-rings, may be joined to the lower edge 112*b* of the extended arm 158. The extended arm 158 and the hanging sign can be operably joined together using a wire, chord, chain, clip, rope, or any suitable connection mechanism, which may allow the hanging sign to be changed out easily. The hanging sign may hang and swing freely from the extended arm 158 member to allow the wind to pass through with ease.

Various ways of positioning the arm members may be contemplated to convey different messages. No words may be necessary to convey meaning because the gestures of a stick figure may be recognizable by a majority of people based on their own interaction with humans or personal performance. For example, positioning the two arm members pointing in eight o'clock and four o'clock directions, respectively, may generally convey the meaning of warning and/or resistance. By positioning more than one of such stick figures side by side, a hold-hands barricade may be formed. In some examples, the two arm members may be configured to point in two o'clock and ten o'clock directions, respectively, which may generally convey the meaning of wait, attention, pause, hold, quiet, and/or victory. The two arm members may be configured to point in three o'clock and nine o'clock directions, respectively, which may generally convey the message of going either way, inclusiveness, full reach, backing off, and/or staying out. In other examples, the two arm members may be configured to bend downward at either side to represent a guard, unit, muscle, obstacle, and/or blockage. In another example, one of the arm members may be configured to bend up, and the other arm member may be configured to extend out, which may instruct an observer of the stick figure to stop or slow down and then travel or look in a depicted direction. In yet another example, configuring one arm member pointing in a two o'clock direction may generally convey the meaning of inquiry, question, looking up, hold, wait, and/or number one.

Figure 5A:
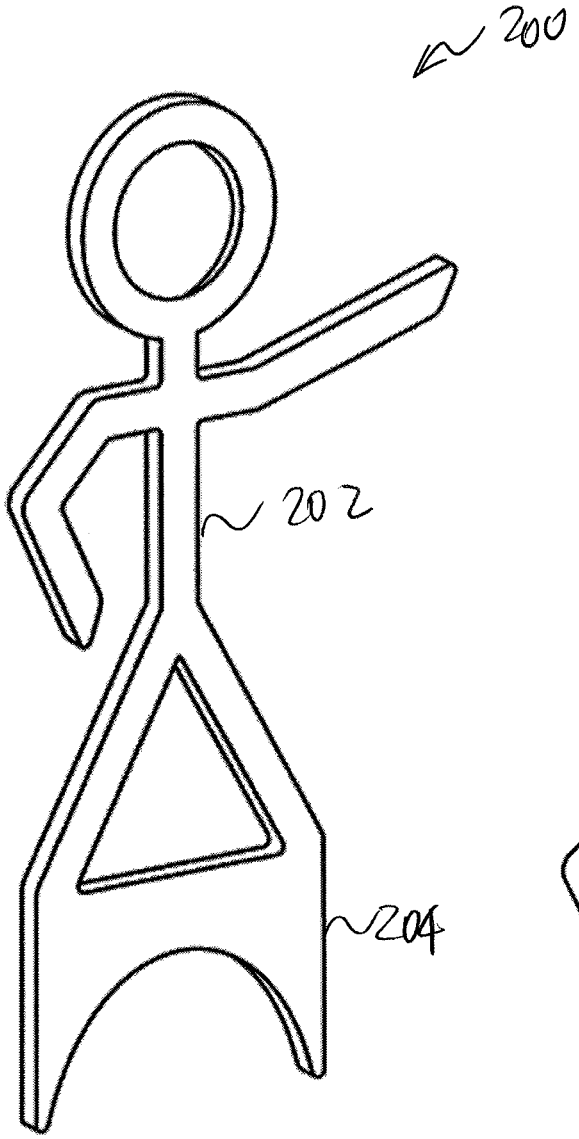
FIGS. 5A and 5B illustrate various views of another embodiment of an information conveying apparatus.
Figure 5B:
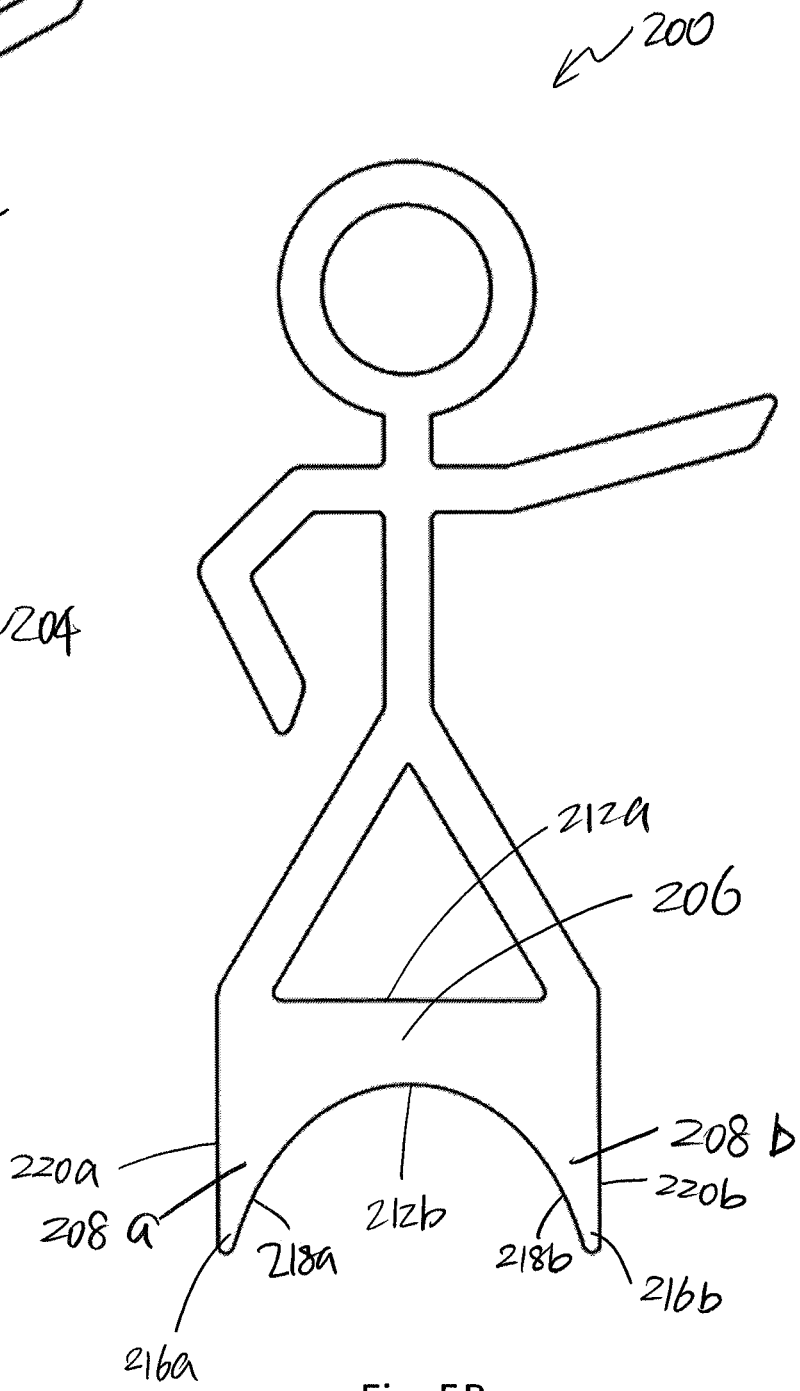
Figure 6:
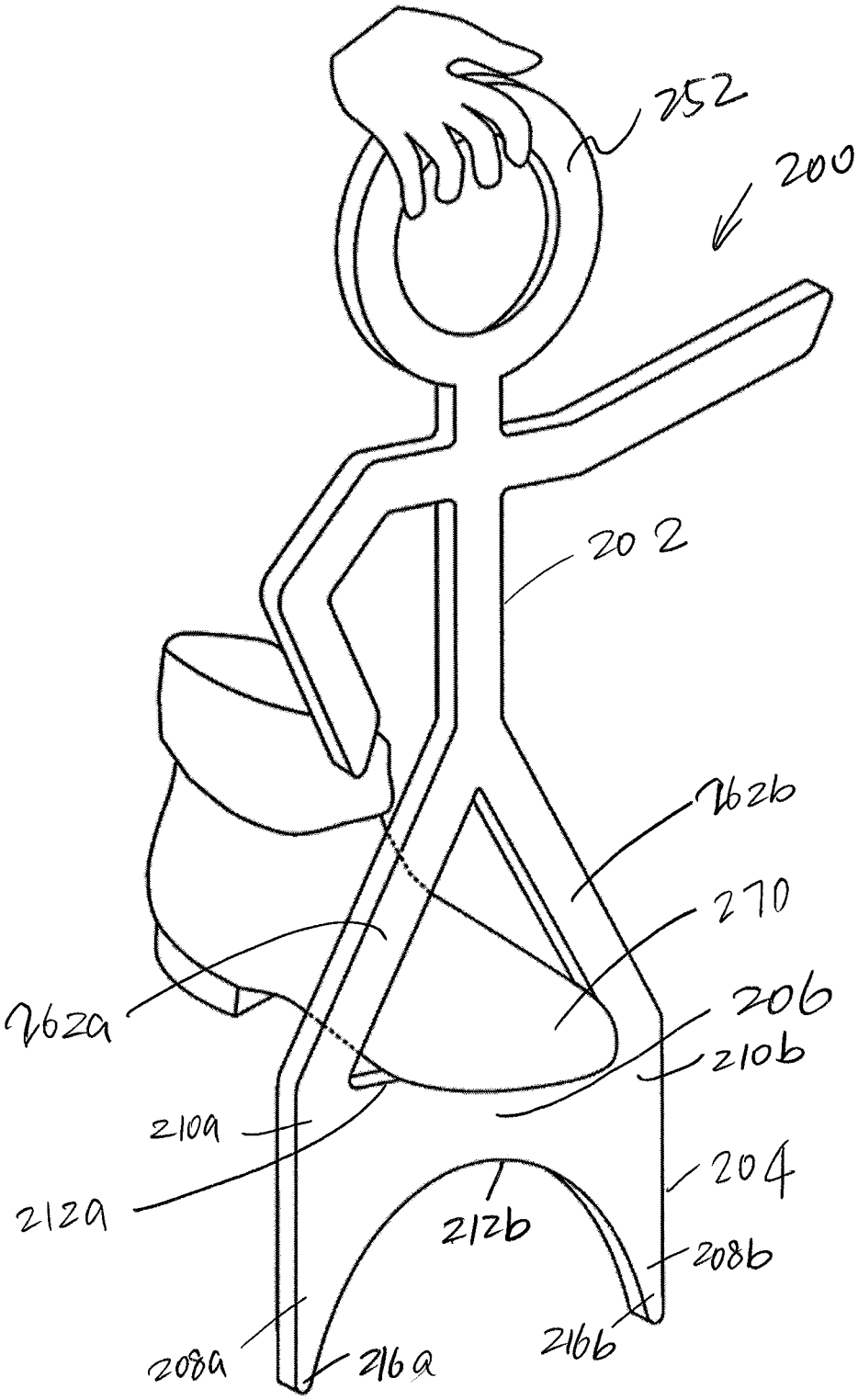
FIG. 6 illustrates the information conveying apparatus of FIGS. 5A and 5B in use.

With reference to FIGS. 5A, 5B, and 6, another information conveying apparatus 200 will be described. Similar to the examples described above, the information conveying apparatus 200 may include an upper portion 202 and a lower portion 204 arranged along a longitudinal dimension of the information conveying apparatus 200. The upper portion 202 may be substantially the same as that of the information conveying apparatus 100 described with respect to FIGS. 1A, 1B, 2, 4A, and 4B. The lower portion 204 may be configured such that the information conveying apparatus 200 may be easily inserted into a support medium or pulled out of the support medium with or without excavation and backfill.

The lower portion 204 of the information conveying apparatus 200 may include a horizontal structural element 206 and first and second projections 208*a*, 208*b* extending downwardly from the horizontal structural element 206. The horizontal structural element 206 may include an upper edge 212*a* for joining to and supporting the upper portion 202 of the information conveying apparatus 200, and a lower edge 212*b* defining a concave opening. The end portions of the lower edge 212*b* of the horizontal structural element 206 may define the inner edges 218*a*, 218*b* of the first and second projections 208*a*, 208*b*. The inner edges 218*a*, 218*b* and the outer edges 220*a*, 220*b* of the first and second projections 208*a*, 208*b* may converge at the respective ends 216*a*, 216*b* of the first and second projections 208*a*, 208*b* distal to the upper portion 202 of the information conveying apparatus 200. The distal ends 216*a*, 216*b* of the first and second projections 208*a*, 208*b* may each define a tapered end of the projection 208*a*, 208*b* with a downward pointing apex. Such tapered ends 216*a*, 216*b* of the projections 208*a*, 208*b* may allow for easy insertion and/or quick removal of the information conveying apparatus 200 into and/or out of a supporting medium.

With reference to FIG. 6, to set up the information conveying apparatus 200 for conveying information represented by the upper portion 202, a user may position at least a portion of the lower portion 204 of the information conveying apparatus 200 into a solid medium, such as soil, dirt, rocks, gravel, for support. The user may first orient the information conveying apparatus 200 at any desired angle relative to the surface of the medium, such as the ground surface, with the first and second projections 208*a*, 208*b* pointing in a substantially downward direction. The user may then apply a downward force on the upper edge 212*a* of the horizontal structural element 206 to cause the first and second projections 208*a*, 208*b* to enter into the solid medium. In some examples, the left and right leg members 262*a*, 262*b* of the stick-figure-resembling upper portion 202 of the information conveying apparatus 200 and the horizontal structural element 206 of the lower portion 204 may form an opening of a suitable size for the user's foot 270 to be positioned therethrough. The user may step on the upper edge 212*a* of the horizontal structural element 206 and may apply downward pressure using the user's body weight. The tapered ends 216*a*, 216*b* of the first and second projections 208*a*, 208*b* may facilitate the downward motion of the first and second projections 208*a*, 208*b* into the support medium.

The user may also hold the head member 252 of the stick-figure-resembling upper portion 202 of the information conveying apparatus 200 to maintain the position of the information conveying apparatus 200 relative to the ground. The user may continue applying the downward force on the upper edge 212*a* of the horizontal structural element 206 until the lower edge 212*b* of the horizontal structural element 206 reaches below the ground surface while the upper edge 212*a* remains above the ground surface. This way, the information conveying apparatus 200 may be supported across the entire longitudinal dimension between the ends 210*a*, 210*b* of the horizontal structural element 206, which may help minimize the risk of the information conveying apparatus 200 falling over. The information conveying apparatus 200 may be positioned deeper into the medium, such as a position where the upper edge 212*a* of the horizontal structural element 206 being beneath the ground surface, or may be positioned less deep into the medium, such as a position where the lower edge 212*b* of the horizontal structural element 206 is being partially exposed above the ground surface, for other considerations.

To remove the information conveying apparatus 200 out of the medium, a user may simply apply an upward force by grabbing the head member 252 and/or other members of the stick-figure-resembling upper portion 202 and pulling up the information conveying apparatus 200. The information conveying apparatus 200 may be configured with appropriate thickness and width dimensions and/or made from suitable materials such that the information conveying apparatus 200 may be able to withstand the pushing and/or pulling forces for inserting it into and pulling it out of the support medium multiple times without tools and/or without excavation or backfilling. The upper portion 202 of the information conveying apparatus 200 may be configured with an appropriate height dimension for an average adult to comfortably hold the head member 252 of the upper portion 202 and step on the upper edge 212*a* of the lower portion 204. Alternatively, the information conveying apparatus 200 may be configured with variable height dimensions to accommodate users of different heights or for any other consideration.

When not used in combination with the retaining member 124, the information conveying apparatus 100 of FIGS. 1A, 1B, and 2 may also be set up to be supported by the medium or removed from the medium in a manner similar to that in which the information conveying apparatus 200 of FIG. 6 may be set up.

Figure 7:
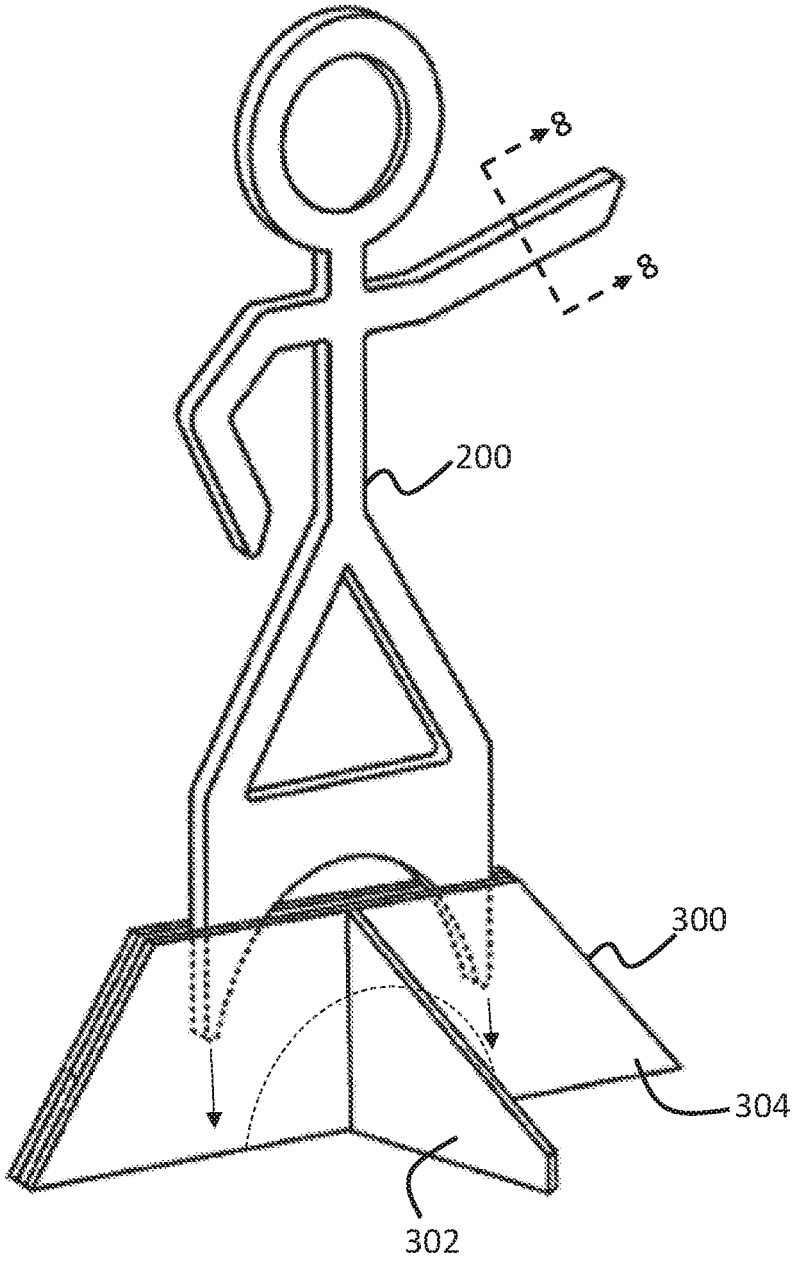
FIG. 7 illustrates a support base for use with the information conveying apparatus of FIGS. 5A and 5B.
Figure 8A:
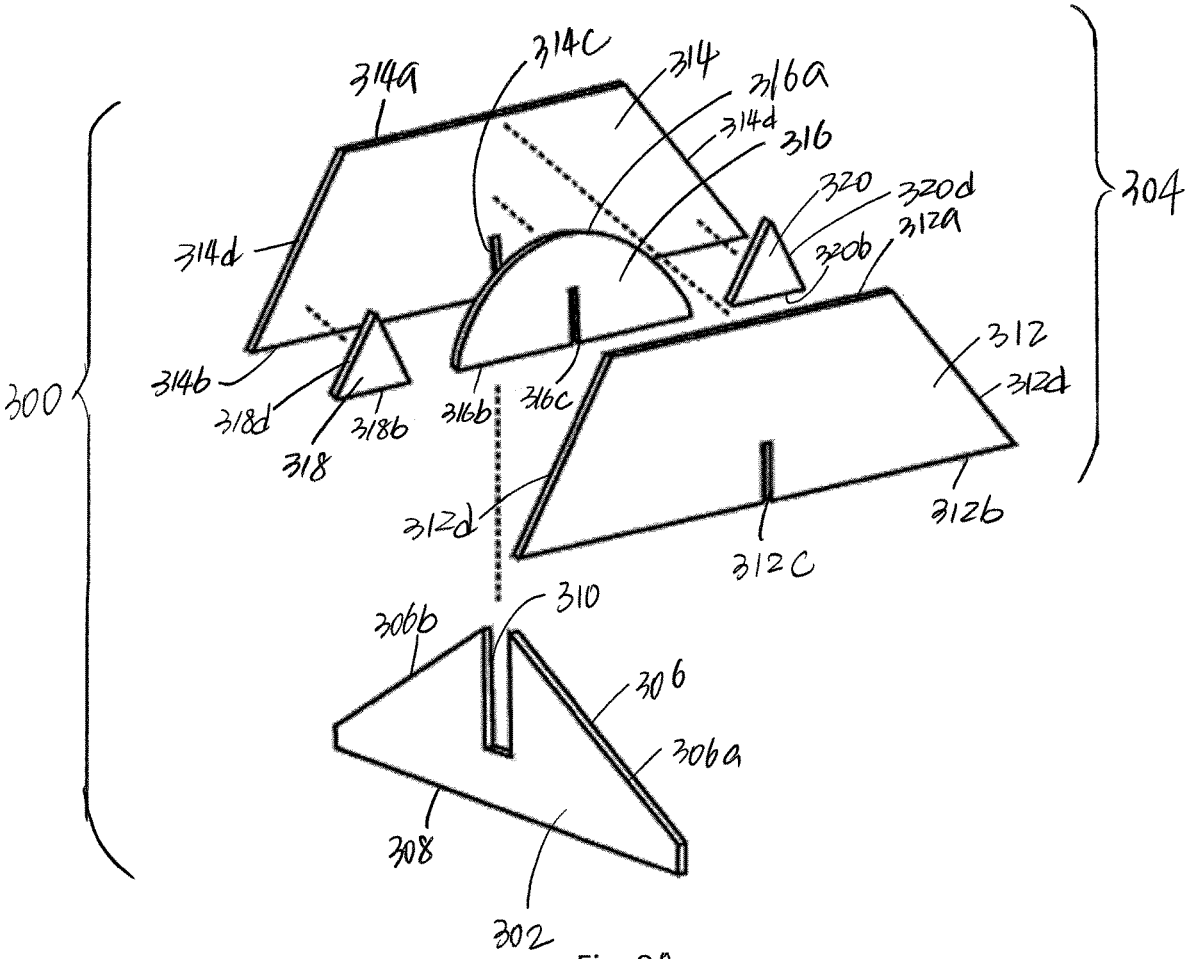
FIG. 8A illustrates an exploded view of the support base of FIG. 7.
Figures 1, 19A:
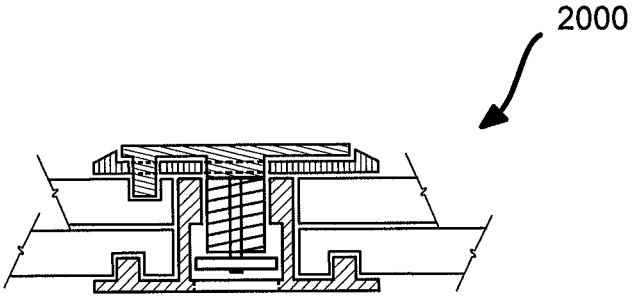
Figures 1A, 19A:
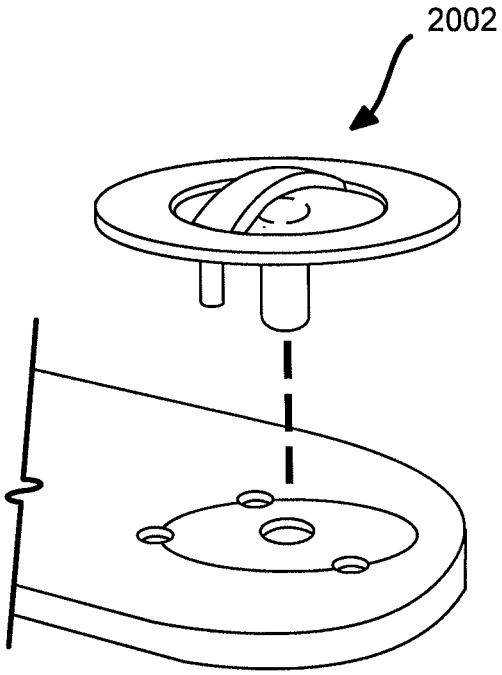
Figures 3, 19A:
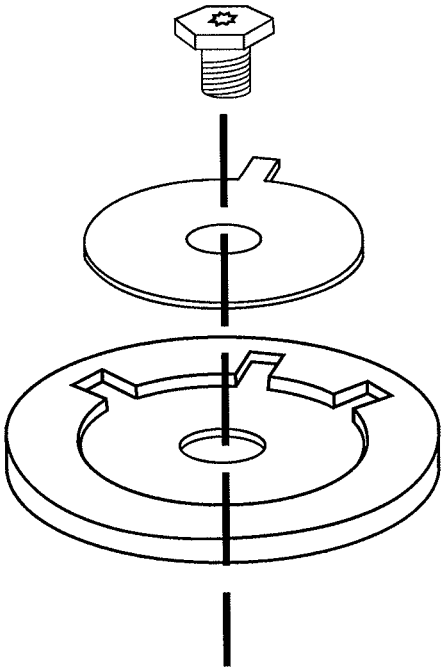
Figures 2, 19A:
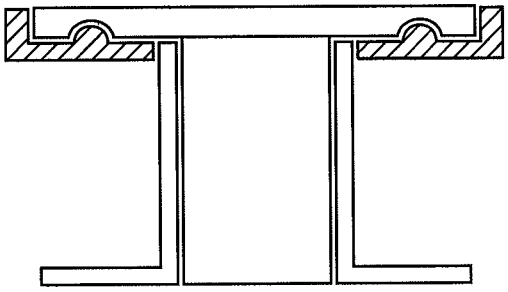

Sometimes it may be undesirable to press the information conveying apparatus into the ground or any suitable material for upright positioning. The information conveying apparatus may be supported by a self-standing support base for maintaining the information conveying apparatus in a substantially upright and stable position. With reference to FIGS. 7 and 8, a support base 300 for supporting the information conveying apparatus 200 in a substantially upright or vertical position will be described. The support base 300 may include a first support structure 302 and a second support structure 304 configured to removably engage each other in a crossed configuration. The first support structure 302 may include a panel or relatively rigid sheet material. The panel or sheet may include a top edge 306 and a base edge 308. A notch or an elongated opening 310 may be formed at the top edge 306 for engaging the second support structure 304 (described below) and may be oriented substantially perpendicular to the base edge 308 of the panel or sheet. The notch 310 may be positioned near a middle portion of the top edge 306 and separate the top edge 306 into two edge segments 306*a*, 306*b*. The two edge segments 306*a*, 306*b* may align with each other and define a substantially straight top edge profile. Alternatively, the two edge segments 306*a*, 306*b* may be oriented at an angle with respect to each other and extensions of the two edge segments 306*a*, 306*b* may intersect each other. In the example shown in FIG. 8A, the two edge segments 306*a*, 306*b* may be oriented such that the end of each segment 306*a*, 306*b* distal to the notch 310 may be closer to the base edge 308 than the end of the same segment proximal to the notch 310. Accordingly, the two edge segments 306*a*, 306*b* and the base edge 308 may form two tapered ends pointing away from the notch 310. The base edge 308 may define a substantially straight base edge profile to rest against a support surface. In an alternative embodiment, as shown in FIGS. 8B-1 through 8B-2, the information conveying apparatus 200 is slotted directly into a different flat part that is similar in shape to support structure 302 and may be used without support structure 304. In this embodiment, intersecting notches, sized a little larger than the material thickness, are centered in apparatus 200 and support structure 302*a* such that apparatus 200 slides or otherwise engages with support structure 302*a* at an angle of approximately 90 degrees. Apparatus 200 is notched at the top center of the arch between the feet. Support structure 302*a* is notched at the top and is configured to receive or engage with apparatus 200. In some embodiments, and as depicted in FIG. 8B-3, another option to incorporate a ground-mounting mechanism is to make a hole in 206 for the attachment of secondary grounding device. This could be a shaped hole that corresponds to a mounting nub on a rigid, straight rod as shown in b1. It could also be a simple hole enabling a user to pass through a bent rod or wire for insertion of one or both ends into the ground as shown in b2.

The second support structure 304 may include multiple panels configured in a sandwich structure. The multiple panels may include a front support member 312, a rear support member 314, and at least one center support member 316, 318, 320 to be positioned between the front and rear support members 312, 314. The front support member 312 and the rear support member 314 may be trapezoidal-shaped panels. The two parallel edges 312*a*, 312*b*, 314*a*, 314*b* of each of the front and rear support members 312, 314 may define a top edge 312*a*, 314*a* and a base edge 312*b*, 314*b* of the respective front or rear support member 314. The base edge 312*b*, 314*b* may rest against a support surface when assembled and may be configured to be longer than the top edge 312*a*, 314*a* for added support. A notch or elongated opening 312*c*, 314*c* may be formed at the base edge 312*b*, 314*b* near a middle portion of the base edge 312*b*, 314*b* of each of the front and rear support members 312, 314.

In continuing reference to FIGS. 7 and 8, the center support member may include a middle support element 316, a left side support element 318, and a right side support element 320. Each of the support elements 316, 318, 320 may include a base edge 316*b*, 318*b*, 320*b* that may be parallel to and align with the base edges 312*b*, 314*b* of the front and rear support members 312, 314 when positioned therebetween. The middle support element 316 may further include a notch 316*c* or elongated opening formed at the base edge 316*b* thereof near the middle portion of the base edge 316*b*. The notches 312*c*, 314*c* of the front and rear support members 312, 314 and the notch 316*c* of the middle support element 316 may be configured with the same depth and configured to engage the first support structure 302. The middle support element 316 may include a top edge 316*a*, at least a portion of which may be configured to align with or complement an edge portion of the information conveying apparatus 200. The top edge 316*a* may include a portion that defines a convex arc complementary to the lower edge 212*b* of the horizontal structural element 206 that defines the concave opening of the lower portion 204 of the information conveying apparatus 200 (see, for example, FIG. 7). The middle support element 316 and the left and right side support elements 318, 320 may form any shape, including round, triangle, square, rectangular, trapezoidal, or any other suitable shape. It is contemplated that the first support structure 302 may also include multiple support members and be formed as a multi-layer support structure similar to the second support structure 304.

The support base 300 may be assembled by first assembling the front, center, and rear support members 312, 314, 316, 318, 320 to form the second support structure 304. The left side support element 318 may be operably joined to one of the front and rear support members 312, 314 near one of the bottom corners of the front or rear support member 312, 314. The right side support element 320 may be operably joined to the same front or rear support member 312, 314 near the other one of the bottom corners. Alternatively, the right side support element 320 may be operably joined to the other one of the front or rear support member 312, 314. The left and right support elements 318, 320 may be operably joined to the front and rear support members 312, 314 by glue, tape, screw, rivet, or any suitable fastening mechanism. The middle support element 316 may be positioned between the front and rear support members 312, 314 such that the notch 316*c* of the middle support element 316 may align with the notches 312*c*, 314*c* of the front and rear support members 312, 314. The middle support element 316 may simply be kept in position by the engagement between the first and second support structures 302, 304 without an additional fastening mechanism. Alternatively, the middle support element 316 may be operably joined to one of the front and rear support members 312, 314 by glue, tape, screw, rivet, or any suitable fastening mechanism.

When the front, center, and rear support members 312, 314, 316, 318, 320 are operably joined together, one of the side edges 318*d*, 320*d* of the left and right support elements 318, 320 may align with the adjacent side edges 312*d*, 314*d* of the front and rear support members 312, 314, and the base edges 316*b*, 318*b*, 320*b* of the middle, left, and right support elements 316, 318, 320 may align with the base edges 312*b*, 314*b* of the front and rear support members 312, 314. The middle support element 316 may be spaced apart from each of the left and right side support elements 318, 320. The middle, left, and right support elements 316, 318, 320 may be configured with substantially the same or similar thickness dimensions, which may substantially correspond to or be slightly greater than the thickness dimension of the lower portion 204 of the information conveying apparatus 200. As such, the middle, left, and right support elements 316, 318, 320 may effectively create one or more gaps between the front and rear support members 312, 314 for receiving therein a portion of or the entire lower portion 204 of the information conveying apparatus 200 and for supporting it in a stable, upright position.

The first support structure 302 and the assembled second support structure 304 may engage each other by sliding into each other's notches 310, 312*c*, 314*c*, 316*c* and resting against the terminal or closed ends of the notches 310, 312*c*, 314*c*, 316*c*. The engaged first and second support structures 302, 304 may be oriented at an angle of 90 degrees or any other suitable angle and form an X or a plus sign when viewed from the top or bottom. The notch 310 of the first support structure 302 and the aligned notches 312*c*, 314*c*, 316*c* of the second support structure 304 may be configured with appropriate depth dimensions such that when the first and second support structures 302, 304 engage, the base edges 308, 312*b*, 314*b*, 316*b*, 318*b*, 320*b* of the first and second support structures 302, 304 may rest on a common plane. The notch 310 of the first support structure 302 may include a width dimension substantially corresponding to the combined thickness of the front, center, and rear support members 312, 314, 316, 318, 320 of the second support structure 304. The aligned notches 312*c*, 314*c*, 316*c* of the second support structure 304 may include a width dimension substantially corresponding to the thickness of the first support structure 302. As such, the first and second support structures 302, 304 may interlock with each other and the relative orientation of the first and second support structures 302, 304 may be maintained when they engage. Accordingly, the interlocking first and second support structures 302, 304 with their base edges 308, 312*b*, 314*b*, 316*b*, 318*b*, 320*b* resting on a support surface, such as a ground surface, may provide a stable support base 300 for the information conveying apparatus 200.

Once the support base 300 is assembled, a user may slide or insert the projections 208*a*, 208*b* of the information conveying apparatus 200 into the space between the front and rear support members 312, 314 of the second support structure 304 with the projections 208*a*, 208*b* positioned at either side of the middle support element 316. The user may continue pushing the information conveying apparatus 200 until the lower portion 204 of the information conveying apparatus 200 engages the middle support element 316. The middle support element 316 may be configured with an appropriate height dimension such that when it engages the information conveying apparatus 200, the projections 208*a*, 208*b* of the information conveying apparatus 200 may not extend beyond the base edges 312*b*, 314*b* of the front and rear support members 312, 314. The height dimension of the middle support element 316 may be further configured such that when the information conveying apparatus 200 engages the middle support element 316, the lower edge 212*b* of the horizontal structural element 206 may be below the top edges 312*a*, 314*a* of the front and rear support members 312, 314 and the upper edge 212*a* of the horizontal structural element 206 may remain above the top edges 312*a*, 314*a* of the front and rear support members 312, 314. Such configuration may allow the front and rear support members 312, 314 to form a greater contact area with the information conveying apparatus 200 and to provide increased stability for the upper portion 202 of the information conveying apparatus 200.

As described earlier, the top edge 316*a*, or a portion thereof, of the middle support element 316 may be configured to align with or complement an edge portion of the information conveying apparatus 200, such as the lower edge 212*b*, or a portion thereof, of the horizontal structural element 206 of the lower portion 204 of the information conveying apparatus 200. The complementary configuration between the middle support element 316 and the lower portion 204 of the information conveying apparatus 200 may allow the information conveying apparatus 200 to maintain a substantially upright position and to remain aligned with and centered relative to the support base 300.

Spaces or gaps along the base edges 312*b*, 314*b* of the front and rear support members 312, 314 may remain between the inserted information conveying apparatus 200 and the respective left and right support elements 318, 320 such that a spike or stake may enter from either side of the second structure 304 and pass through the gaps at the base edges 312*b*, 314*b* for additional anchoring. In this embodiment, the multi-part base was designed so that apparatus 200 sits on top of support element 316. The support elements 318 and 320 create a suitable blocking mechanism so that the shape remains upright. The triangle blocks also maintain proper gap between support members 312 and 314 and allow for the insertion of a pin, nail or stake to pass between support elements 318 and 316 in the situation where the stand needs to be anchored to the ground or surface preventing movement, theft or turning (direction change).

There are several advantages associated with supporting the information conveying apparatus 200 using the support base 300 as described herein. The support base 300 may provide sufficient material weight to keep itself and the supported information conveying apparatus 200 in place under temperate weather conditions. The middle, left, and right support elements 316, 318, 320 of the center support member of the support base 300 also provide several important functions. First, the middle, left, and right support elements 316, 318, 320 may effectively serve as spacers to create the appropriate thickness gap for insertion of the information conveying apparatus 200. Second, the middle, left, and right support elements 316, 318, 320 may also provide added weight to the base. Third, the middle support element 316 may allow the information conveying apparatus 200 to stand in a substantially upright position and to remain aligned and centered by mirroring the underside curve of the information conveying apparatus 200. The middle, left, and right support elements 316, 318, 320 may further maintain more solid or practically even distribution of strength along the length of the support base 300. The middle, left, and right support elements 316, 318, 320 may create the appropriate gap for insertion of mounting stakes and provide a hard stop with an inserted stake for resistance from extraction. Should the support base 300 need to be better anchored to a surface, stakes having a width of less than that of the middle, left, and right support elements 316, 318, 320 may be inserted between the parallel front and rear support members 312, 314 sandwiching the middle, left, and right support elements 316, 318, 320. The stakes may be made of any suitable material, such as metal, fiberglass, aluminum, and so on.

The various shapes of the information conveying apparatuses 100, 200 and the support base 300 as described herein may be made from a flat piece of material or a sheet material which may be cut out, routed, or die-stamped out of a suitable material ranging from semi-flexible to rigid, such as new or recycled plastic, fiberglass, aluminum, steel, or composite. The information conveying apparatuses 100, 200 and the support base 300 may also be stamped, cast, or injection molded using plastic, resin, reinforced resin, or metal. The information conveying apparatus 100, 200 and the support base 300 may be made out of a same material or different materials. The information conveying apparatus 100, 200 may be generally made out of the sheet material as one integral planar piece for structural integrity. Alternatively, the upper portion 102, 202, the lower portion 104, 204, and/or the various members and elements of the upper or lower portion 102, 104, 202, 204 may be produced as separate parts, which may be assembled or operably joined together by welding, glue, epoxy, or any suitable attaching mechanism. The planar or substantially two-dimensional structure of the information conveying apparatus 100, 200 may allow multiple information conveying apparatuses 100, 200 to be stacked, stored, and/or shipped flat. In addition, the planar or substantially two-dimensional structure of the information conveying apparatus 100, 200 may be able to shed snow, sleet, ice, dust, dirt, etc. and work well in weather conditions.

Figure 9:
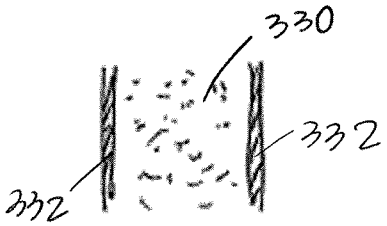
FIG. 9 illustrates a cross sectional view of an exemplary structure of a material for making various embodiments of the information conveying apparatus, the retaining member, and the support base.
Figure 10A:
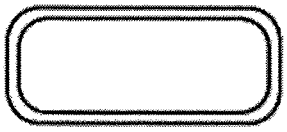
FIGS. 10A-10I show cross sections of various alternative embodiments of the information conveying apparatus disclosed herein.
Figure 10B:
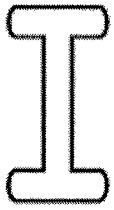
Figure 10C:
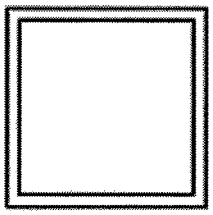
Figure 10D:
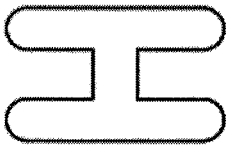
Figure 10E:
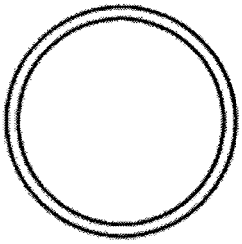
Figure 10F:
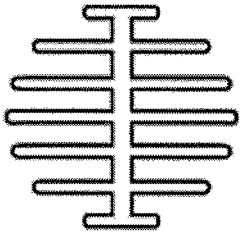
Figure 10G:
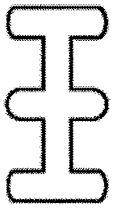
Figure 10H:
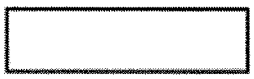
Figure 10I:
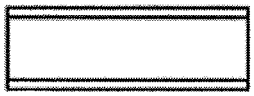

With reference to FIG. 9, the information conveying apparatus 100, 200 may be made out of a three-layer sheet material. The three-layer sheet material may include a recycled plastic core 330 and thin sheets of aluminum 332 securely attached to either side of the recycled plastic core 330. The recycled plastic core 330 and the thin aluminum sheets 332 may allow for overall light weight construction of the information conveying apparatus 100, 200 and at the same time provide sufficient durability. A colored coating may be applied to the outer surfaces of the aluminum sheets 332 to create a unique, distinctive, or specialized look. It can also be used for sourcing or identification purposes. The coating may also provide layered protection for the information conveying apparatus 100, 200 against elements in the environment, such as moisture, heat, etc. Printing may also be done directly onto the outer surfaces of the aluminum sheets 332 by machine or an individual for suitable decorations, words, and/or logos. The outer surfaces of the aluminum sheets 332, i.e., the surfaces of the information conveying apparatus 100, 200, may be applied with a uniform color, specific color combinations, or dedicated patterns. The coating material may be pre-applied, pre-ordered, mixed, or post-treated to match any desired color specification or regulation. In some embodiments, for durablility and ease of manufacturing, the apparatus 100, 200 is cut out of steel by laser and then power-coated (heat-treated paint) to minimize the possibility of rust.

With reference to FIGS. 10A-10I, the information conveying apparatus may be joined to the support base by welding, glue, stapling or any other suitable attachment mechanism. FIGS. 10A-10I illustrate cross sections of various alternative embodiments of the information conveying apparatus having a circular, square, rectangular ring shaped cross-section (FIGS. 10A, 10C, and 10E), ribs, H, T and I-beam shaped cross-sections (FIGS. 10B, 10D, 10F,10G), or a cross-section having one or more elongated strips (FIGS. 10H and 10I), or any other suitable shape. The information conveying apparatus may be formed by casting, injection molding or extrusion.

Figure 11A:
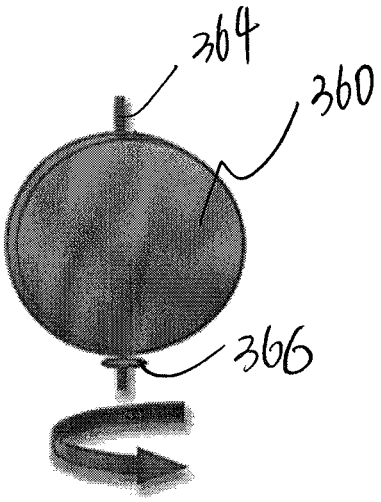
FIGS. 11A-11G illustrate embodiments of a head insert for use with an information conveying apparatus.
Figure 11B:
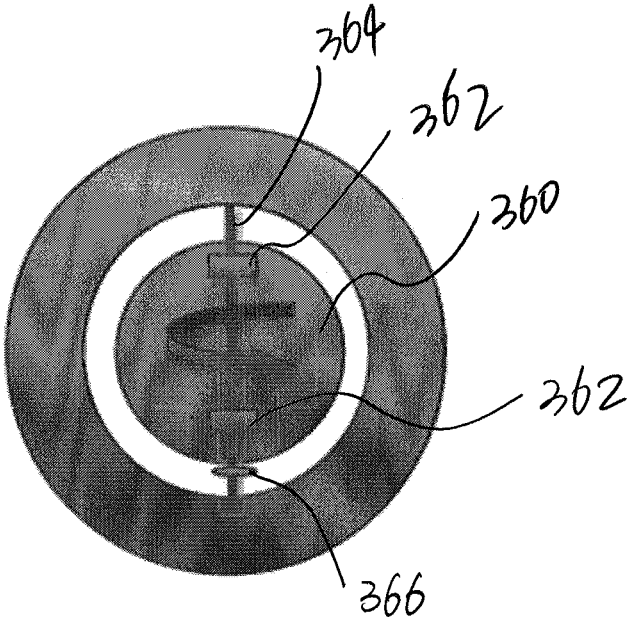

With reference to FIGS. 11A and 11B, the head member 152, 252 of the information conveying apparatus 100, 200 as described above may be configured to attach thereto a changeable head insert for displaying additional information, such as graphic designs, words, logos, etc., besides the information conveyed by the posture of the stick-figure-resembling portion 102, 202 of the information conveying apparatus 100, 200. The head area may be appropriate for placement of additional information or messaging because it is a common or frequent focal point by viewers in addition to the body position. The additional information may include statistics such as distance, elevations, area features, and so on. The head insert may include a round member with additional information on one or both sides of the round member. The round member may be made of fabric, plastic, or any suitable material. The diameter of the round member may be smaller than the diameter of the inner periphery of the circular ring member, which defines the head member 152, 252, such that a gap between the round member of the head insert and the circular head member 152, 252 may be formed. The gap may allow wind or air to pass through and may reduce the risk of the information conveying apparatus 100, 200 falling over. Connecting elements may be provided to one or both sides of the round member or may be disposed about the circumference of the round member for releasably or permanently joining the head insert to the head member 152, 252 of the information conveyance apparatus.

Figure 11C:
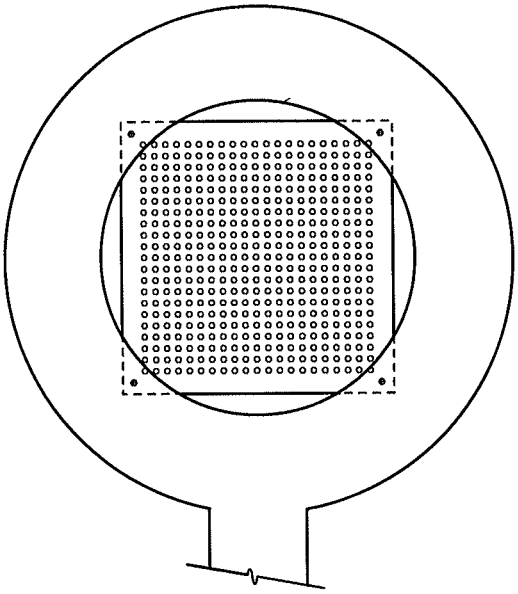
Figure 11D:
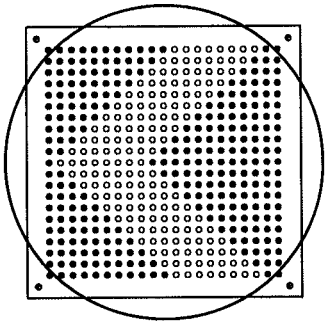
Figure 11E:
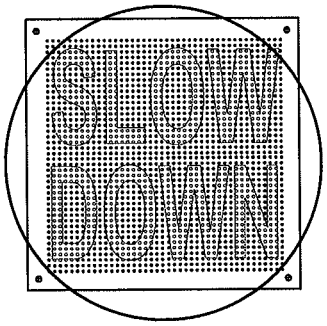
Figure 11F:
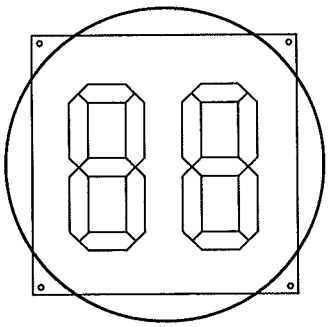
Figure 11G:
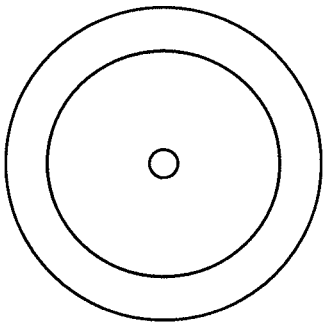

Referring now to FIGS. 11C-11G, the figures depict various alternative embodiments for the head insert 360. For example, the flat, solid or fabric-style of head insert 360 can be replaced by an electronic message board to have changeable instructions of words or symbols. The flat insert can also be modified to hold a camera and/or speaker and/or antenna for taking remote pictures, audible instructions or electronic timing signals. FIG. 11C depicts a square LED grid mounted in corners to ICA head. FIG. 11D depicts a grid displaying symbols, such as moving or flashing arrows. FIG. 11E depicts a grid displaying words in English. FIG. 11F depicts the stick form of LED (not round) to form displayed letters and numbers as seen on, for example, scoreboards. FIG. 11G depicts a head insert made of a suitably sturdy material on which a camera, speaker or antenna can be securely mounted for remote capturing or transmission.

With reference to FIG. 11, a head insert 360 may include one or more sleeve members 362 attached to one side of the head insert 360 and arranged along the diameter of the head insert 360. The sleeve members 362 may allow a rod 364 to pass through for attaching the head insert 360 to the head member 152, 252 of the stick-figure-resembling portion 102, 202. The ends of the rod 364 may be joined to two opposing portions of the head member 152, 252. The rod 364 may be oriented vertically and configured with a suspended base 366 to maintain the head insert 360 at a center portion with respect to the head member 152, 252. The rod 364 may be oriented horizontally and configured with two suspended bases 366 near either end of the head insert 360 to maintain the center location of the head insert 360. In some examples, the head insert 360 may be constructed with a board, such as corrugated plastic board, Coroplast, which may include an internal cavity or channel for passing through the rod 364. External sleeves 362 may be optional. Attaching the head insert 360 to the head member 152, 252 using a rod 364 with suspended bases may allow the head insert 360 to rotate or pivot within the head opening.

Figure 12A:
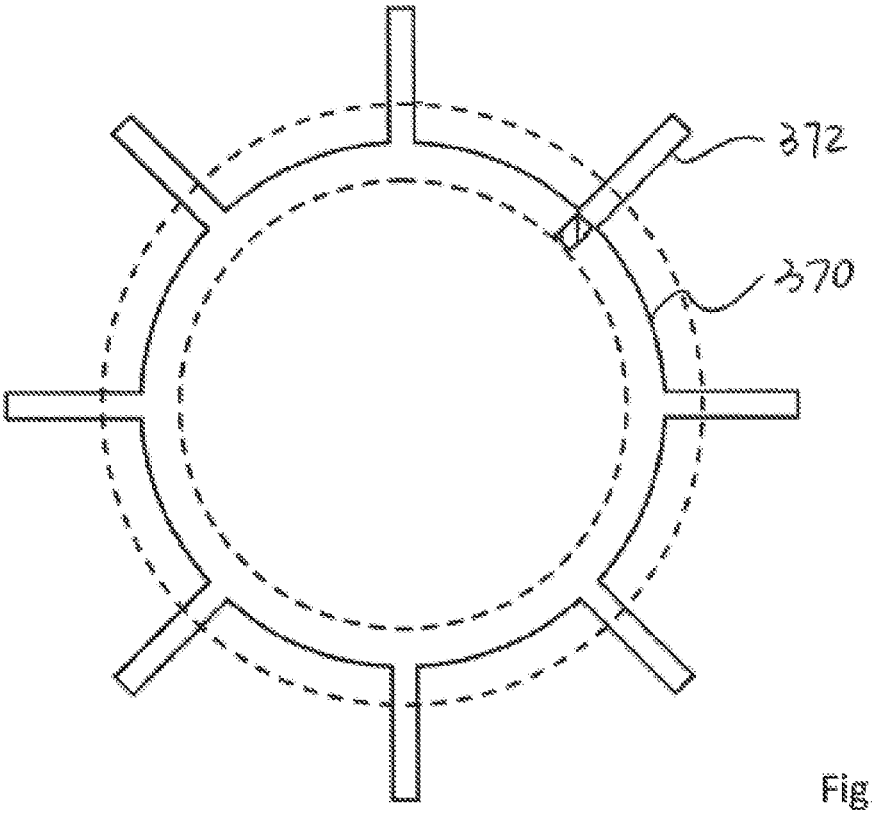
FIG. 12A illustrates another embodiment of a head insert for use with an information conveying apparatus.
Figure 12B:
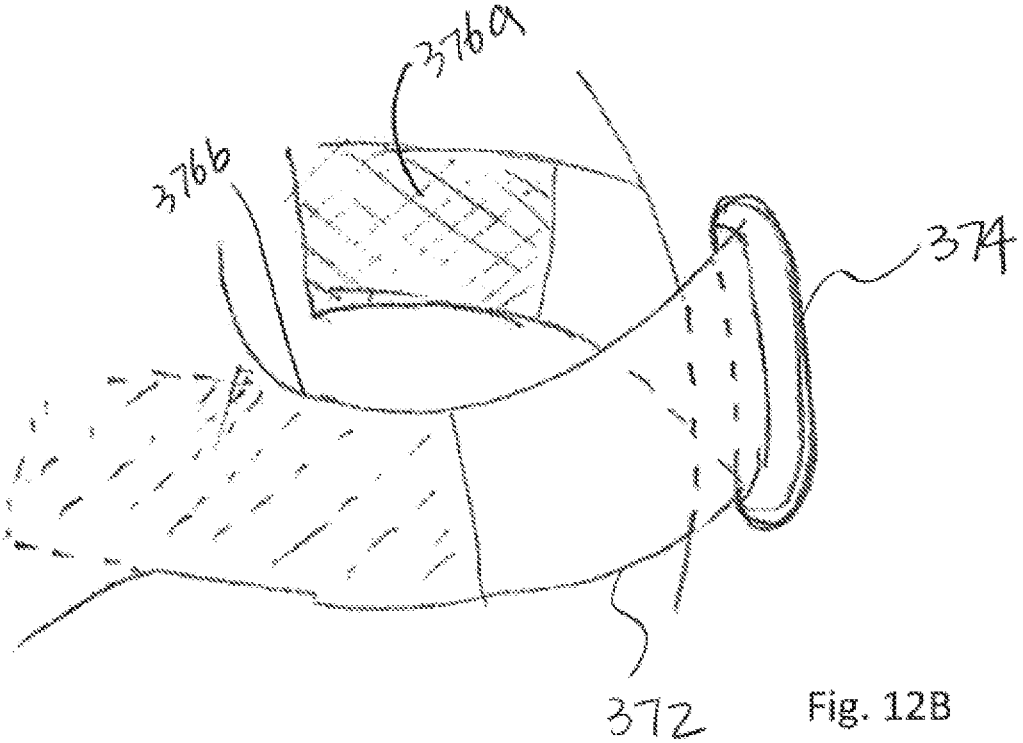
FIG. 12B illustrates an embodiment of the connection mechanism for attaching the head insert of FIG. 12A to an information conveying apparatus.

With reference to FIGS. 12A and 12B, another head insert 370 may include one or more straps or extensions 372 extending from a periphery of the round member of the head insert 370. The one or more straps 372 may be oriented in spaced angular intervals. In some examples, the head insert 370 may include eight of such straps 372 oriented in 45 degree intervals. A corresponding number of openings 374 may be formed near the inner periphery of the head member of the information conveying apparatus for receiving therein one of the straps 372 of the head insert 370. The head member may be formed with more or less openings 374 as long as the head insert 370 may be secured to the head member of the information conveying apparatus. To attach the head insert 370 to the head member of the information conveying apparatus, the free end of each of the straps 372 may be placed through one of the openings 374 formed near the inner periphery of the head member and then folded back to connect the round member of the head insert 370 near its periphery and/or a portion of the strap 372.

With further reference to FIG. 12B, the free end of each of the straps 372 may be provided with one of the female and male members 376*a* of a hook-and-loop fastener, such as Velcro™ tapes. The other one of the female and male members 376*b* of the hook-and-loop fastener may be provided near the periphery of the round member of the head insert 370 and/or the portion of the strap 372 adjacent thereto. The free ends of the straps 372, after passing through the openings 374 formed at the head member, may be connected or secured to the round member of the head insert 370 near its periphery and/or a portion of the strap 372 by the engagement of the male and female members 376*a*, 376*b* of the hook-and-loop fasteners. In some examples, the free ends of straps 372 may be joined to the round member and/or a portion of the strap 372 using snaps, peg receptors, ties, hooks, adhesive, stapling, bolts, rivets, or any other suitable fastening mechanism.

Figure 13A:
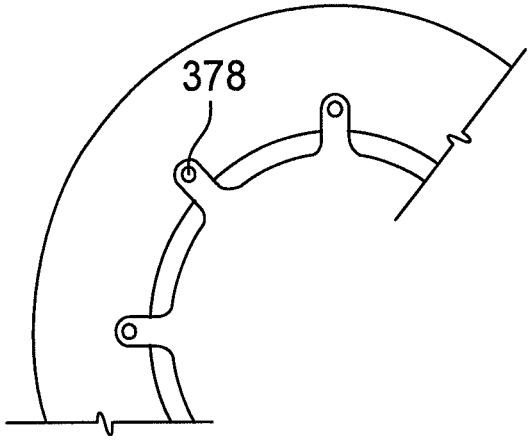
FIG. 13A illustrates a partial view of another embodiment of a head insert attached to an information conveying apparatus.
Figure 13B:
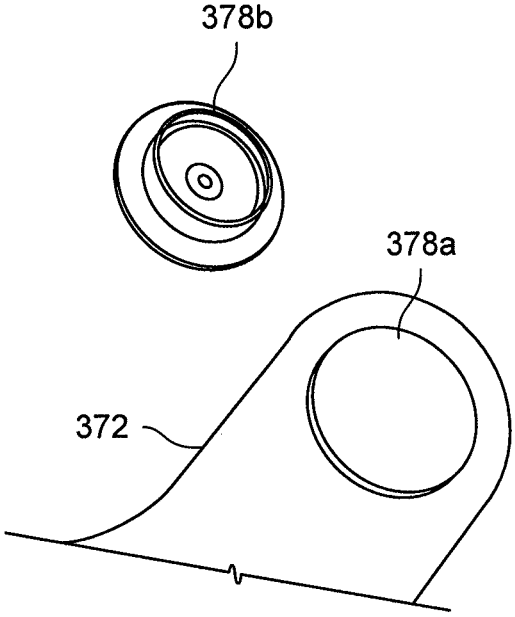
FIG. 13B illustrates an embodiment of the connection mechanism for attaching the head insert of FIG. 13A to the information conveying apparatus.
Figure 13C:
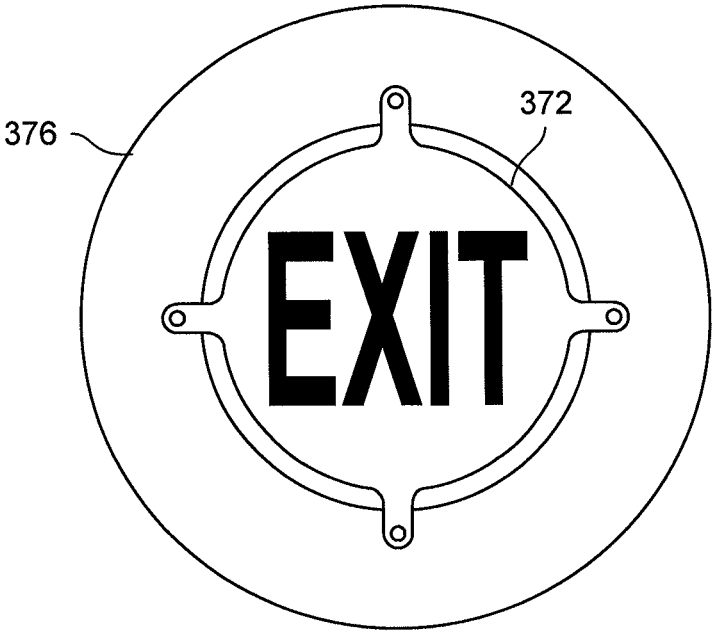
FIG. 13C illustrates another embodiment of a head insert attached to an information conveying apparatus.

With reference to FIGS. 13A, 13B, and 13C, the free ends of the straps or extensions 372 may be directly joined to the head member of the information conveying apparatus using releasable fastening mechanisms. With reference to FIGS. 13A and 13B, one of the female and male members 378*a* of a snap fastener 378 may be provided at the free end of each of the straps 372, and the other one of the female and male members 378*b* of the snap fastener 378 may be provided near the inner periphery of the head member of the information conveying apparatus. With reference to FIG. 13C, the hook-and-loop members of hook-and-loop fasteners 376 may be used instead of the female and male members of snap fasteners 378. The number of the straps or extensions 372 of the head insert 370 may be the same as or different from the number of fasteners 376, 378 provided at the head member of the information conveying apparatus.

Figure 14A:
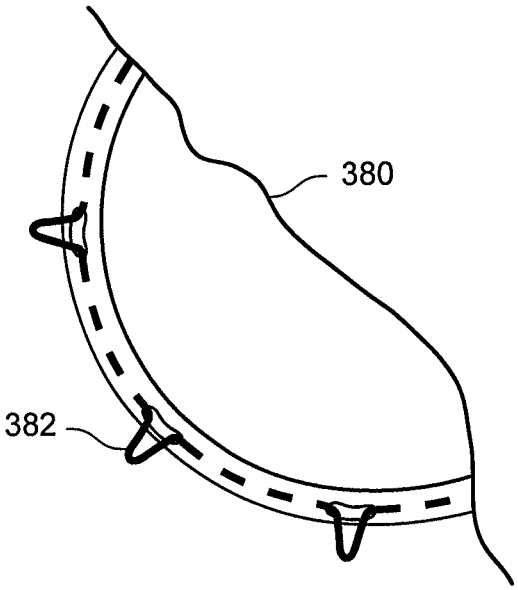
FIG. 14A illustrates a partial view of another embodiment of a head insert for use with an information conveying apparatus.
Figure 14B:
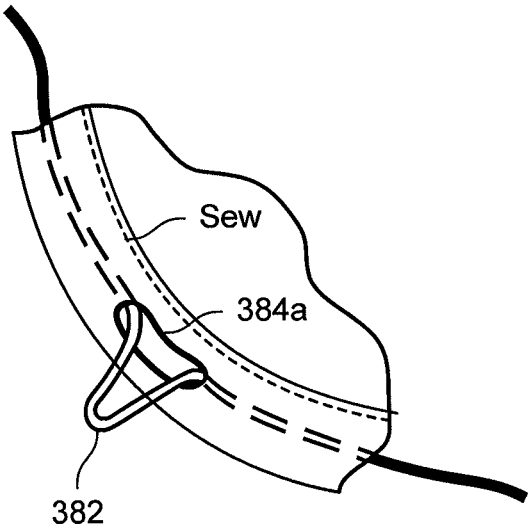
FIG. 14B illustrates an embodiment of the connection mechanism configured at the head insert of FIG. 14A for attaching the head insert to an information conveying apparatus.
Figure 14C:
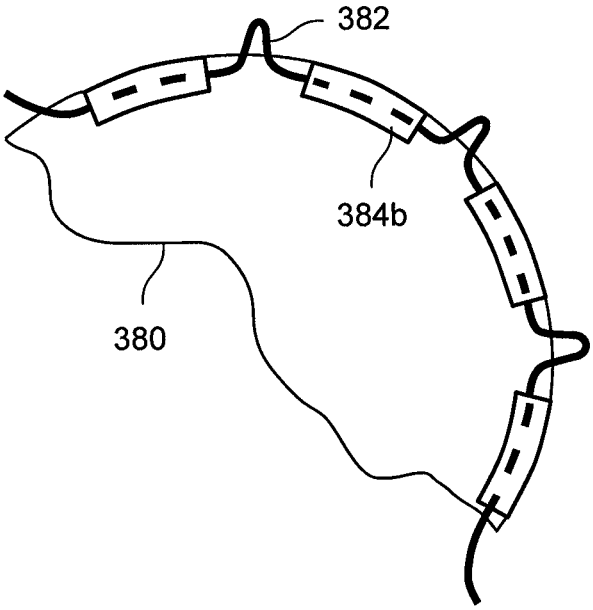
FIG. 14C illustrates a partial view of another embodiment of a head insert for use with an information conveying apparatus.
Figure 14D:
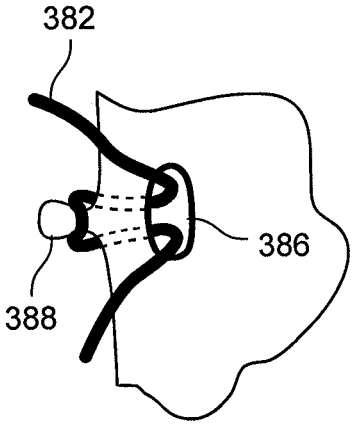
FIG. 14D illustrates an embodiment of the connection mechanism for attaching the head inserts of FIGS. 14A and 14C to an information conveying apparatus.
Figure 15A:
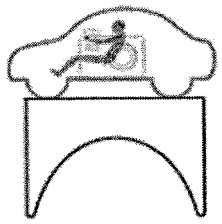
FIGS. 15A-15L illustrate variations of the information conveying apparatuses of FIGS. 1-6.
Figure 15B:
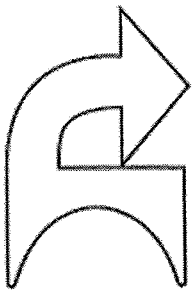
Figure 15C:
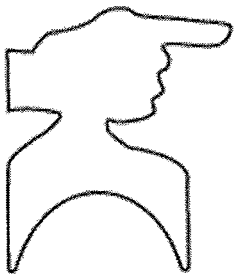
Figure 15D:
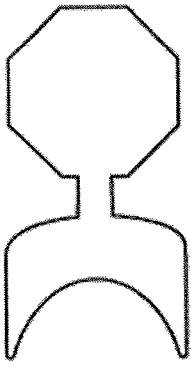
Figure 15E:
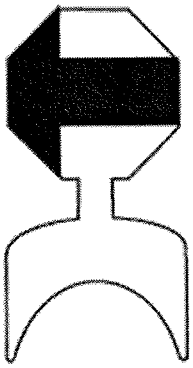
Figure 15F:
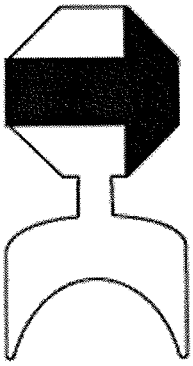
Figure 15G:
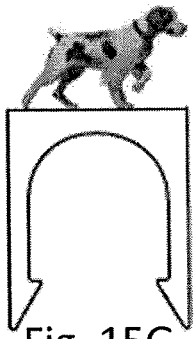
Figure 15H:
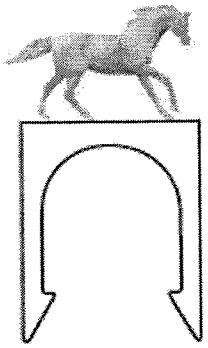
Figure 15I:
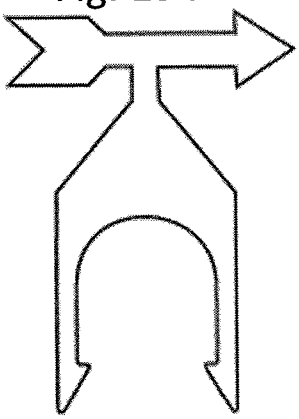
Figure 15J:
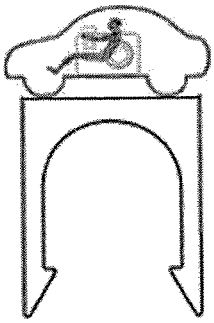
Figure 15K:
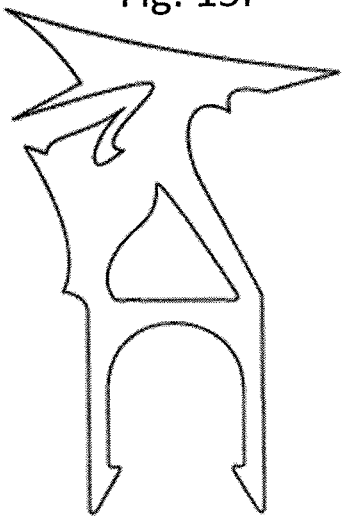
Figure 15L:
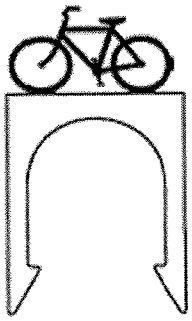

With reference to FIGS. 14A, 14B, and 14C, the periphery of the round member of another head insert 380 may be folded and the edge portion of the folded portion may be sewn to the round member to form a circular channel for passing through an elastic chord member 382. The circular channel may be configured with one or more openings 384*a*, 384*b* at angular intervals by forming one or more apertures 384*a* in the folded portion (FIG. 14B) or by cutting out one or more sections 384*b* of the folded portion of the periphery (FIG. 14C). The elastic chord member 382 may form a loop at each of the openings 384*a*, 384*b* of the circular channel. The loops may loop over a pin or nub provided at the head member 380 thereby joining to the head member 380. Alternatively, with reference to FIG. 14D, the head member 380 of the information conveying apparatus may include one or more openings 386 formed near its inner periphery. Each of the openings 386 of the head member 380 may receive therethrough a looped portion of the elastic chord member 382, which may be secured thereto by a pin or nub 388.

With reference to FIGS. 15A-15L, the upper portion of any of the information conveying apparatus as described above may incorporate other shapes or structures for displaying a suitable message. In some examples, the upper portion of the information conveying apparatus may incorporate shapes that generally resemble vehicles, such as a car (FIGS. 15A and 15J) or a bicycle (FIG. 15L), to inform an observer of the information conveying apparatus that moving vehicles may be crossing ahead. In some examples, the upper portion of the information conveying apparatus may incorporate shapes or signs, such as arrow shapes (FIGS. 15B and 15I), a hand shape with a finger pointing in a certain direction (FIG. 15C), or plates with painted arrows (FIGS. 15E and 15F), that generally inform the observer of directional information. In some examples, the upper portion of the information conveying apparatus may incorporate pictures or signs of animals (FIGS. 15G and 15H) or other shapes (FIGS. 15D and 15K) for indicating related information, such as events involving the displayed animals or other pertinent information. The dog, horse, car, or bicycle as described herein may also be interpreted as pointing to a certain direction because there is an assumed direction of travel for moving forward. Other desirable shapes or structures may be incorporated for conveying suitable information.

Depending on the shapes or structures of the upper portion of the information conveying apparatus, the upper edge of the horizontal structural element of the lower portion may include a substantially horizontally oriented straight upper edge (see, for example, FIGS. 15A, 15B, 15G, 15H, 15J, 15K, and 15L), curved segments (see, for example, FIGS. 15C, 15D, 15E, 15F), angled straight segments (see, for examples, FIG. 15I), or any suitable combination thereof. The upper shapes or structures may be permanently joined to the lower portion of the information conveying apparatus and form an integral body with the lower portion. Alternatively, the upper shapes or structures may be joined to the lower portion of the information conveying apparatus using hinges, screws, adhesives, stapling, or any suitable fastening mechanism.

Among various structures used for conveying a message or information, there is a direct and/or indirect significance and/or feature and/or benefit of the use of and/or symbolic reference to the stick figure structure. The stick figure structure quickly draws people's attention and conveys different messages based on the position of arms, legs, body, or combination thereof. When shaped to point, a definite and movable direction is indicated. The stick figure structure gives a subliminal message, reason to look, and/or reason to follow. It shows that a person may be involved, in area, and/or nearby, whether working or standing or walking. More examples of information conveying apparatuses that generally resemble a stick figure structure will be described below. In some examples, the stick-figure-resembling information conveying apparatus may be configured with a base to support the stick figure structure on a support surface. In other examples, the stick-figure-resembling information conveying apparatus may be supported by a support structure, which may rest on a support surface. In other examples, the apparatus may be hung on a wall, suspended from above or kept upright by tight wires, guidelines, chords, ropes, etc. pulled from the sides.

With reference to FIGS. 16A, 16B, 16D, and 16E, the information conveying apparatus may be a substantially planar or two-dimensional structure that may generally resemble a stick figure structure 500. The stick figure structure 500 may be similar to that described with reference to, for example, FIGS. 1A, 1B, 5A, 5B, etc. The stick figure structure 500 may include an elongated torso member 550, a circular head member 552 with a hollow center joined to an upper end of the torso member 550, two elongated leg members 562 joined to a lower end of the torso member 550 and defining an inverted V shape, and two elongated arm members 556, 558 joined to the torso member 550 between its upper and lower ends by two shoulder members 560 positioned on either longitudinal sides of the torso member 550. Each of the arm members 556, 558 and the leg members 562 may include a distal edge portion 561 that is slanted with respect to their respective longitudinal dimension. The slanted edge portions 561 may resemble the hands and feet of a human being. The slanted edge portions 561 of the leg members 562 may be aligned with each other and may rest against a support surface to provide horizontal support for the stick figure structure 500 when it is in an upright position.

The torso member 550, the head member 552, the shoulder members 560, the arm members 556, 558, and the leg members 562 may be formed as an integral body and/or made out of one piece of material. In some examples, one of the arm members 556, 558 may further include an extension member operably joined thereto as will be described in more detail below. Each of the head member 552, shoulder members 560, and leg members 562 may define a smooth and/or curved joint with the torso member 550, whether they are formed as one integral body from one piece of material or assembled using multiple parts. The stick figure structure 500 may convey or display a message by particular configurations of the arm and leg members 556, 558, 562, by head inserts placed in the opening or a hollow center of the head member 552, by hanging signs joined to one of the arm members 556, 558, or by any combination thereof.

Figure 16D:
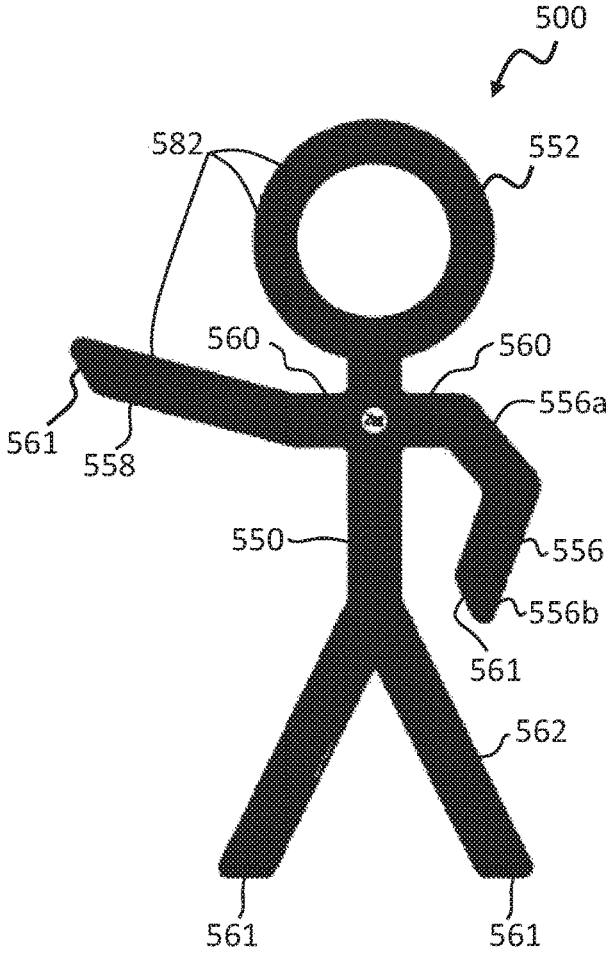
FIGS. 16D and 16E illustrate front and rear perspective views of the information conveying apparatus of FIGS. 16A and 16B and another support member for use with the information conveying apparatus.

With reference to FIGS. 16A, 16B, 16C, 16D, and 16E, in one exemplary arm configuration, one of the two arm members 558 may be configured to extend substantially to point and the other one of the two arm members 556 may be configured to bend down such that attention of an observer is more likely and naturally drawn to the pointing arm 558. The pointing arm member 558 may be substantially straight and tilt upward slightly. The pointing arm member 558 may include a length dimension four to five times the length dimension of the shoulder member 560. The pointing arm member 558 may be formed as one integral piece and joined integrally to the torso member 550 by the shoulder member 560. With further reference to FIGS. 16B, and 16C, the pointing arm 558 may include two elongated portions 558*a*, 558*b* joined together by a connection plate 558*c*. The two elongated portions 558*a*, 558*b* may include substantially the same width dimensions and may be arranged in an abutting relationship along their length dimensions. The connection plate 558*c* may overlap the abutting end portions and may be joined to the respective end portions by rivets, screws, welding, adhering, or any suitable connection mechanism thereby forming the pointing arm member 558. The connection plate 558*c* may be made of a material the same as or different from that of the arm members 556, 558, such as steel, fiber glass, plastic, and so on.

The shoulder members 560 may extend substantially perpendicular to the torso member 550. The shoulder members 560 may slightly tilt upward towards the head member 552. Tilt of the shoulder members 560 may add aesthetics by preventing the drooping look of the shoulder members 560. Tilt of the shoulder members 560 may also help balance and/or counter material or extension weight. The pointing arm member 558 may tilt up or point slightly towards the head member 552. The up-tilting angle of the pointing arm member 558 with respect to the shoulder member 560 may range from 5 degrees to 60 degrees, measured between the lower edges of the pointing arm member 558 and the adjacent shoulder member 560. In some examples, the pointing arm member 558 may be oriented at an angle of 15, 20, or 25 degrees with respect to the adjacent shoulder member 560, which may be sufficient to compensate an uneven position of the stick figure structure 500 and maintain the general pointing direction of the pointing arm member 558 and at the same time may allow additional signage to hang properly from the pointing arm member 558. Other suitable angles or orientations between the pointing arm member 558, the shoulder member 560, and the torso member 550 may be contemplated.

The bending arm member 556 may include an upper arm portion 556*a* and a lower arm portion 556*b* joined to the upper arm portion 556*a*. The joint between the upper and lower portions 556*a*, 556*b* define the bent of bending arm member 556. Each of the upper and lower arm portions 556*a*, 556*b* may be substantially straight and may include a respective length dimension two to three times the length dimension of the shoulder member 560. The upper and lower arm portions 556*a*, 556*b* may be formed as one integral piece and joined integrally to the torso member 550 by the adjacent shoulder member 560.

The shoulder member 560 for joining the bending arm member 556 may extend substantially perpendicular to the torso member 550 and/or may slightly tilt upward towards the head member 552. The upper arm portion 556*a* of the bending arm 556 may extend further away from the torso member 550 and at the same time point or tilt downward away from the head member 552. The lower arm portion 556*b* may extend further downward but point or tilt towards the torso member 550. The angle between the shoulder member 560 and the upper arm portion 556*a* may range from 90 degrees to 170 degrees, and the angle between the upper and lower arm portions 556*a*, 556*b* may range from 90 to 170, with the angles being measured between the respective edges of the shoulder member 560, the upper arm portion 556*a*, and the lower arm portion 556*b* closer to the torso member 550. In some examples, the angle between the shoulder member 560 and the upper arm portion 556*a* may be 130 degrees, and the angle between the upper and lower arm portions 556*a*, 556*b* may be 120 degrees. Other suitable angles or orientations between the shoulder member 560 and the upper and lower arm portions 556*a*, 556*b* may be contemplated.

Configuring the stick figure structure 500 with relatively short shoulder members 560 for joining the arm members 556, 558 to the torso member 550 may improve the structural strength of the arm members 556, 558 and the stick figure structure 500 because the shoulder members 560 may add angular transition between the torso member 550 and the arm members 556, 558. The shoulder members 560 may further balance the overall weight distribution of the stick figure structure 500 thereby increasing the stability of the stick figure structure 500 when it is supported in an upright position. The shoulder members 560 may provide a more balanced and appealing look to an observer and more likely to draw attention from the observer. The shoulder members 560 may be configured with a length dimension similar to or greater or less than the radius of the circular head member 552.

The stick figure structure 500 may convey or display a message by the pointing arm member 558. The pointing arm member 558 of the stick figure structure 500 may provide a sense of direction. It may guide an observer's attention to the pointed objects, such as products or goods. Configuring the pointing arm 558 substantially straight may enhance the pointing action and further emphasize the direction and/or objects being pointed at. Hands may be integrated with the arm members 556, 558 as described herein without showing wrists, palm, and/or fingers. If desired, structures resembling more detailed human hands may be configured at the distal ends of the arm members 556, 558. Enhanced messaging related to the direction of pointing may be achieved by writing words on the arm 556, 558 and/or by hanging a sign from the pointing arm 558 that may describe what can be seen or found in the particular direction of the point.

In some occasions, the pointing arm 558 may be used as a support structure that may hold up a sign for viewing purposes with or without the need to indicate direction. Holes or slots may be formed in the pointing arm 558 near the lower edge thereof. Alternatively, ring members, such as D-rings, may be joined to the lower edge. Signs may be operably joined to the pointing arm 558 using a wire, chord, chain, clip, rope, or any suitable connection mechanism, which may allow the hanging sign to be changed out easily. The hanging sign may hang and swing freely from the pointing arm member 558 to allow the wind to pass through with ease.

Additional information or further clarity may be achieved by attaching a head insert 580 inside the head member 552. The head insert 580 may symbolize the brain area as if indicating what may be in the stick figure's thoughts or what may be on one's mind. The head insert 580 may be used to show expressions by printed graphics such as eyes, nose, and mouth in various positions. The head insert 580 may also provide instructions or information in the form of words, symbols, images, pictures, graphics, persons, shapes, etc., printed thereon. Pre-printed head messages may include "Thank you," "Give us a break," "Reduce Speed," "Slow Down," "People in Area," "Working Zone," "Zone Crew," "Crew Working Here," etc. The head insert 580 may generally be formed smaller than the center opening of the head member 552 to allow a gap to be formed when the head insert 580 is joined to the head member 552. The gap may allow wind passing through such that even with the head insert 580 attached so that the head portion of the stick figure structure 500 may not form a solid flat surface to catch wind and cause the stick FIG. 500 to bend or even fall over.

The head insert 580 may be attached to the head member 552 in a manner similar to that described with reference to FIGS. 11 to 14. Alternatively, the head insert 580 may be attached to a support member for the entire stick figure structure 500 (described in more detail below) instead of being attached to the head member 552 directly. With reference to FIGS. 16A and 16B, the support member may include an elongated portion 602 secured to two opposing portions of the head member 552, such as the top portion and the bottom portion of the head member 552, by screw, rivet, glue, tape, or any suitable attachment mechanism. The head insert 580 may be attached to the elongated portion 602 of the support member by screw, rivet, glue, tape, or any suitable attachment mechanism and positioned at the center of the head member 552. It should be noted that the various configurations of a head insert and/or a hanging sign and the attachment or connection methods for supporting a head insert within the head member of a stick figure structure and/or supporting a hanging sign off of an arm member as described with respect to any particular examples of the information conveying apparatus may advantageously be used for any information conveying apparatus as described herein, separately in some instances, or in combination in other instances.

In continuing reference to FIGS. 16A, 16B, 16D, and 16E, one or both of the surface sides, i.e., the front and back sides of the stick figure structure 500 may include surface features to convey information or messages. Such surface feature may be inherent to materials for making the stick figure structure 500 or may be applied or added to the surface of the materials for making the stick figure structure 500. Because surfaces of the stick figure structure 500 may be relatively smooth or even flat in some cases, such as when the stick figure structure 500 may be made substantially two-dimensional, flat, or planar using panel or sheet material, the application of additional surface features may be done relatively easily. The various surface features described herein with respect to the stick figure structure 500 may be applicable or applied to the front or back or both surfaces to the head insert 580.

Surface features of the stick figure structure 500 may include signs, words, symbols, images, logos, colors, or any combination thereof, printed or painted onto one or both of the arm members 556, 558, the torso member 550, one or both of the leg members 562, the head member 552, or the entirety of the stick figure structure 500. Surface features of the stick figure structure 500 may also include a coating to the entire front or back surface or both surfaces of the stick figure structure 500. In some examples, the coating may include an anti-rust paint or other suitable paint to protect the stick figure structure 500 from elements in the environment, such as moisture, heat, etc. In some examples, the coating may include a painted color, such as safety orange, neon yellow, green, etc., to set the stick figure apart from its surroundings. In some examples, the coating may include a retroreflective sheet applied to the surface(s) of the stick figure structure 500 so that the stick figure structure 500 may be visible at night. In some embodiments, the insert 580 may be an electric message board with a grid pattern of lights that enables changeable messaging or symbols such as moving and/or flashing arrows, for example, a smaller version of a road construction arrow or message board placed inside the head insert. In another embodiment, the head insert 580 may provide a suitable surface for mounting a camera or sound-emitting mechanism as part of head insert 580.

With reference to FIGS. 16A and 16D, surface features of the stick figure structure 500 may also include contour lines 582 near but spaced from the edges of the stick figure structure 500. Such contour lines 582 may be painted onto the surface of the stick figure structure 500 or may be created by adhering tape of appropriate width onto the surface of the stick FIG. 500. The contour lines 582 may accentuate the stick figure structure 500, which may be useful when the surrounding environment may include colors that may be similar or close to that of the stick figure structure 500 or the environment may simply include too many colors or elements that may distract an observer. Additional reflective striping or lettering may be placed on top of the retroreflective sheeting to enhance or draw attention. For example, black lettering placed on top of white retroreflective head insert will make words stand out. Similarly, a white outline along the edge can create a halo or glow effect of shape. If a striping is placed a distance from edge, it can serve to accentuate the shape when viewed.

The stick figure structure 500 and/or the head insert 580 may be made of materials similar to or different from that described with reference to FIG. 9. The stick figure structure 500 and/or the head insert 580 may be made from one or multiple layers of plastic, fiberglass, metal (flat, sheet, rolled, or corrugated), carbon fiberboard, and so on.

With reference to FIGS. 16A, 16B, 16D, and 16E, the stick figure structure 500 may be supported by a stand 600 and held in a substantially upright position with respect to a support surface, such as a ground surface. The stand 600 may define an H-shaped base 604 and may include a first elongated bar member 604*a*, a second elongated bar member 604*b* parallel to the first elongated bar member 604*a*, and a third elongated bar member 606 oriented perpendicular to the first and second elongated bar members 604*a*, 604*b* and joining the first and second elongated bar members 604*a*, 604*b* at their respective middle portions by welding, glue, or any suitable connection mechanism. The elongated bar members 604*a*, 604*b*, 606 may each define a square cross section or other suitably shaped cross sections. The first and second parallel bars 604*a*, 604*b* may each include support feet positioned at both ends thereof. The stand 600 may include a first pole receptacle 608*a* and a second pole receptacle 608*b* oriented vertically or in an upright position and arranged at the middle portion of the first and second parallel bar members 604*a*, 604*b*, respectively. The first and second pole receptacles 608*a*, 608*b* may be configured to receive therein respectively a first foot pole 610*a* and a second foot pole 610*b*. Each of the first and second foot poles 610*a*, 610*b* may be operably joined to the distal end of one of the leg members 562 by screws, rivets, welding, adhering, or any suitable connection mechanism. The first and second foot poles 610*a*, 610*b* may be further joined to either ends of a horizontally oriented bar member 612 by screws, rivets, welding, adhering, or any suitable connection mechanism to provide increased structural strength and stability to the stick figure structure 500. In some examples, the foot poles 610*a*, 610*b*, the horizontal bar member 612, and the distal ends of the leg members 562 may be joined together by a common connection mechanism.

Each of the foot poles 610*a*, 610*b* and pole receptacles 608*a*, 608*b* may include at least one aperture formed therein. To support the stick figure structure 500 in an upright position, the apertures of the foot poles 610*a*, 610*b* may align with the aperture of the apertures of the receptacles 608*a*, 608*b* when the foot poles 610*a*, 610*b* are received within the respective pole receptacles 608*a*, 608*b*. A removable pin, bolts, screws, or other suitable connection mechanism, may be positioned through aligned apertures of the foot poles 610*a*, 610*b* and pole receptacles 608*a*, 608*b*, respectively. The foot poles 610*a*, 610*b* and the pole receptacles 608*a*, 608*b* may be configured with heights that may accommodate more than one aperture to be formed therein. By aligning different pairs of apertures, the stick figure structure 500 may be supported at various elevations.

More specifically, there is a separate support structure for the body whereby the rigid back bracing (steel, iron, aluminum pipe, etc.) keeps the facing material stable and allows for removal from the H stand. The pole extensions on each foot could be used to mount the upright structure in a permanent fashion if align with and inserted into receptacles that are mounted in the ground or surface then secured by bolts or welding. This is much like the method used for mounting street or stop signs along roadways or in concrete sidewalks.

Figure 16E:
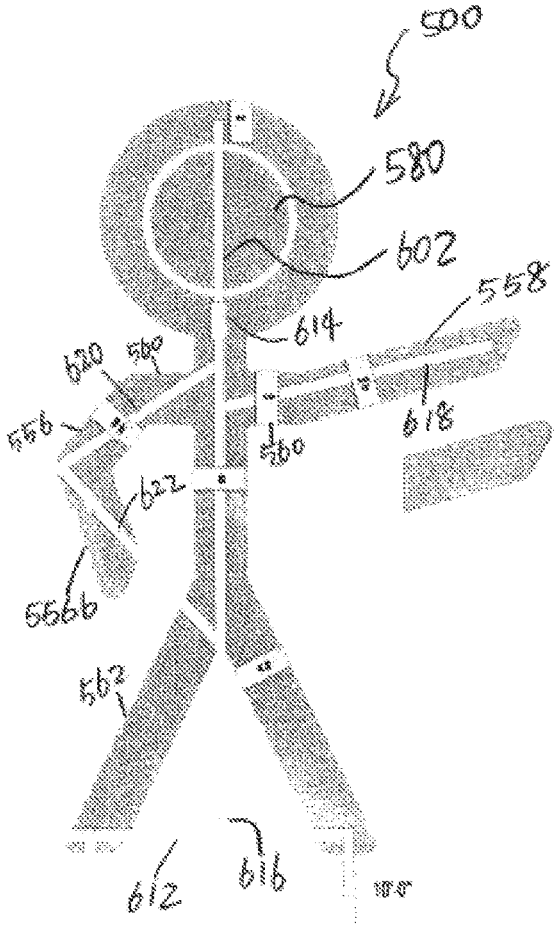

With reference to FIG. 16E, the frame or support structure may include a bent arm (620) that extends beyond the elbow surface shape so that it carries the weight burden when placed on its side for storage rather than bending the thin front face. Similarly, the horizontal bar connecting the feet extends beyond the foot on the same side as the bent elbow. The support structure also allows the upright element to be easily carried without worrying of damage or bending.

The stand 600 may provide the ease and flexibility of moving around and repositioning the stick FIG. 500. In some occasions, it may be desirable to place the stick figure structure 500 in a set location without the ease of removal or repositioning. As such, the H-shaped base may be replaced by pre-set slots or receptacles anchored in the ground so that the foot poles 610*a*, 610*b* may be inserted into the pre-set slots or receptacles in the ground to install the stick figure structure 500. Alternatively, the foot poles 610*a*, 610*b* may simply be long enough or include extensions so that the foot poles may be inserted into the ground and supported by the surrounding soil, rocks, gravels, etc., of the ground. The stand 600 for the stick figure structure 500 may be made of metal bars with a square cross section and a hollow center. Other suitable materials and shapes of cross sections may be considered.

In continuing reference to FIGS. 16A, 16B, 16C, and 16D, the stick figure structure 500 may be further supported by one or more reinforcement elements when placed in the field to resist bending or falling over, which may be caused by wind or such. With reference to FIGS. 16A and 16B, the reinforcement elements may include a vertical support element 602, such as a vertical support rod, bar, post, etc., that may extend substantially the entire height of the stick figure structure 500 and may align with the longitudinal center line of the torso member 550. The vertical support element 602 may be joined to the stick figure structure 500 at multiple locations, including one or both of the top and bottom portions of the head member 552 and/or one or more portions of the torso member 550 by screw, bolts and nuts, rivets, stapling, welding, gluing, adhering, or any other suitable connection mechanism. The bottom end of the vertical support element 602 may be joined to the middle portion of the horizontal support bar 612 joining the two leg members 562 of the stick figure structure 500 by screws, bolts and nuts, rivets, stapling, welding, gluing, adhering, or any other suitable connection mechanism. The vertical support element 602 may also be joined to the head insert 580 and support the head insert 580 at the center of the head member 552. The vertical support element 602 may include multiple pre-formed openings or holes, such as square, tubular, or U-channel road sign posts with lines of openings formed on the four sides of the post, so that it can accommodate various attaching locations for supporting the stick figure structure 500 at appropriate portions thereof.

With reference to FIGS. 16C and 16D, the stick figure structure 500 may include one or more sleeves or brackets 614 joined thereto along the longitudinal center line of the stick figure structure 500. The support stand 600 may also include a vertical receptacle 616 joined to the middle portion of the horizontal support bar 612. The vertical support element 602 may be slidably received in the one or more sleeves or brackets 614 of the stick figure structure 500 and received in and supported by the vertical receptacle 616 of the horizontal support bar 612 with or without using screws, bolts and nuts, rivets, stapling, welding, gluing, adhering, or any other suitable connection mechanism.

In continuing reference to FIGS. 16C and 16D, the stick figure structure 500 may be further supported by one or more reinforcing elements positioned along the shoulder and arm members 556, 558, 560 of the stick figure structure 500. It should be noted that because the reinforcing elements may include width dimensions much smaller than the width dimensions of the shoulder members 560 and the arm members 556, 558, each shoulder member 560 and the joining arm member 556, 558 may be supported by one substantially straight support element, which may yield greater structural strength.

The extending or pointing arm member 558 may be supported by a first arm support element 618 joined thereto and may extend along substantially the entire extension of the arm member 558. The first arm support element 618 may further be joined to the vertical support element 602. The bending arm member 556 may be supported by a second arm support element 620 joined thereto and may extend or cross the adjacent shoulder member 560 and the upper arm portion 556*a*. The second arm support element 620 may further be joined to the vertical support element 602 near the upper end portion of the torso member 550. The bending arm member 556 may further be supported by a third arm support element 622 joined thereto and may extend along the extension of the lower arm portion 556*b* and cross a portion of the same side leg member 562. One end of the third arm support element 622 may be joined to the adjacent end portion of the second arm support element 620 and the other end of the third arm support element 622 may be joined to the vertical support element 602 near the lower end portion of the torso member 550. The second and third arm support elements 620, 622 and the portion of the vertical support element 602 between the joints may form a triangle, which may provide structural stability and strength to the bending arm member 556.

The first arm support element 618 may be joined to the extending or pointing arm member 558 by screws, rivets, nuts and bolts, stapling, hinges, welding, adhering, gluing, taping, or any suitable connection mechanism along the extension of the first arm support element 618 at one or more suitable locations or portions of the extending arm member 558. The second and third arm support elements 620, 622 may be joined to the bending arm member 556 and/or the nearby leg member 562 by same, similar, or different connection mechanisms along the extension of the second and third arm support elements 620, 622 at one or more suitable locations or portions of the bending arm member 556 and/or the leg member 562. Alternatively, the arm members 556, 558 may include brackets or sleeves attached thereto, and the arm support elements 618, 620, 622 may be slidably received in the brackets or sleeves.

The first, second, and third arm support elements 618, 620, 622 may be joined to the vertical support element 602 by screws, rivets, nuts and bolts, stapling, hinges, welding, adhering, or any suitable connection mechanism. The second and the third arm support elements 620, 622 may be joined together in the same, similar, or different manners. The first, second, and/or the third arm support elements 618, 620, 622 may use the same structure and/or material as the vertical support element 602. The arm support elements 618, 620, 622 and/or the vertical support element 602 may include a substantially straight bar, rod, post, etc. Similar to the vertical support element 602, the arm support elements 618, 620, 622 may include one or more openings or apertures formed along the extensions thereof for joining to the arm members 556, 558 at various suitable locations.

Figure 17A:
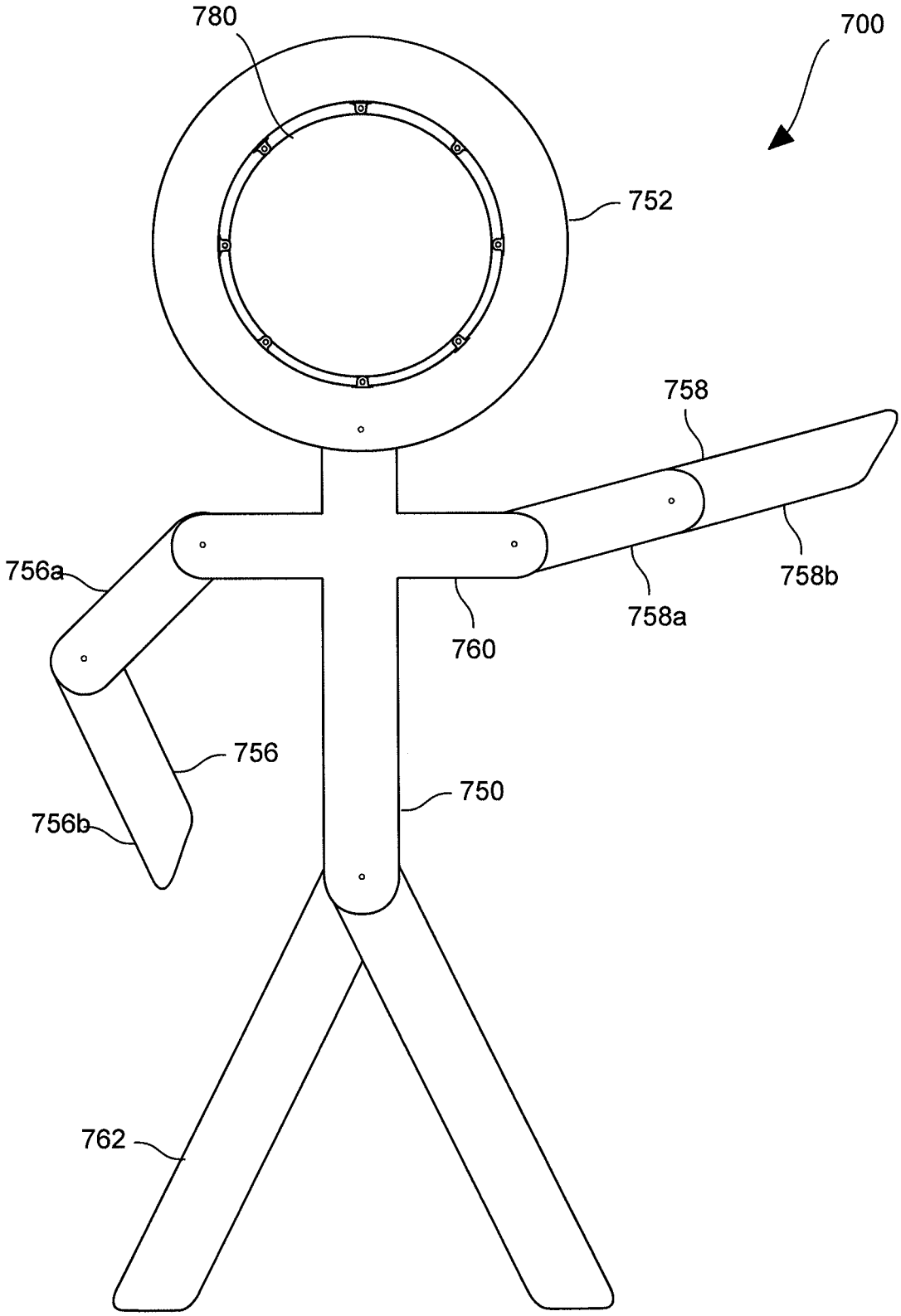
FIG. 17A illustrates an elevation view of another embodiment of an information conveying apparatus.
Figure 17B:
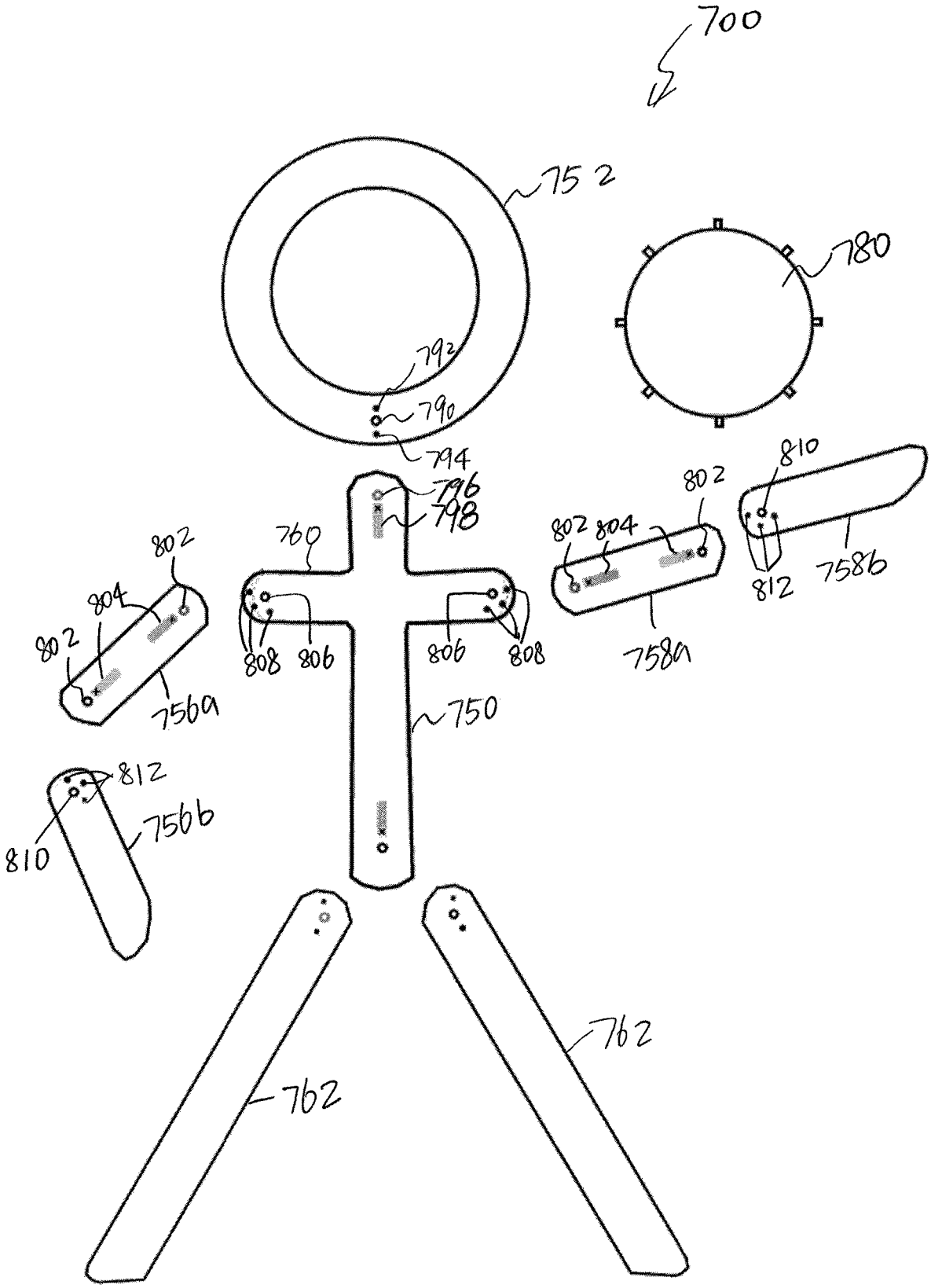
FIG. 17B illustrates an exploded view of the information conveying apparatus of FIG. 17A.

With reference to FIGS. 17A and 17B, another exemplary information conveying apparatus 700 may include segments or pieces of planar components operably joined together for forming the stick figure structure 700. The multiple segments or pieces of planar components may include a circular component for forming head member 752, a cross component for forming the torso member 750 and the shoulder members 760, and line segments configured with appropriate length dimensions for forming the arm and leg members 756, 758, 762. The line segments may include relatively short segments for forming upper and lower portions 756*a*, 756*b*, 758*a*, 758*b* of the respective arm members 756, 758, and relatively long segments for forming the leg members 762. Forming the stick FIG. 700 by segments or pieces of components may allow only part(s) of the stick FIG. 700 to be replaced if damaged, as opposed to replacing the entire stick figure structure 700 if formed as an integral piece. Similar to other stick figure structures described herein, a head insert 780 may be operably joined to the head member 752 of the stick figure structure 700 for displaying additional information. The arm members 756, 758 may also be configured with connection members 794, such as ring members, at the lower edges thereof for holding a hanging signage.

Each of the segments or pieces of planar components may be operably joined together at their overlapping end portions using screws, bolts, pins, rivets, or any suitable connection mechanism. The connection mechanism may allow the segments and pieces of planar components to move or rotate relative to each other. Relative rotation or movement of one segment or piece of planar component with respect to another may allow the arm members 756, 758 to be configured to point or bend in various directions to convey different messages. Further, the relative rotation or movement between various segments or pieces may allow the various components to be moved to an overlapping position thereby folding the stick figure structure 700 for stacking or placement in a bag for storage and/or transportation (see FIG. 18A-B).

Figure 18A:
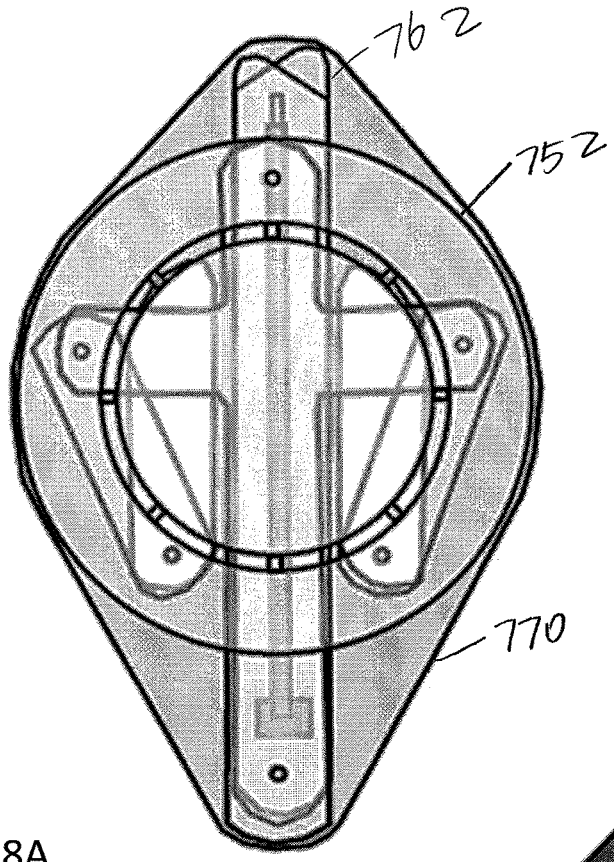
FIGS. 18A and 18B illustrate the information conveying apparatus of FIG. 17A in a folded configuration for storage or transportation using a bag.
Figure 18B:
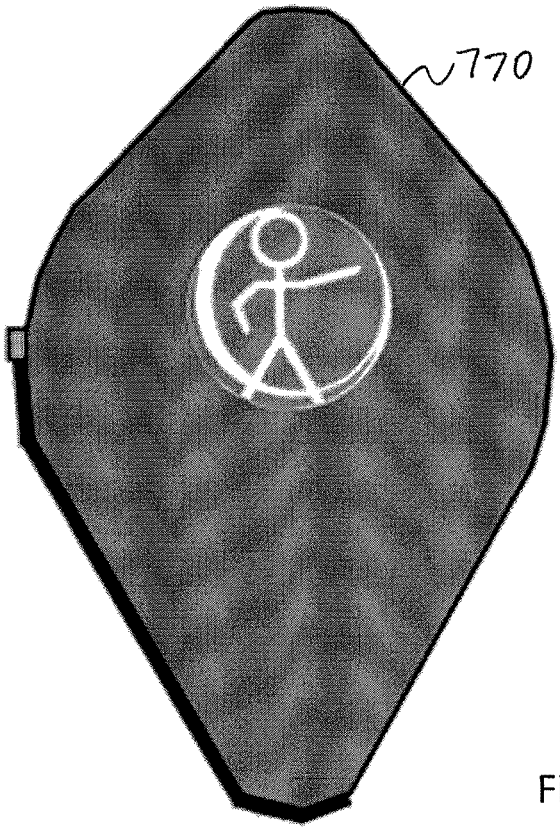

To allow for a folding or overlapping configuration of the stick figure structure 700, the circular component forming the head member 752 may be joined to one side (for example, the front side) of the cross member for forming the torso member 750 and the shoulder members 760. The line segments for forming the arm and leg members 758, 760, 762 may be joined to the other side (for example, the rear side) of the cross member (see FIG. 17A). With reference to FIG. 18A, to fold the stick figure structure 700 for storage or transportation, the head member 752 may pivot about the joint between the head member 752 and the torso member 750 to overlap the shoulder members 760 and the upper portion of the torso member 750. The lower arm portions 756*b*, 758*b* may pivot about the respective joints between the upper and lower arm portions 756*a*, 756*b*, 758*a*, 758*b* to fold toward the respective upper arm portion 756*a*, 758*a*. By further folding or pivoting the upper arm portions 756*a*, 758*a* toward the torso member 750, it may allow the folded lower arm portions 756*b*, 758*b* to be positioned between the upper arm portions 756*a*, 758*a* and the torso member 750. The leg members 762 may pivot about the joint between the leg members 762 and the torso member 750 to overlap and align with the torso member 750. In some examples, the stick figure structure 700 may further include a horizontal segment joined between the two distal ends of the leg members 762 for additional stability. The horizontal segment may be releasably joined to one leg member 762 and may be pivotably joined to the other leg member 762 in a similar manner to how the leg members 762 may be joined to the torso member 750. Therefore, when the stick figure structure 700 is not in use, the horizontal segment may be released from the one leg member 762, and may rotate with respect to the other leg member 762 to overlap with the other leg member 762 into the folded configuration.

Each of the components for forming the stick figure structure 700 may be configured with appropriate dimensions such that when the stick figure is folded, the lower end portion of the torso member 750 and the distal ends of the leg members 762 may define two opposing end portions of the folded stick figure structure 700, and the head member 752 may define two opposing rounded peripheral portions of the folded stick figure structure 700 (see FIG. 18A). In some examples, the leg members 762 may be configured with length dimensions similar to or smaller than the length dimension of the torso member 750 such that when the stick figure is folded, the distal ends of the leg member may not extend beyond the periphery of the head member 752, and the head member 752 may define a substantial peripheral portion of the folded stick figure structure 700. The rounded peripheral portions formed by the head member 752 may facilitate even weight distribution of the folded stick figure structure 700 inside a carrying bag 770, which may substantially conform to the periphery of the folded stick figure structure 700, thereby reducing the risk of damage to the carrying bag 770. In an alternative embodiment, the length of the leg members 762 is such that the leg members do not extend beyond the head shape when folded.

In some examples, the relative position of each planar component may be maintained by tightening the connection mechanism for joining the components together, thereby maintaining a particular posture of the stick figure structure 700. By loosening the connection mechanism, the components may be repositioned for a different posture or may be folded for storage. In some examples, one or more of the planar components for forming the stick figure structure 700 may include alignment and/or securement features arranged near their joints for selectively engaging the adjacent planar component.

Using the joint between the head member 752 and the torso member 750 for example and with reference to FIG. 17B, the head member 752 may include a connection aperture 790, an alignment aperture 792 for maintaining the head member 752 in a folded position, and an alignment aperture 794 for maintaining the head member 752 in an extended position. The torso member 750 may include a connection aperture 796 and a locking aperture 798 formed near its upper end portion. In some examples, the locking aperture 798 may include an elongated slot formed near the connection aperture 796 and extend along the longitudinal dimension of the torso member 750. The head member 752 and the torso member 750 may be operably connected to each other by a rivet passing through both connection apertures 790, 796 of the head member 752 and the torso member 750. The head member 752 may pivot about the rivet with respect to the torso member 750 to various positions.

To secure the head member 752 at an extended configuration for upright positioning of the stick figure structure 700, the alignment aperture 794 near the outer periphery of the head member 752 may be aligned with the locking aperture or slot 798 of the torso member 750. A bolt may pass through the aligned apertures 794, 798 and be secured thereto by a nut, thereby maintaining the head member 752 at the extended position. To secure the head member 752 at the folded configuration, the bold and nut may be loosened to allow the head member 752 to pivot to the folded position such that the alignment aperture 792 formed near the inner periphery of the head member 752 may be aligned with the locking aperture 798 of the torso member 750. The bolt and nut may be then used to secure the head member 752 at the folded position. The leg members 762 and the lower end portion of the torso member 750 may include similar alignment and connection apertures for operably connecting the leg members 762 to the torso member 750 and for selectively positioning the leg members 762 in the folded or extended positions.

As described previously, the arm members 756, 758 of the stick figure structure 700 may be configured to orient or point in various directions to convey various messages. To allow such various configurations, each of the upper arm portions 756*a*, 758*a* may include a connection aperture 802 and a locking aperture or slot 804 formed at either end portion thereof. Each of the shoulder members 760 may include a connection aperture 806 and two or more alignment apertures 808 formed near its distal end. Each of the lower arm portions 756*b*, 758*b* may include a connection aperture 810 and two or more alignment apertures 812 formed near its joint to the upper arm portions 756*a*, 758*a*. Configuring the shoulder members 760 and the lower arm portions 756*b*, 758*b* with two or more alignment apertures 808, 812 may allow for the arm members 756, 758 to be positioned and secured in more than one extended configuration in addition to the folded configuration. The locking apertures or slots 804 of each of the upper arm portions 756*a*, 758*a* may selectively engage any appropriate alignment aperture 808 of the shoulder member 760 and/or any appropriate alignment aperture 812 of the lower arm portion 756*b*, 758*b* to achieve any desired configuration of the arm members 756, 758. Various alignment apertures and locking apertures may ensure consistent positioning of the stick figure structure 700.

With reference to FIGS. 19A, 19B, 19C, 19D, and 19E, two adjacent members may be joined by an indexed pivot for selective configuration of the stick figure structure 700. These figures depict different ways to move and secure the parts into desired or consistent and repeatable positions. FIGS. 19A-1 and 19A-2 illustrate two alternative cross sections of different indexing mechanisms 2000 used to hold together the components as shown in FIG. 17B. The indexing elements 2000 allow for the repositioning of the arms, legs and head so the apparatus can change body position (e.g., position arms differently) or be folded for compact transportation or storage. The isometric figure in the upper right is the locking plate 2002 (with or without spring loading) that enables the two or more overlapping body parts to be joined together in a specific position via insertion of pin into holes. The operator lifts the plate with pin and repositions into another desired slot.

Figures 4, 19A:
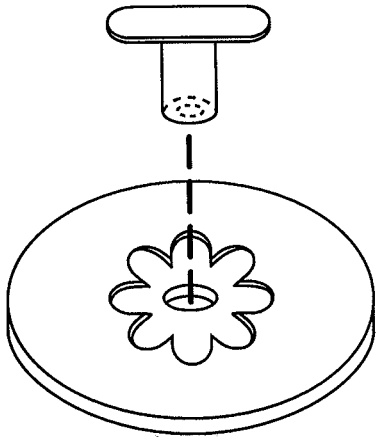
Figures 5, 19A:
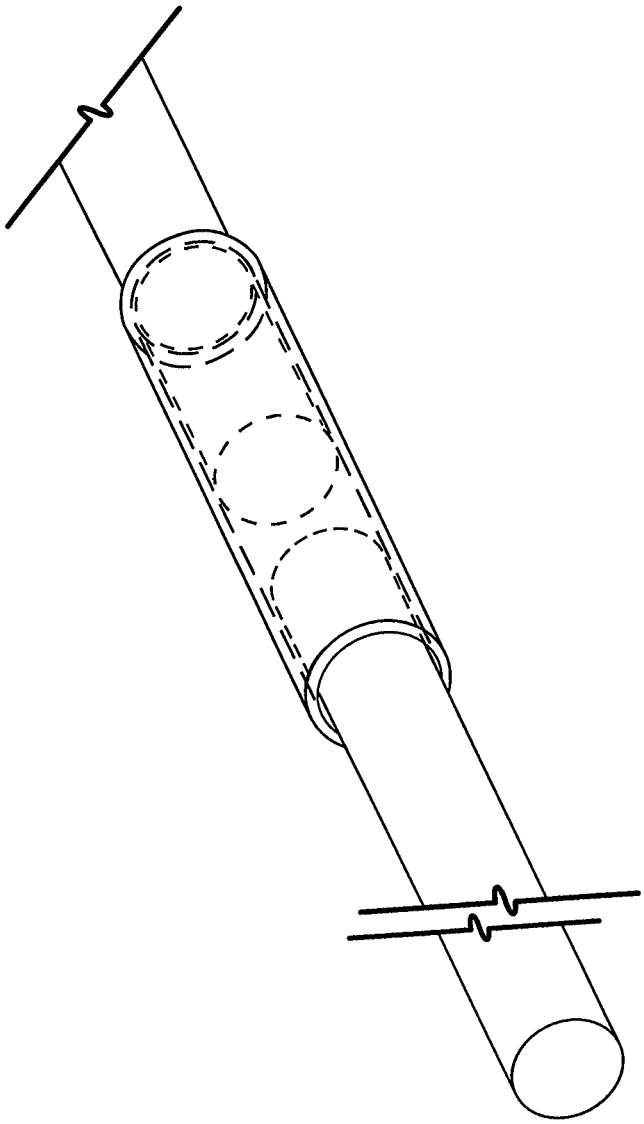

FIG. 19A-2 depicts another embodiment that replaces the pin and hole mechanism of FIGS. 19A-1 and 19A-1A with detents or ball-bearings that allow for indexing. The locking mechanism could be either a pivot post (shown in FIG. 19A-4) or a separate screw, pivot tray and index plate (shown in FIG. 19A-3. FIG. 19A-5 illustrates a form of the structure to keep the assembled body (FIG. 17B) in a vertical position. This shows a way to extend or unfold a rod that has been compacted for storage or travel. The pointing arrow shows how one would pivot the rod in the joint to move it from straight to folded position.

Figures 1, 19B:
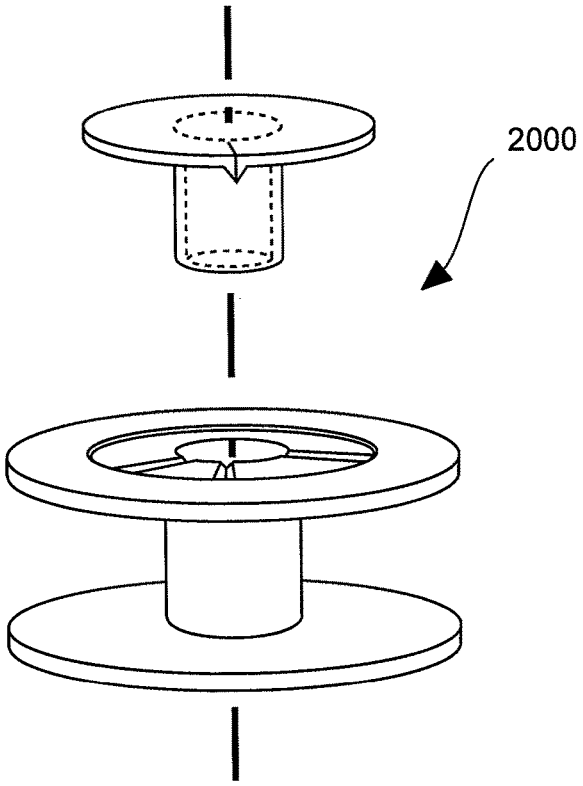
Figures 2, 19B:
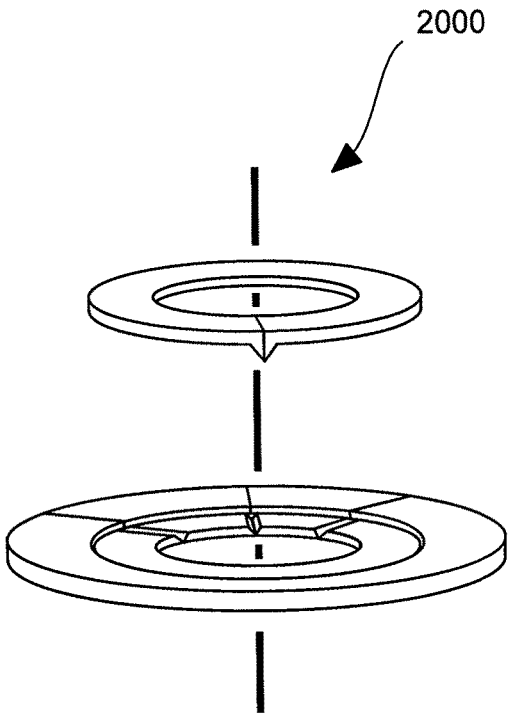
Figure 19B:
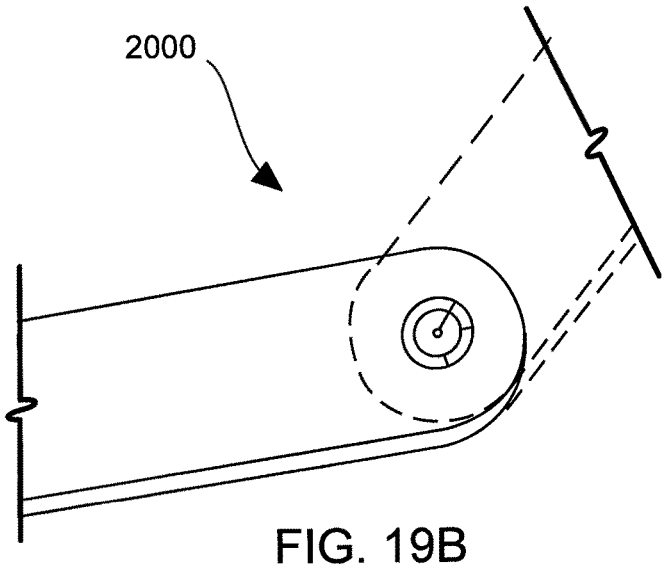
Figures 3, 19B:
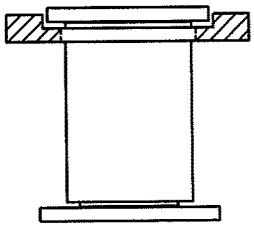
Figures 1, 19C:
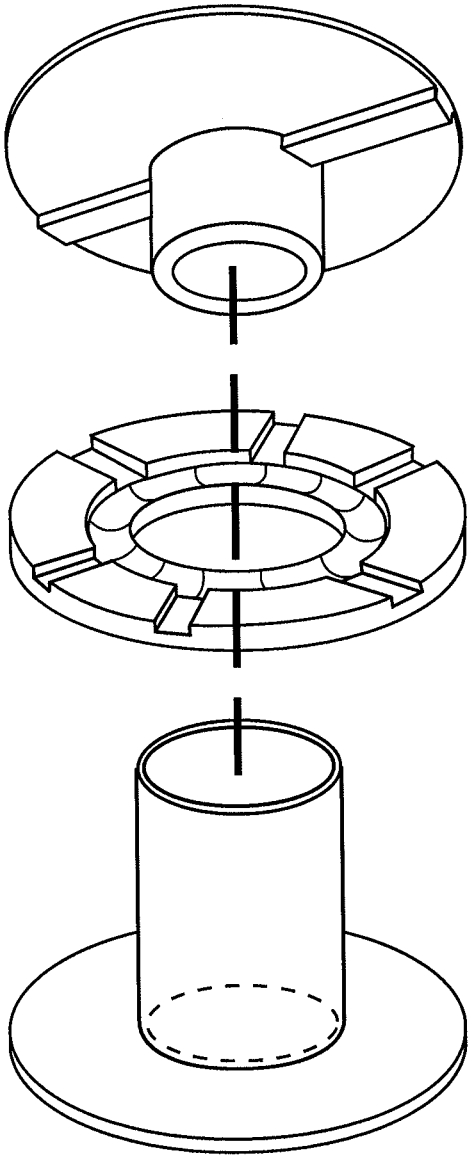
Figures 2, 19C:
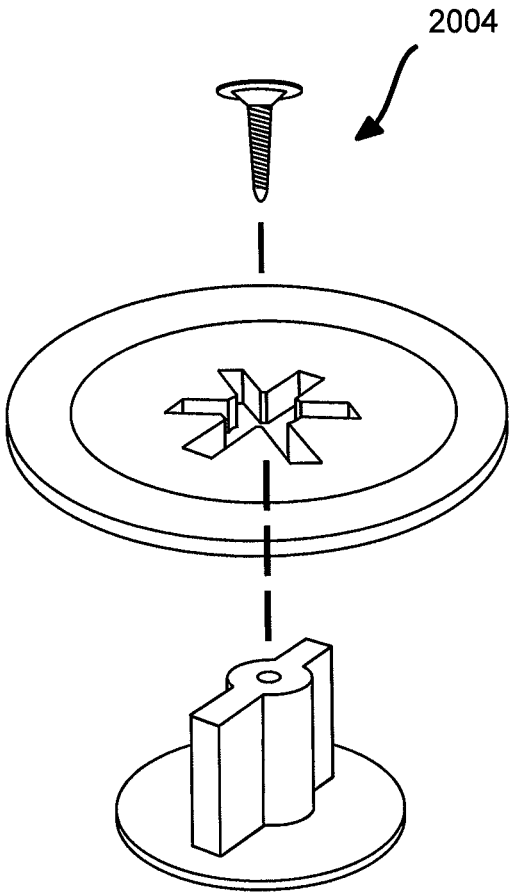
Figures 1A, 19C:
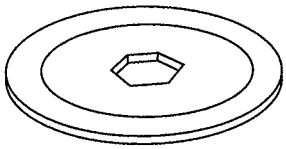
Figures 1B, 19C:
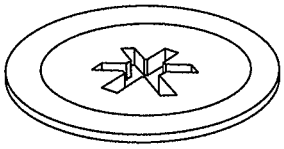
Figures 1C, 19C:
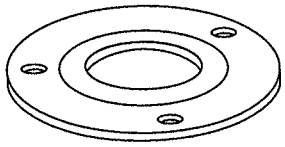

FIGS. 19B, 19B-1 to 19B-3 is another embodiment of a friction-type indexing system whereby the channels create the desired angle or alignment of the joined parts.

FIGS. 19C, 19C-1, 19C-1A to C-1C and 19C-2 is an exploded view of different embodiments of the locking mechanism 2004 for the indexing system 2000. Here, the appropriate locking screw (round, round with slot, hex or locking pin) is inserted into corresponding locking cap, which goes into a sleeve that allows for rotation of body parts (arm to shoulder, leg to torso, etc.), which goes into locking cap for completion of the joint mechanism.

Figures 1, 19D:
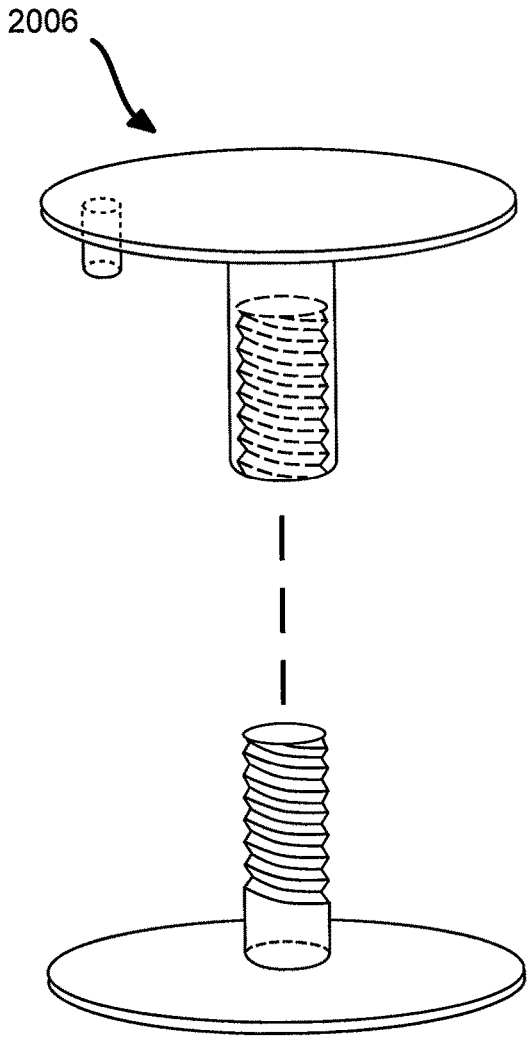
Figures 2, 19D:
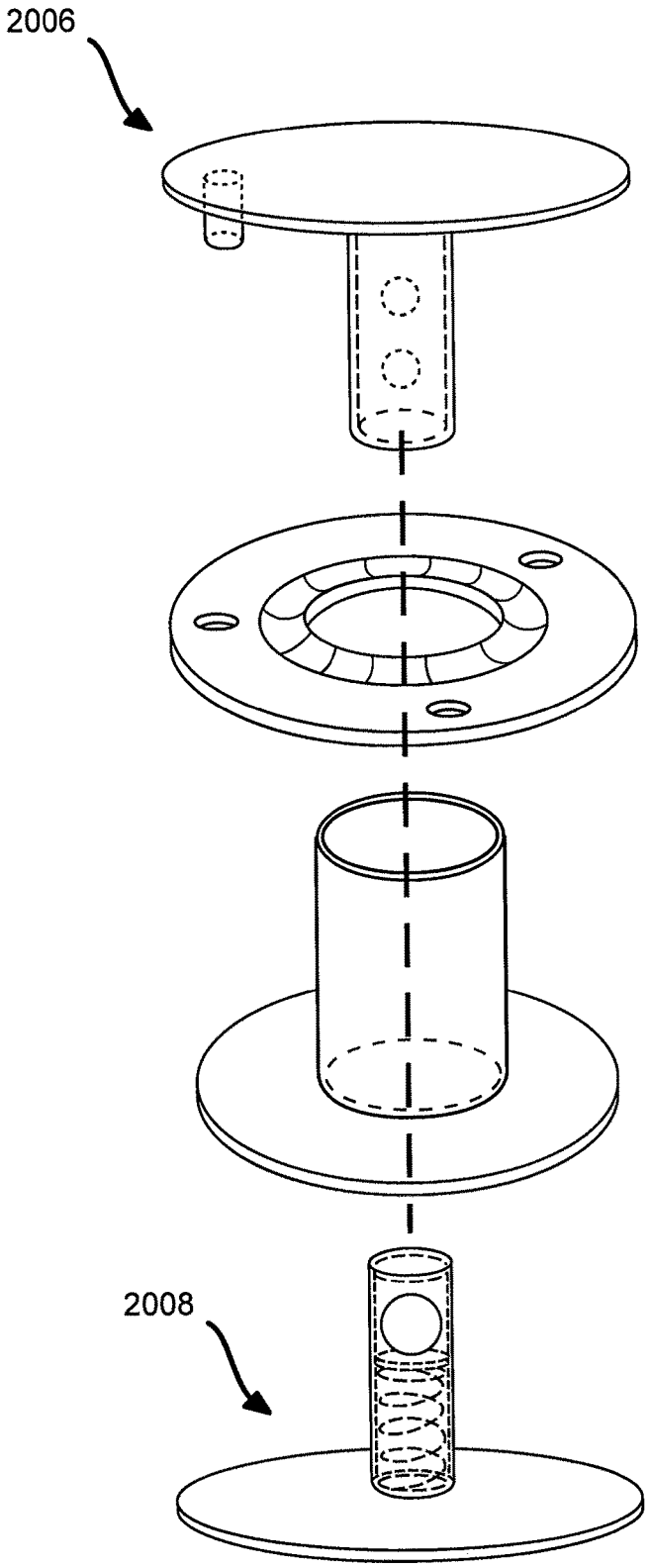

FIGS. 19D-1 through 19D-2 depict exploded views of two additional embodiments of a locking mechanism 2004. FIG. 19D-1 depicts a cap and screw 2006 that requires the use of a tool to hold the grommet or pivot sleeve in place. FIG. 19D-2 depicts an alternative top and bottom cap system 2006 that uses a spring-loaded button mechanism 2008 to change the holding position without the need for a tool. By pressing the button, the spring engages or releases the ball bearing so the opposing cap can be moved into a different position. Releasing the button then locks the pin into the indexed position.

Figures 1, 19E:
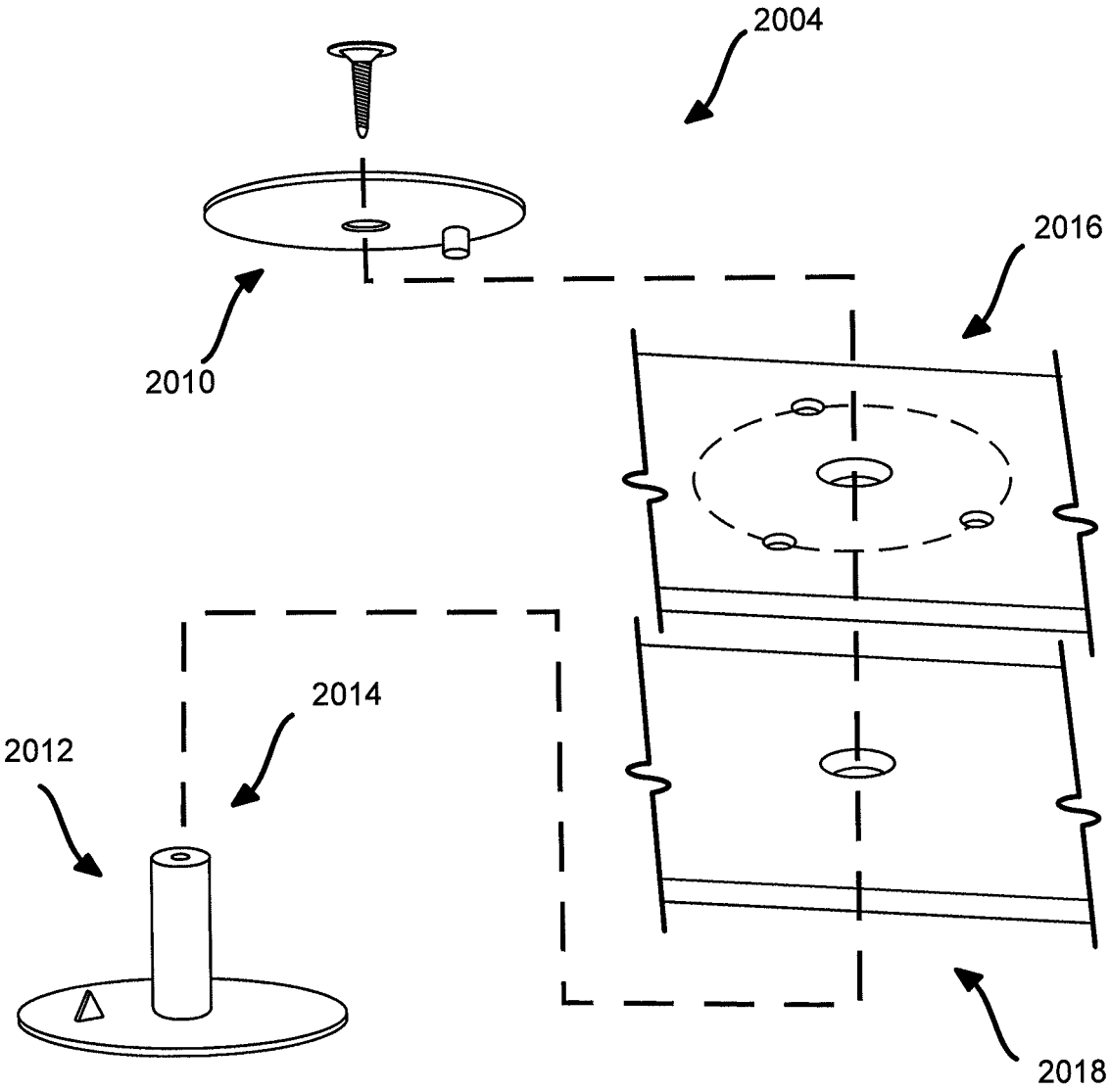
Figures 2, 19E:
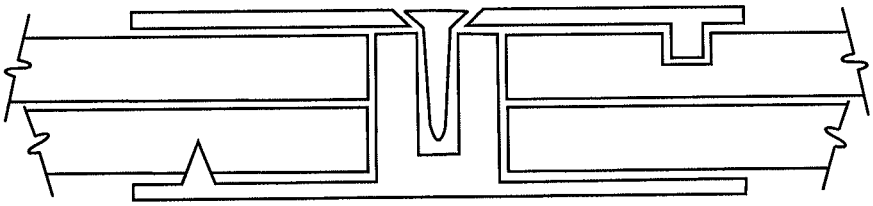

FIGS. 19E-1 and 19E-2 shows a simple locking mechanism 2004 comprised of a top and bottom plate 2010, 2012 with indexing pin 2014. The two rectangle shapes 2016, 2018 are partial sections of the body parts (arm, shoulder, torso, leg, etc.) with a pre-drilled hole in each for insertion of the locking mechanism 2004 plus the index detents put into the material rather than into the holding plate as shown previously.

In some examples, instead of connecting the head member 752, torso member 750, arm members 756, 758 and leg members 762 with pivots, the various members may be joined by hinges.

Figure 20:
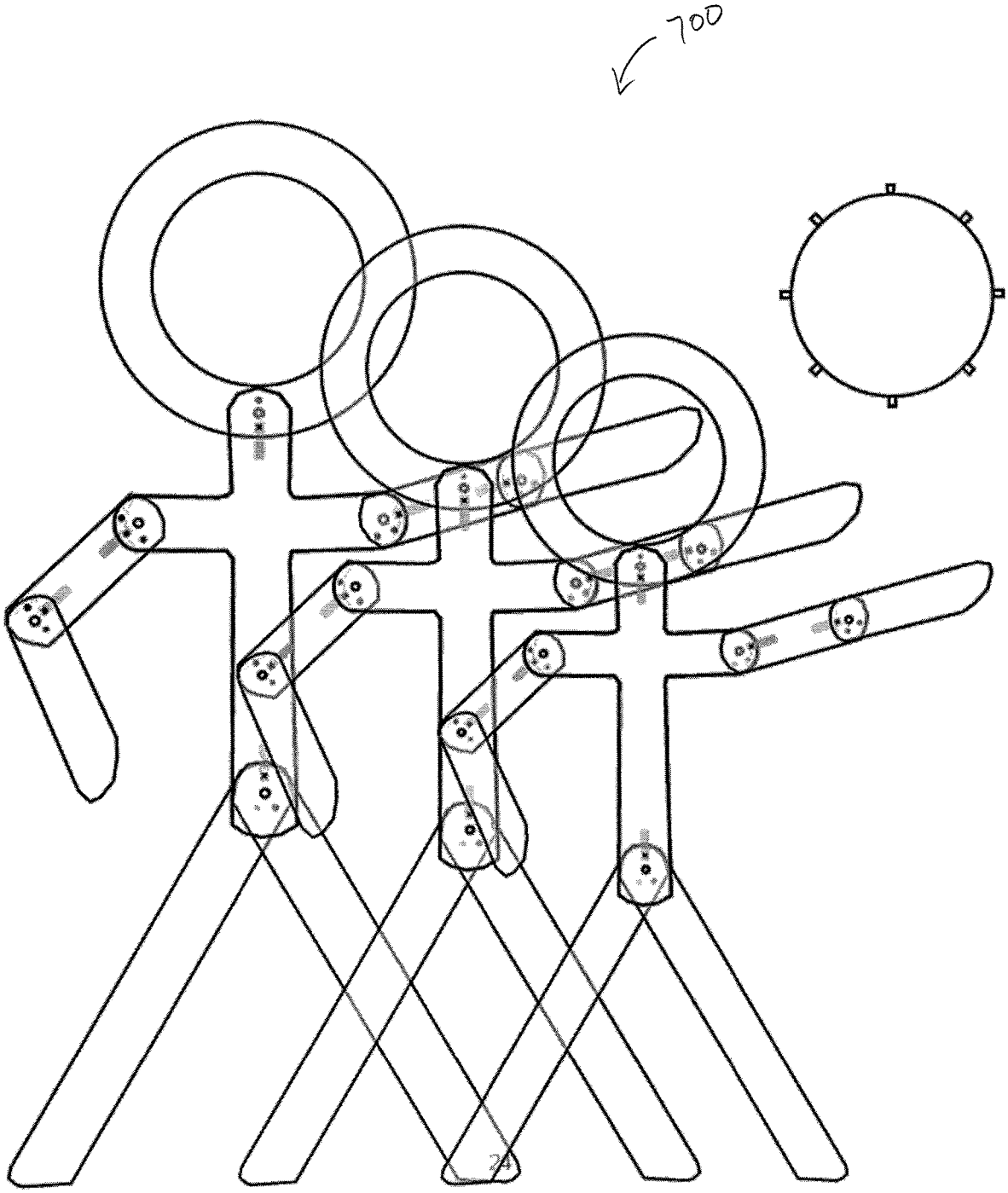
FIGS. 20, 21, 22 show schematically variations of the information conveying apparatus of FIG. 17A.
Figure 21:
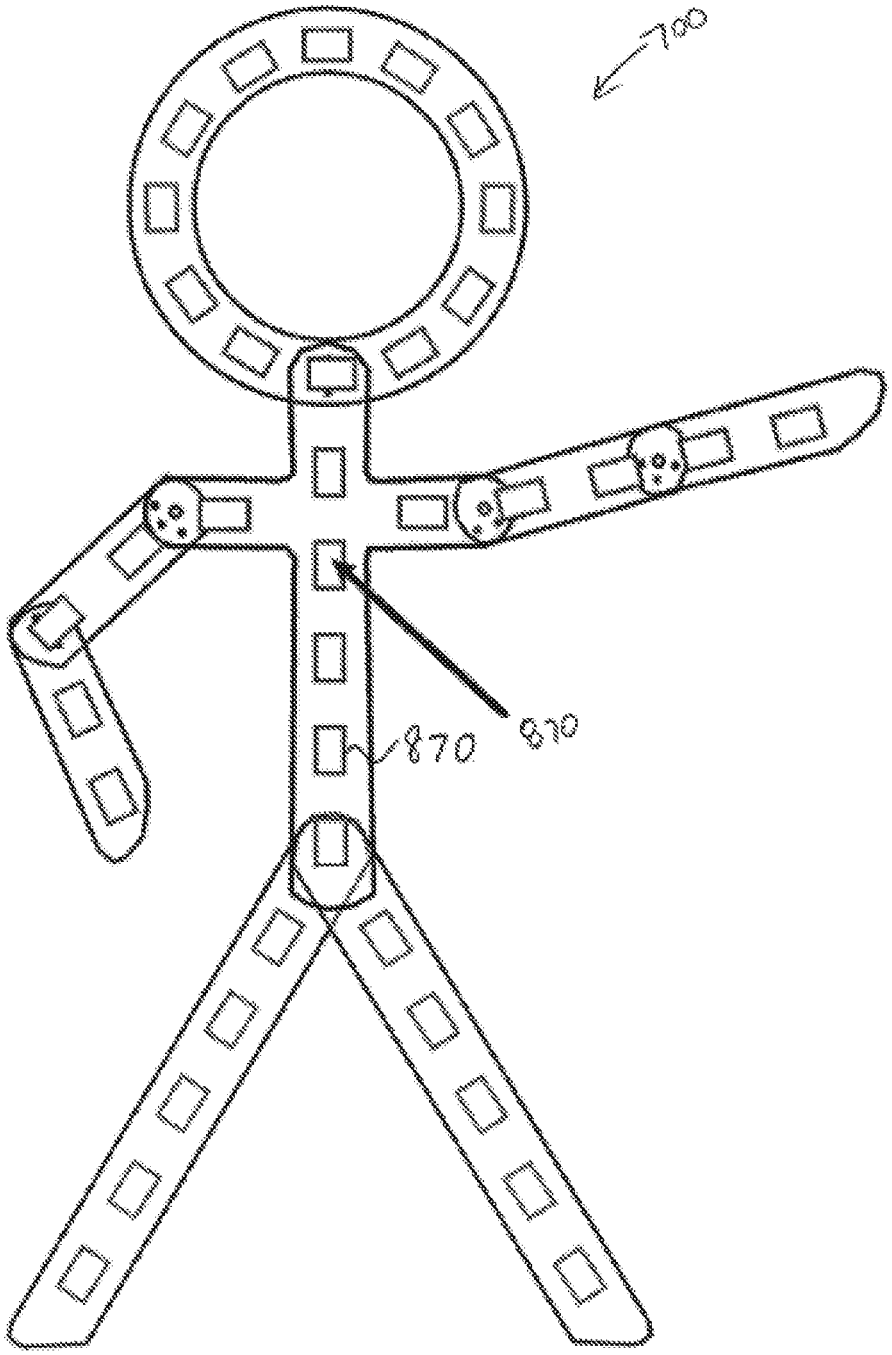
Figure 22:
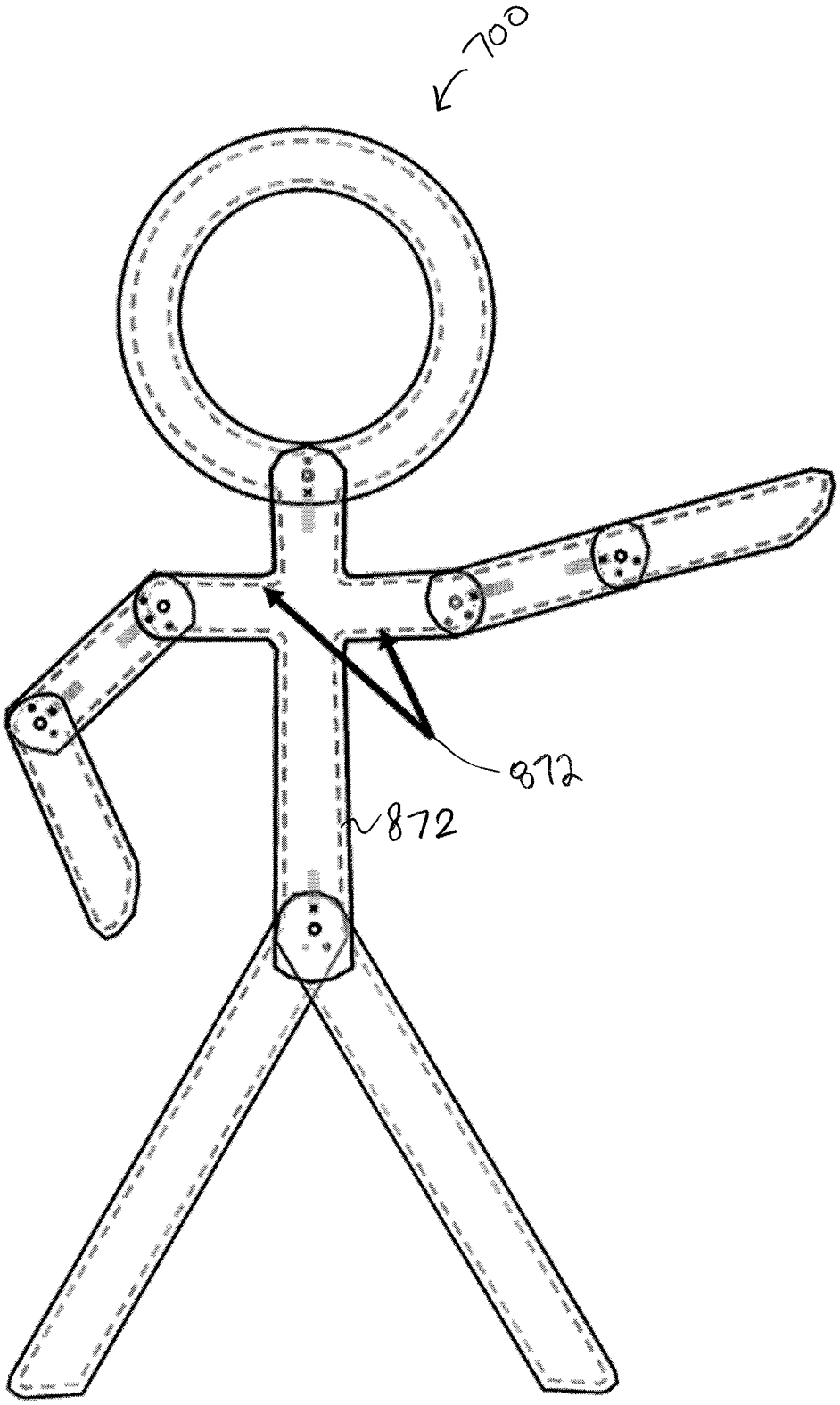

FIGS. 20-22 show variations of the stick figure structure 700. With reference to FIG. 20, the stick figure structure may be configured with various sizes, ranging from a few feet to over 10 feet for visibility. With reference to FIG. 21, the stick figure structure may include reflective strips 870 or other coloration glued or printed thereon. With reference to FIG. 22, the stick figure structure may include lighting elements, such as LED strings 872, positioned along the edge portions thereof and attached thereto by gluing, adhering, taping, rivets, screws, brackets, or any suitable attaching mechanism. The lighting elements 872 may enhance the appearance of the stick figure structure when the environment is dark or the surrounding lighting is low. Such reflective strips 870 or lighting elements 872 may also be applied to any other information conveying apparatus as described herein.

Figures 23A, 23B, 23C:
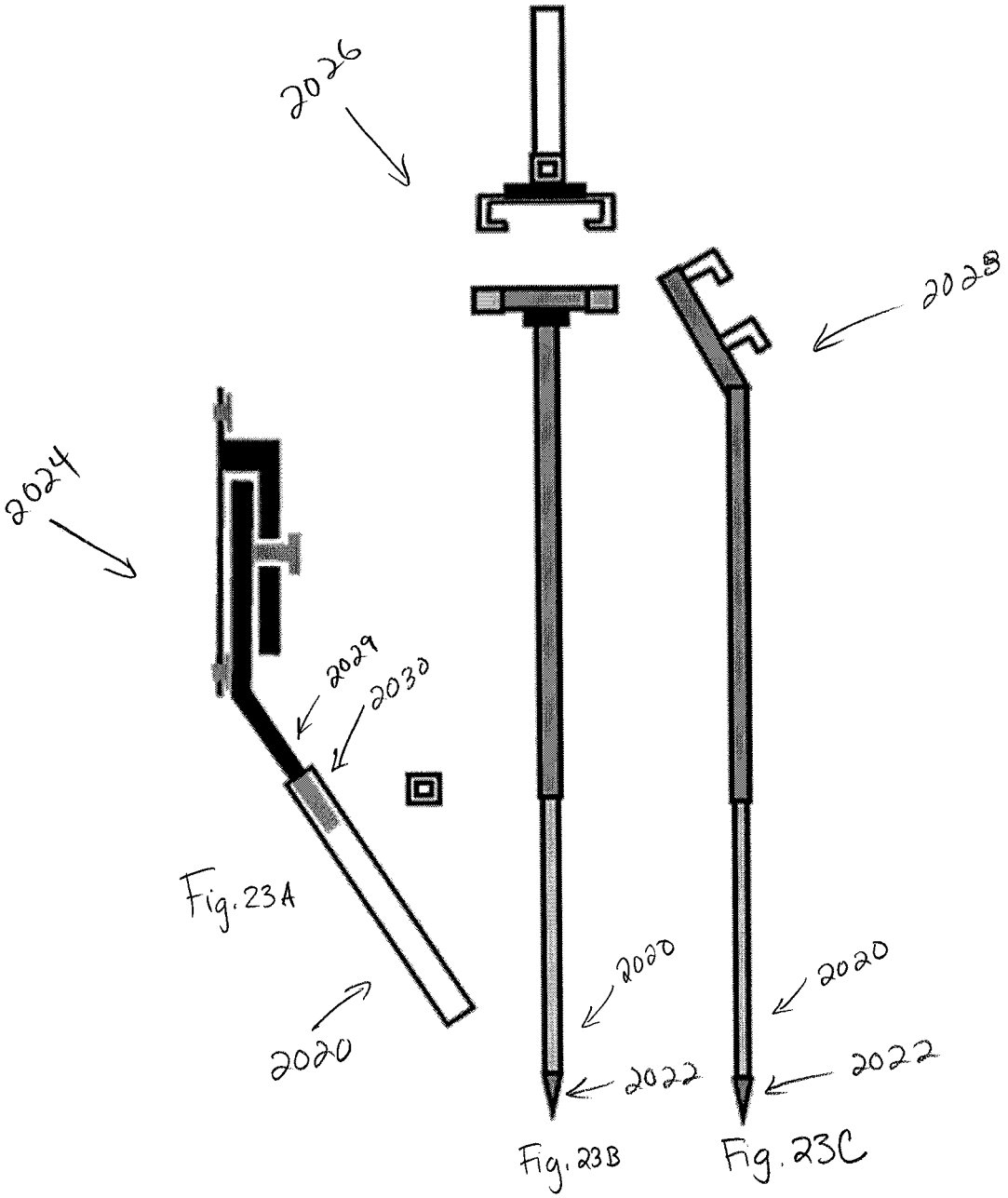
FIGS. 23A-C illustrate various mechanisms used to position the assembled body into an upright or angled position relative to the ground, a wall or object like the trunk of a car.

With reference to FIGS. 23A-C, various embodiments of mechanisms used to position the assembled body into an upright or angled position relative to the ground, a wall or object like the trunk of a car. These mechanisms may be attached to the assembled body via a pin or screw lock mount 2024 (FIG. 23A), sliding insert with pin lock 2026 (FIG. 23B), or via a clamping mechanism or pre-cut slots for tab insertion 2028 (FIG. 23C). The fixing attachment 2020 of the rod could be a penetrating pin or ground stake 2022. The fixing attachment 2020 could also involve inserting a shaft 2029 into a fixed receiver 2030.

Figure 24:
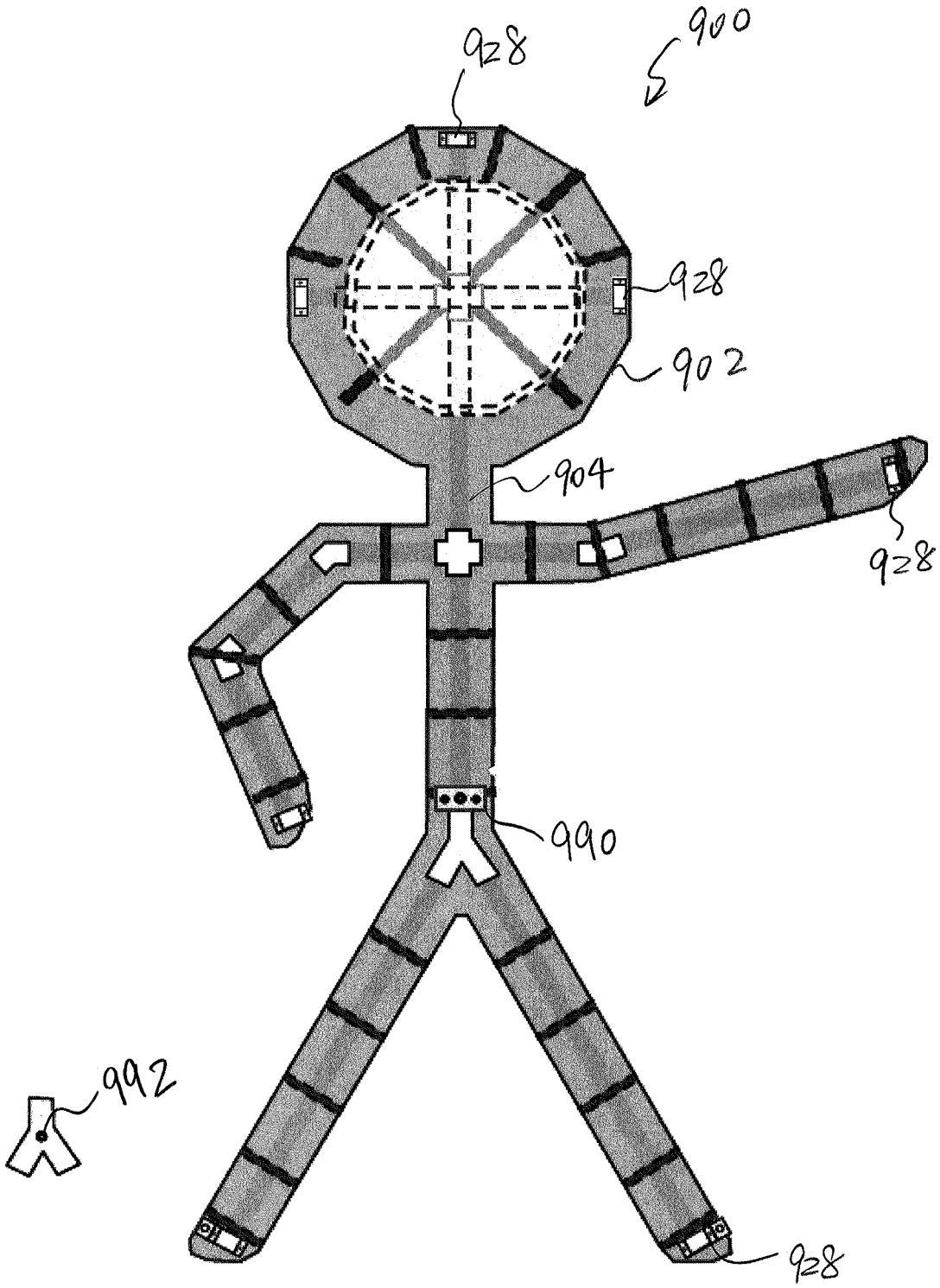
FIG. 24 illustrates an elevation view of another embodiment of an information conveying apparatus.
Figure 25:
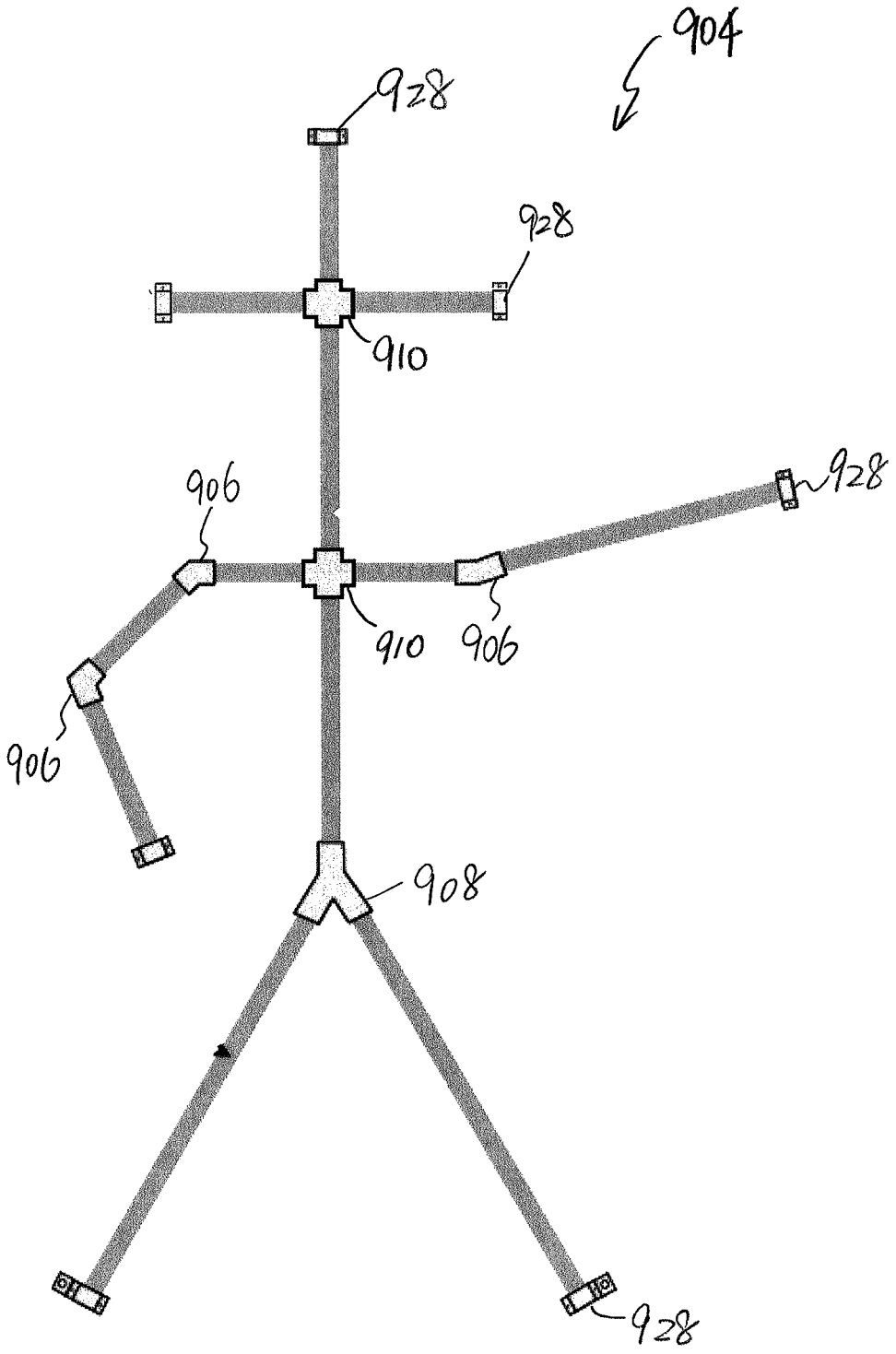
FIG. 25 illustrates an elevation view of a frame structure used for the information conveying apparatus of FIG. 24.

The stick figure structures or information conveying apparatuses described above may generally be formed using rigid or semi-rigid planar materials. With reference to FIGS. 24 and 25, another example of an information conveying apparatus, more specifically a stick figure structure 900, may be formed by a relatively flexible covering 902 supported by a skeleton frame 904. The relatively flexible covering 902 may include two layers of materials, one front layer and one back layer, joined together along their edges by sewing, gluing, adhering, or any suitable connection mechanism to form the stick figure shape. The layers of material may include fabric, plastic, and so on. Joining the materials together may create an internal sleeve for the skeleton frame 904. The front and back layers may be further sewn together to create channels for supporting skeleton segments (described in more detail below). The skeleton segments may be slid into the sleeve, sewn or locked if necessary, and kept in place. The relatively flexible covering 902 supported by the skeleton frame 904 in such a way that the end result may reflect the same or desired stick figure shape. The skeleton frame 904 may include skeleton segments joined together with joint mechanisms. When not in use, the flexible covering 902 may be removed from the skeleton frame 904 and the skeleton segments can be disassembled. The flexible covering 902 may be folded or rolled up and kept or bundled with the skeleton segments by attached string-like mechanics.

The flexible covering 902 may generally represent the stick figure and may include torso, shoulder, arm, and leg members. The skeleton segments may include corresponding torso, shoulder, arm, and leg segments that support the corresponding portion of the flexible covering 902. Crossed skeleton segments may collectively define the head area and support the head member formed by the flexible covering 902. The skeleton segments may be formed using fiberglass ribs. The cross section of the skeleton segments may be flat, square, rectangle, round, triangle, or any suitable shape. The skeleton segments may be hollow or solid. The flexible covering 902 may be formed using fabric, textile, plastic, or any suitable material.

To assemble the skeleton frame 904, connectors shaped with channels or openings to allow insertion of skeleton segments may be used. The connectors may additionally be configured with internal stops inside the channel to receive therein a predetermined length of the skeleton segments. With reference to FIG. 25, the connectors may include angled members configured with two openings (V connectors 906) for receiving therein the shoulder and arm skeleton segments or configured with three openings (Y connectors 908) for receiving the torso and leg skeleton segments. The connectors may further include cross members 910, each configured with four openings for receiving therein or passing therethrough skeleton segments for forming the head area or for joining the shoulder, torso, and neck skeleton segments. The cross members 910 may define two through channels crossing each other or four receptacles with internal stops.

Figure 26A:
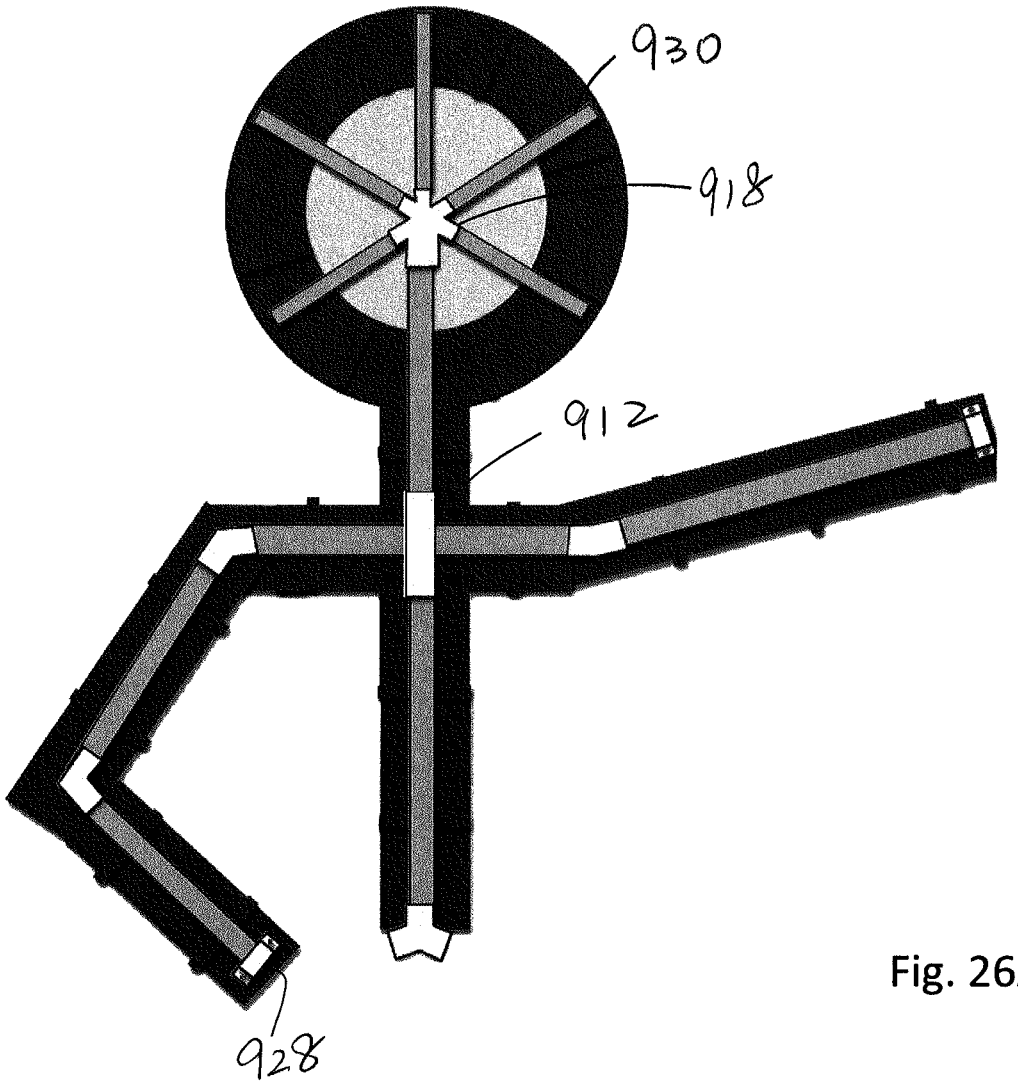
FIGS. 26A, 26B, 26C, 26D, 26E, and 26F illustrate various examples of connection mechanisms used for the frame structure of FIG. 25.
Figure 26B:
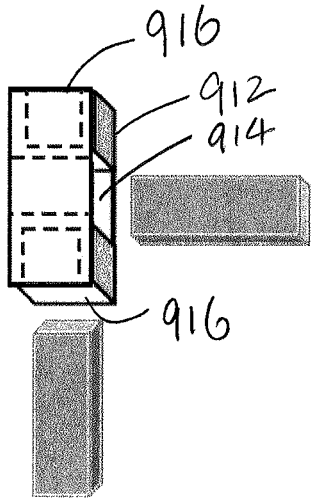
Figure 26C:
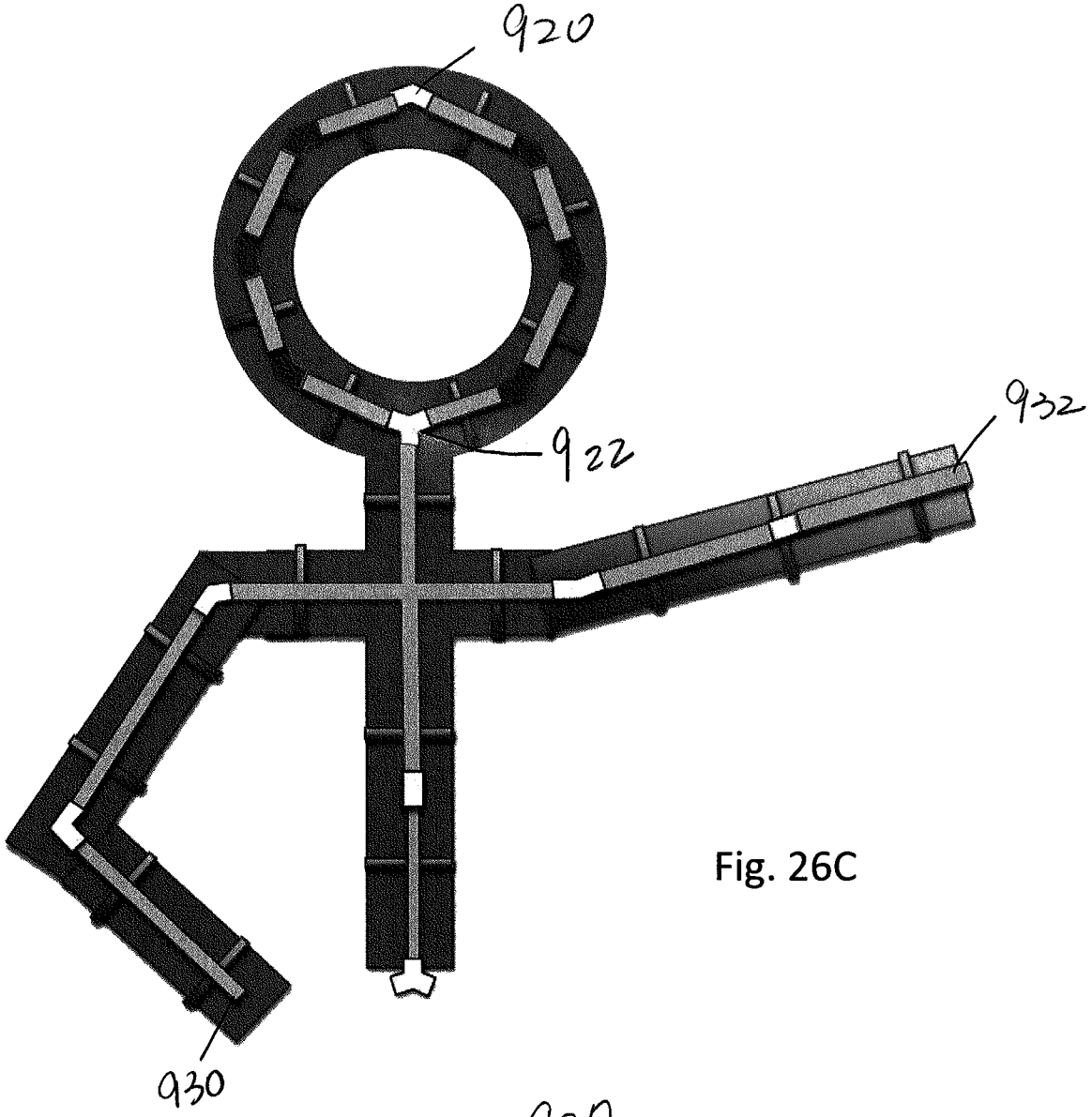
Figure 26D:
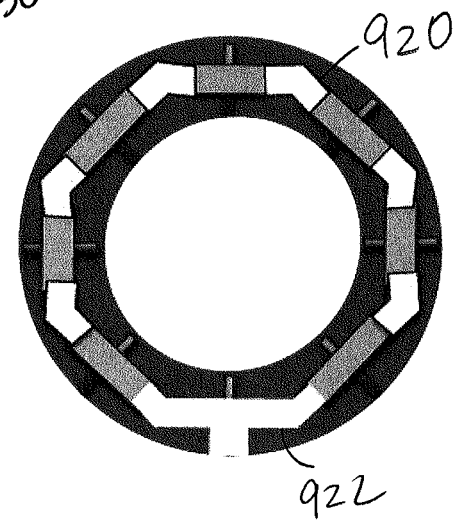

FIGS. 26A, 26B, 26C, 26D, 26E, and 26F illustrate various additional examples of connectors that may be used for assembly of the skeleton frame 904. In FIGS. 26A and 26C, one side of the covering 902 is removed to show the skeleton frame 904. With reference to FIGS. 26A and 26B, an elongated connector 912 may be used to join the torso, neck, and shoulder skeleton segments. The connector 912 may include a through channel 914 and two openings 916 on either side of the through channel 914. The through channel 914 may be configured to receive therein a skeleton segment forming both shoulder segments, and the two openings 916 configured to receive the ends of the torso segment and the neck segment. Alternatively, the through channel 914 may be configured to receive therein a continuous skeleton segment forming both the torso and neck segments, and the two openings 916 configured to receive the ends of the two separate shoulder segments.

With reference to FIGS. 26A, 26B and 26C, the head skeleton may be formed by a center connector 918 joining two or more radiating skeleton segments (FIG. 26A) or a number of angled connectors 920 each joining two skeleton segments forming a polygonal shape (FIGS. 26B and 26C). The polygon shaped head skeleton may be joined to the neck or torso segment using a connector 922 having three openings, two of which join two head segments and the third joining the neck or torso segment.

Figure 26E:
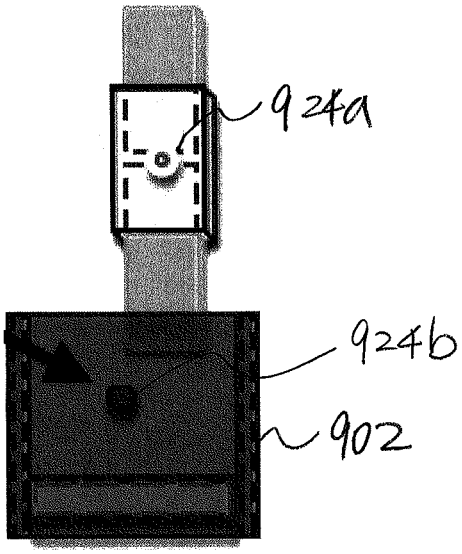
Figure 26F:
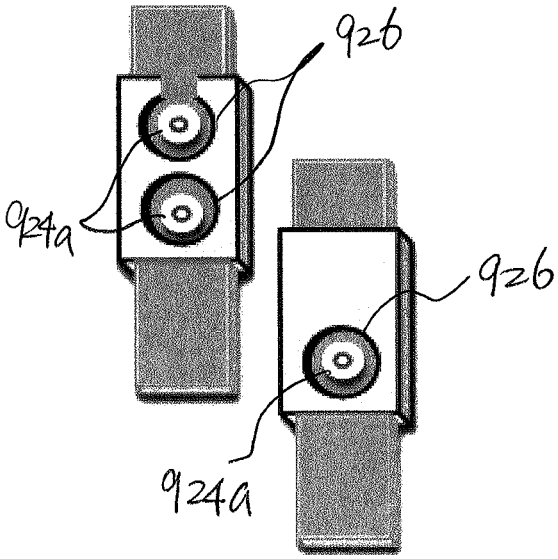

The connectors and the skeleton segments may be kept together by friction fit. Additional locking mechanism, such as pins, screws, and so on, may be used to secure the connectors to the skeleton segments. With reference to FIG. 26E, the connectors may be configured with one or more snap buttons 924*a* on the exterior thereof for releasably engaging mating snap buttons 924*b* configured on the interior of the covering material 902. The locking mechanism may not be needed if the skeleton segments may be kept in place or tightened externally by the attachment of the flexible covering 902. With reference to FIG. 26F, instead of configuring snap buttons on the connectors, the skeleton segments may be provided with one or more snap buttons 924*a*. The connectors may be configured with one or more openings 926 such that when the skeleton segments are joined to the connectors, the snap buttons 924*a* configured at the skeleton segments may engage mating snap buttons 924*b* configured on the interior of the covering material 902 through the openings 926 of the connectors. Although snap buttons 924 are described herein as examples, other connection mechanisms may be used, such as hook and loop fasteners, magnets, and so on.

Referring back to FIGS. 24, 25, 26A, and 26C and in some examples, the free ends of the skeleton frame 904 may be joined to the covering material 902 by end caps 928. In some examples and with reference to FIGS. 26A and 26C, some free ends 930 of the skeleton frame 904 may be simply received into a folded fabric, sewn pocket or cap of the covering material 902. With further reference to FIG. 26C, some free ends 932 of the skeleton frame 904 may not be received or covered by the covering material 902 and may extend outside the covering material 902. The end caps 928 and the skeleton connectors may be made of the same or different materials, such as metal, plastic. They may be custom made or standard commercial ties. The body material shown in FIGS. 24 and 26 is depicted as a fabric with periodic reinforcements whether stitching, sewn in fabric stabilizers, batons, or even straps for attachment to supportive skeleton. In alternative embodiments, the frame can slide between fabric and reinforcement.

Figure 27A:
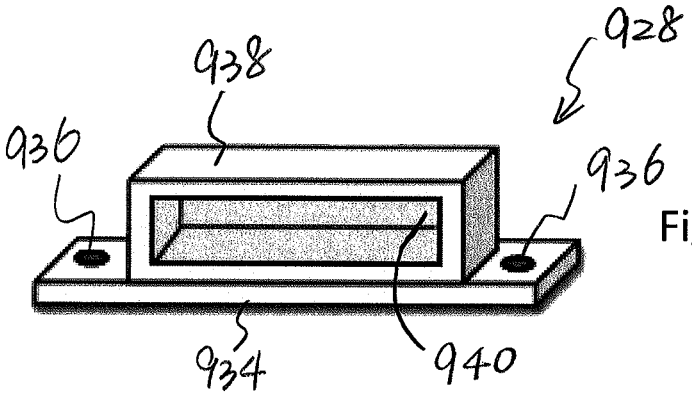
FIGS. 27A, 27B, 27C, 27D, 27E, 27F, 27G, 27H, and 27I illustrate various examples of end structures used for the frame structure of FIG. 25.

With reference to FIG. 27A to 27I, various examples of end caps 928 will be described. With reference to FIG. 27A, the end cap 928 may include a base portion 934 formed with two openings 936 at either end of the base portion 934 and a cap portion 938 positioned on the base portion 934 between the two openings 936. The end portions of the flexible covering 902 may be configured with corresponding openings that may be aligned with the openings 936 of the end cap 928 for receiving fasteners, such as rivets, screws, and so on, to join together the flexible covering 902 and the skeleton frame 904. More specifically, the flexible material is fastened or riveted onto the joint through openings 936. The skeleton is then slid through the center channel 942 until terminating at the closed end channel 940 at the end of the arm or foot. The accessible end cap has a folding cap or hinged door 944 that snaps closed via closure lock 946, ultimately becoming FIG. 27A. When solid end caps are used on both ends, the skeleton sticks should be sturdy yet flexible (i.e.: fiberglass rods) so that the sticks can be bent for insertion in both ends.

Figure 27B:
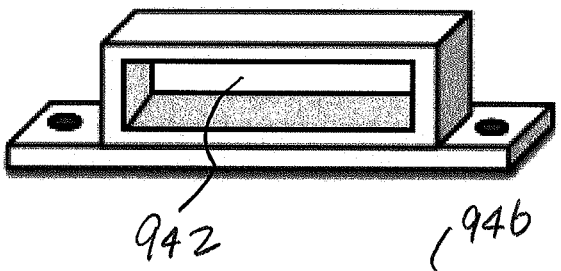
Figure 27C:
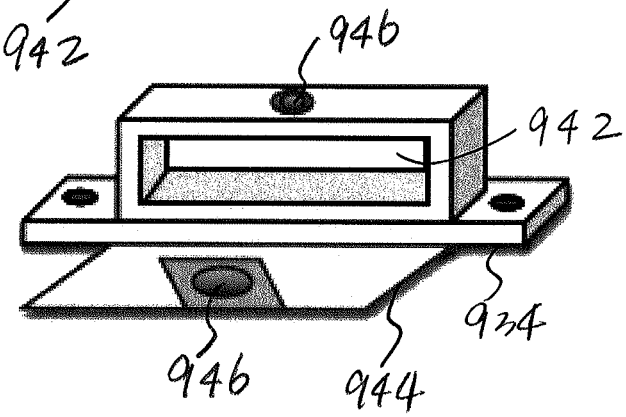
Figure 27F:
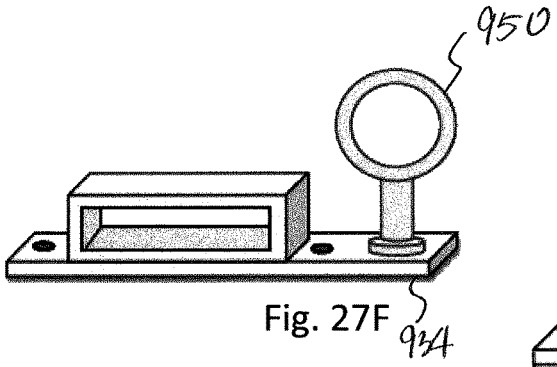
Figure 27E:
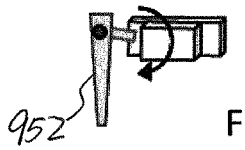
Figure 27G:
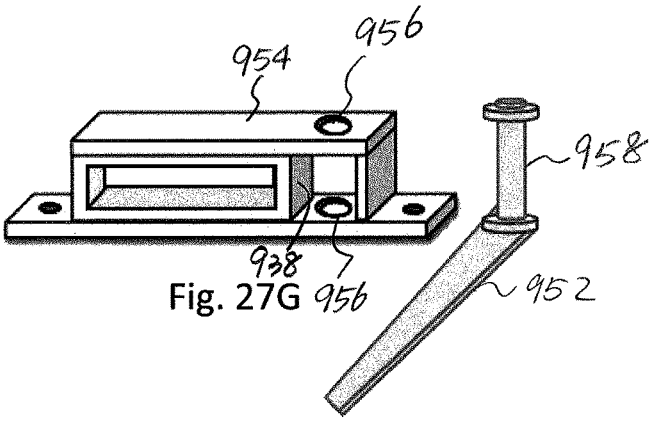
Figure 27D:
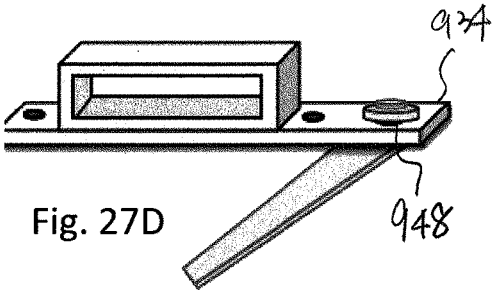
Figure 27H:
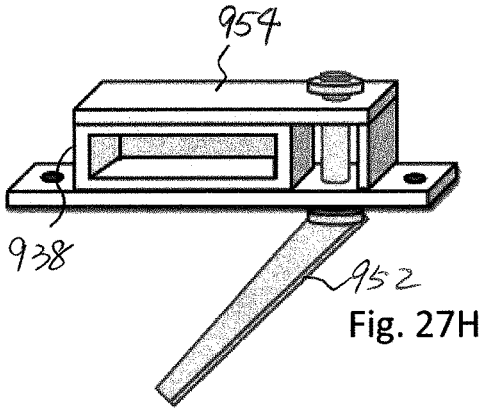
Figure 27I:
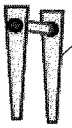

The cap portion 938 may define a close-ended channel 940 (see FIG. 27A) or a through channel 942 (see FIGS. 27B and 27C). With reference to FIG. 27C, the end cap 928 may be configured with a hinged door 944 pivotably joined to the base portion 934. The hinged door 944 may be releasably joined to the top of the cap portion 938 by a snap or closure lock 946 so as to hold therein an end portion of the skeleton frame 904 and to allow easy slide access. With reference to FIGS. 27D-28H, the end caps 928 for receiving the end portions of the leg skeleton segments may be further configured to pivotably attach thereto foot stakes 952, which may be pushed into the ground or set above ground surface. With reference to FIGS. 27D and 27F, the base portion 934 of the end cap 928 may be configured with openings 948 or attaching rings 950 for pivotably attaching thereto foot stakes 952. With reference to FIGS. 27G and 27H, the end cap 928 may be further configured with a plate 954 on top of the cap portion 938 that extends beyond the cap portion 938. Aligned apertures 956 may be formed in the extension of the plate 954 and the base portion 934 for receiving therein an axle 958 for pivotably joining a single foot stake 952 (FIGS. 27G and 27H) or a double-foot stake 952 (FIG. 27I).

Figures 28A, 28B, 28C, 28D, 28E:
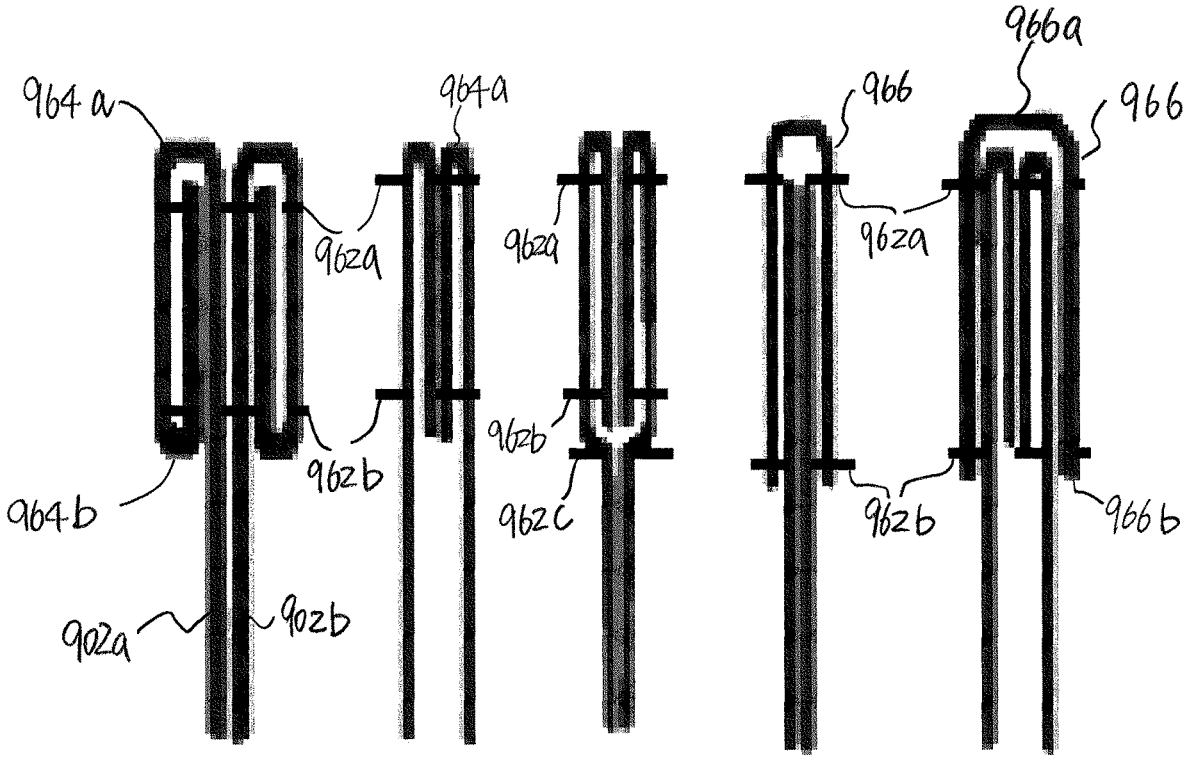
FIGS. 28A, 28B, 28C, 28D, and 28E illustrate various edge configurations for a covering used for the information conveying apparatus of FIG. 24.

With reference to FIGS. 28A, 28B, 28C, 28D, and 28E, the relatively flexible covering 902 may include two layers of materials 902*a*, 902*b* joined together by sewing along their edges to create an internal sleeve for the skeleton frame 904 (see edge stitching 960 in FIGS. 29, 30, 31, 32A, 32B, and 32C). With reference to FIG. 28A, the edges of the front and rear covering materials 902*a*, 902*b* may be folded outwardly two or more times so that the edge portions are not exposed. One or more lines of stitching 962*a*, 962*b* near each folding line 964*a*, 964*b* may be used to join the front and rear covering materials 902*a*, 902*b* together. With reference to FIGS. 28B and 28C, the edges of the front and rear covering materials 902*a*, 902*b* may be folded inwardly. One or more lines of stitching 962*a* may be used near the folding line 964*a* and another one or more lines of stitching 962*b*, 962*c* may be used near, above, and/or below the folded-in edges of the covering materials 902*a*, 902*b*. With reference to FIGS. 28D and 28E, an edge strip or binding material 966 may be used to surround or wrap around the edges of the covering materials 902*a*, 902*b*. The edges of the front and rear covering materials 902*a*, 902*b*, received within the binding, may or may not be folded. One or more lines of stitching 962*a* may be used near the back 966*a* of the binding material 966, and one or more lines of stitching 962*b* may be used near the edges 966*b* of the binding material 966 to join the material layers together. The two layers 902*a*, 902*b* of the covering 902 may be joined together along their edges by gluing, adhering, stapling, or any other suitable connection mechanism. The edges of the two layers 902*a*, 902*b* of the covering 902, with or without the binding material 966, may be further treated or reinforced to provide sufficient rigidity for low sag following the edge treatments. Advantageously, the above description provides various methods to sew or reinforce fabric for better stability of shape whether edge, seam or reinforcement treatment. In one implementation, the reinforcement material or pockets may be sewn so as to receive more rigid bracing like the batons used in sailboat sails.

Figure 29:
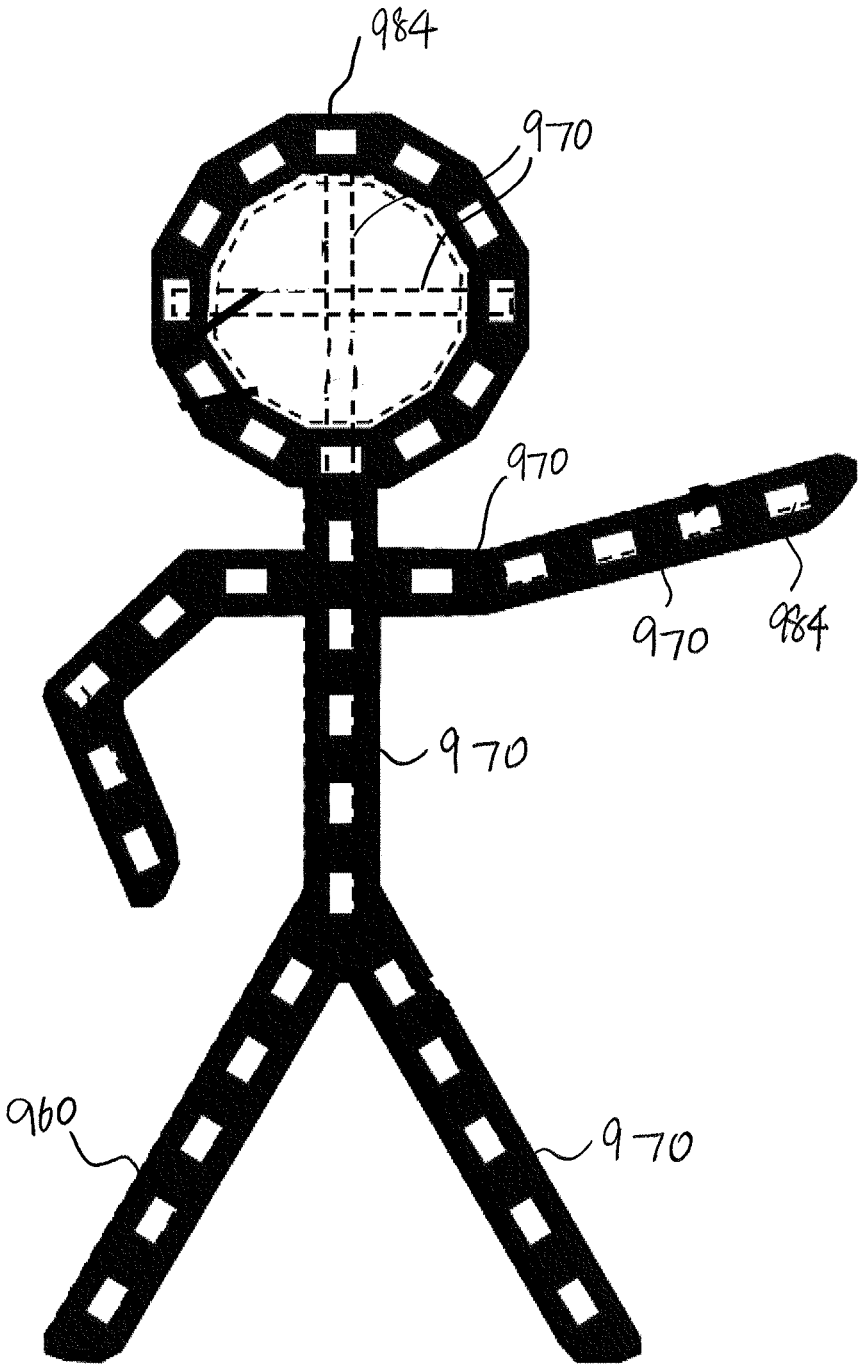
FIGS. 29, 30, 31 and 32 illustrate schematically variations of the information conveying apparatus of FIG. 24.
Figure 30:
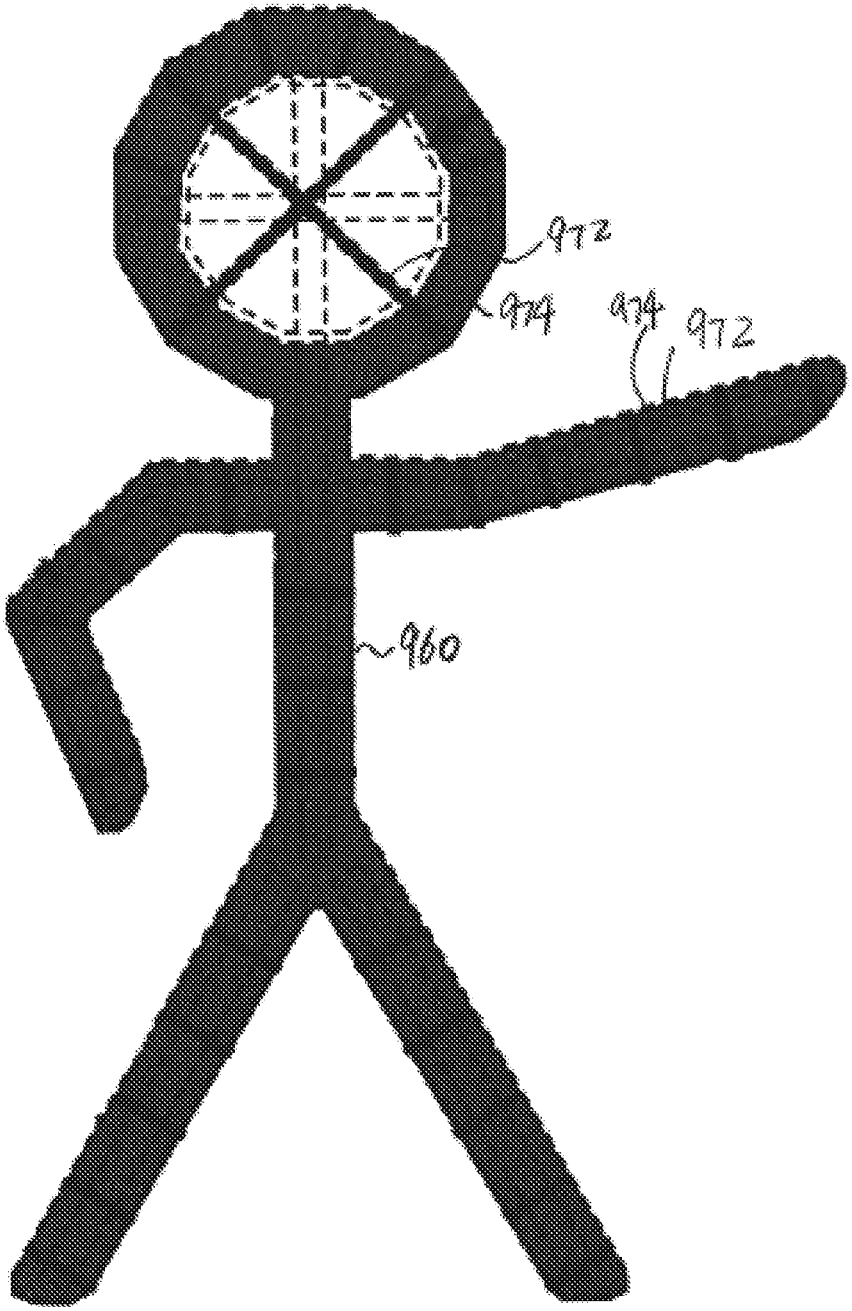
Figure 31:
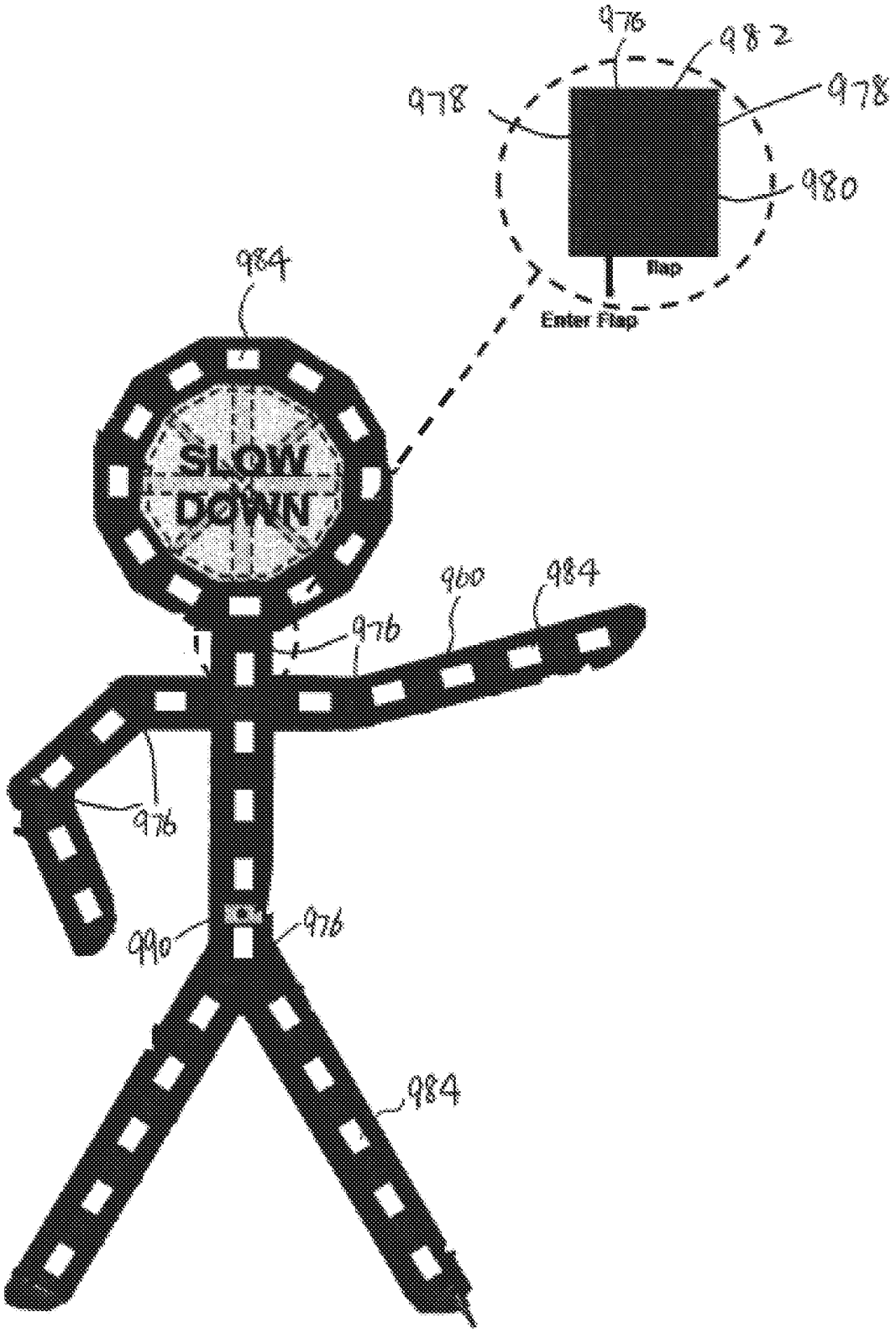

With reference to FIGS. 29, 30, and 31, the front and back layers 902*a*, 902*b* of the flexible covering 902 may be further sewn together to create channels to support and hold in place the skeleton frame 904 and other stiffening materials. With reference to FIG. 29, some channels 970 may extend along the longitudinal dimension of elongated portions of the stick figure, such as the arms, legs, torso, and shoulder portions, for receiving therein supporting skeleton segments. Some channels 970 may also cross a large area of the stick figure, such as the head of the stick figure and the head insert joined thereto. The channels 970 may define a width dimension that may be less than the covering 902 and similar to the width dimension of the skeleton segments so as to hold the skeleton segments in place.

With reference to FIG. 30, some channels 972 may extend across the longitudinal dimension of the elongated portions of the stick figure, such as the arms, legs, torso, and shoulder portions, and may be arranged along these elongated portions of the stick figure at any suitable intervals. These cross channels 972 may include a width dimension less than the channels 970 for receiving the skeleton frame segments. The cross channels 972 may receive therein stiffening materials 974, such as strip stiffeners, to keep shape of the stick figure in weather elements. The head portion of the stick figure, as well as the head insert received therein, may also be configured with such cross channels 972 and similar stiffening strips 974. The strip stiffeners 974 may be made from fabric, plastic, metal, or any suitable material. In some implementations, the strip stiffeners 974 may be joined to the covering 902 directly by gluing, adhering, stapling, or any suitable connection mechanism. In some implementations, strip stiffeners 974 may not be needed since the cross channels 972 created by sewing together the two layers of the covering 902 may be sufficiently stiff to maintain the shape of the stick figure.

With reference to FIG. 31, one side of flexible covering 902 may further include one or more skeleton access flaps 976. The skeleton flaps 976 may be configured near the transition areas between different portions of the stick figure formed by the flexible covering 902, such as transitions between the torso and the legs or the head, transitions between the shoulders and the arms or portions of the arms. Such transition areas may correspond to joints between different skeleton segments of the skeleton frame 904. The flaps 976 may be created by two overlapping portions of the covering material 902 with side stitches 978 to create fold over flaps such that the access flaps 976 may include an external opening 980 and an internal opening 982 offset from the external opening 980. The skeleton segments of the frame 904 may enter the covering 902 by passing under the flaps 976 through the external and internal openings 980, 982.

With further reference to FIGS. 29 and 31, the stick figure may include reflective strips 984 attached to the exterior of the flexible covering 902 by sewing, stapling, gluing, adhering, or any suitable attaching mechanism. In some implementations, the reflective strips 984 and portions of the covering 902 underneath the reflective strips 984 may form flaps similar to the flaps 976 described above with reference to FIG. 31 for insertion of the segments of the skeleton frame 904 into the flexible covering 902.

Figure 32:
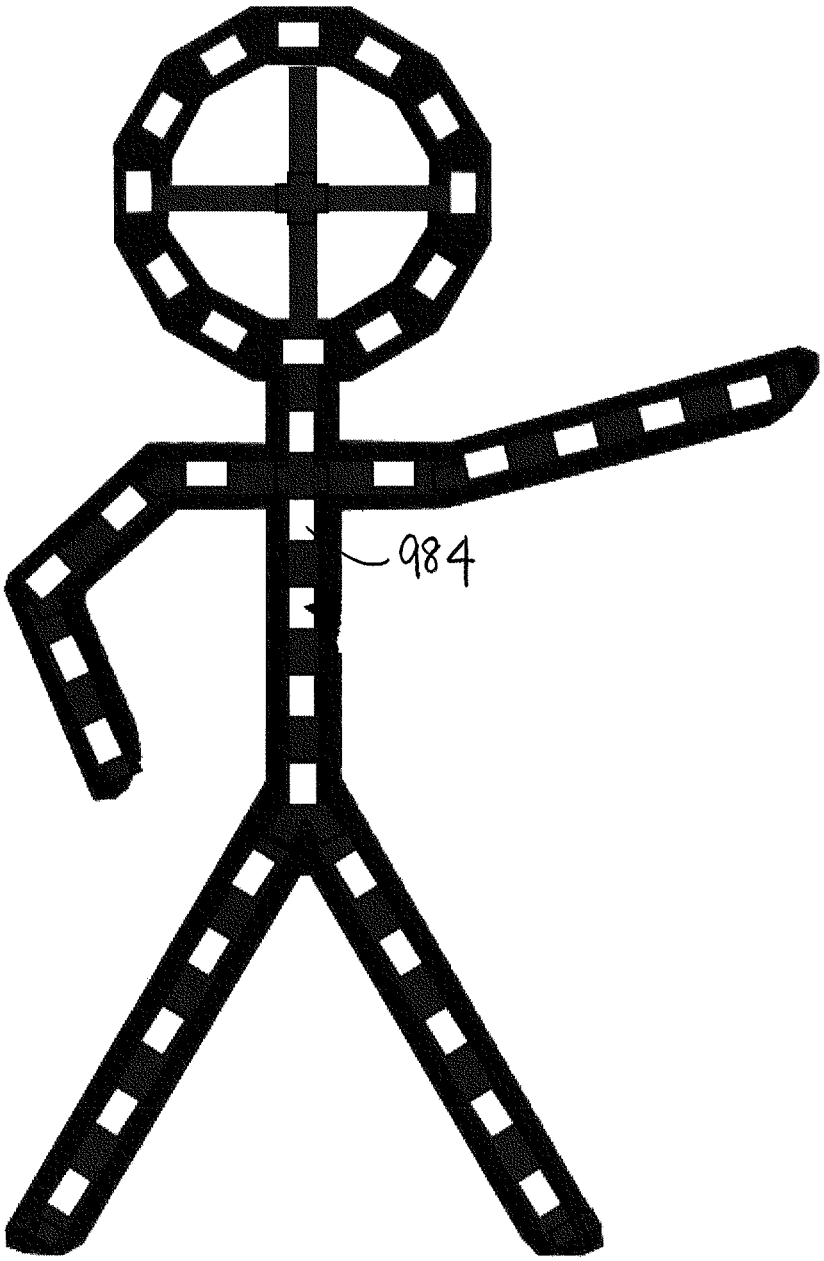

With reference to FIG. 32, in some implementations, the reflective strips 984 may be sewn to the flexible covering 902 in a manner such that the reflective strips 984 may collectively form channels similar to the channels 970 described above for holding in place the segments of the skeleton frame 904. When reflector patches 984 are used to form skeleton channels for securing the skeleton frame 904 to the covering 902, the covering 902 may be formed using only one layer of material instead of two layers sewn together. In further implementations, the skeleton frame 904 may be joined to the one-layer covering 902 by one or more snaps, hooks, material sleeves, end caps, reflector patches, or a combination thereof.

Figure 33A:
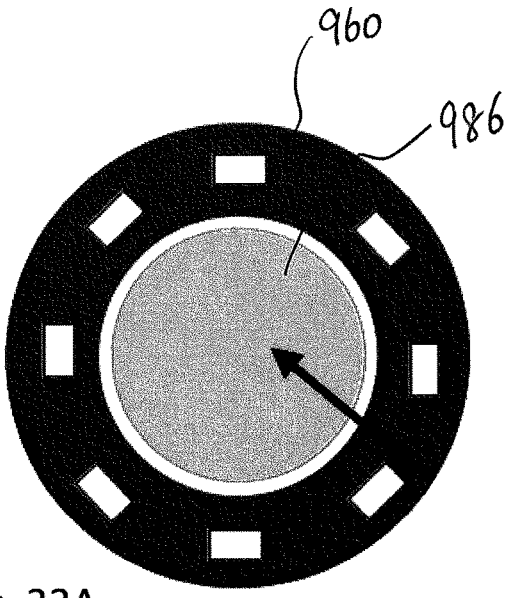
FIGS. 33A, 33B, and 33C illustrate schematically head inserts and attaching mechanisms therefor used for the information conveying apparatus of FIGS. 24, 29, 30, 31, and 32.
Figure 33B:
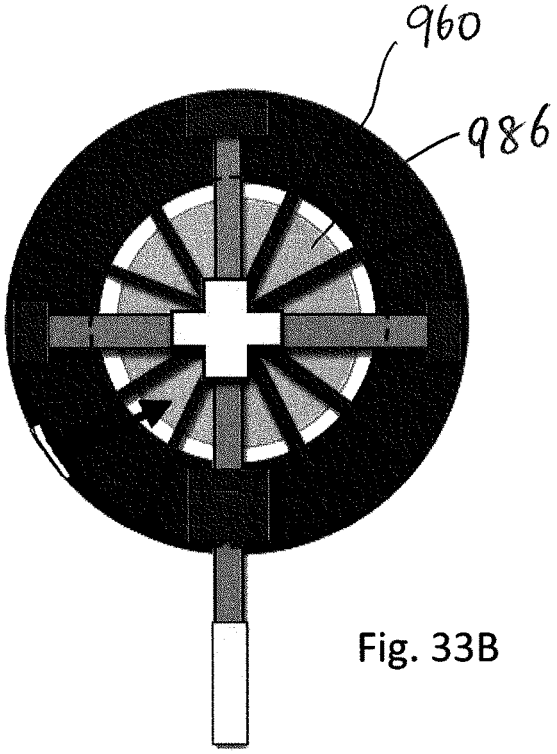
Figure 33C:
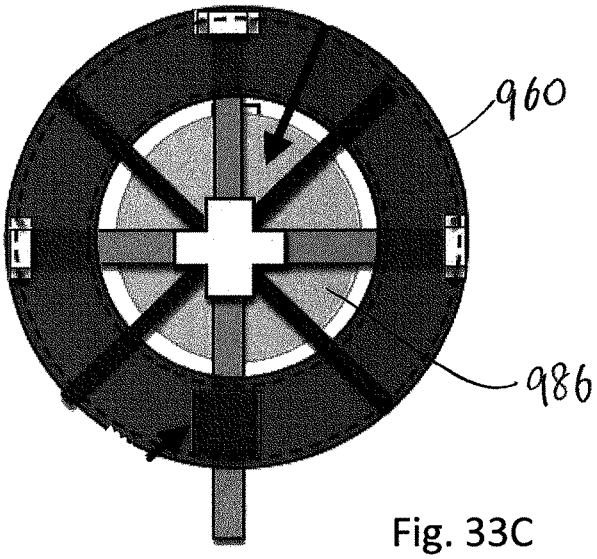

With reference to FIGS. 33A, 33B, and 33C, a head insert 986 for conveying additional information may be included. In some implementations, the head insert 986 may be formed by two layers of materials with stitched channels for receiving portions of the skeleton segments defining the head area. The head inserts 986 may include one or more additional channels for holding in place stiffening materials. In some implementations, the head insert 986 may be formed of only one layer of material and may be attached to the head portion of the stick figure, the head portion of the skeleton frame 904, or both. The head insert material 986 may be the same or different from the covering materials 902 and may be of same or different colors. Typically, the head insert 986 may be in white color for adding text information and the covering materials 902 for forming the stick figure shape may be in orange, blue, green, yellow, or any suitable color. The head insert 986 may be sized such that a gap may be formed between the head insert 986 and the circular head portion of the stick figure to allow air to pass through.

With reference to FIGS. 24 and 31, a mounting mechanism 990 may be provided near the lower end portion of the torso for supporting the stick figure structure/shape in an upright position. The mounting mechanism 990 may include two pieces of surface plates positioned on either side of the stick figure covering 902. The mounting bracket 990 may include one or more apertures or integrated nuts for joining by bolts thereto a mounting stand (described below). Alternatively, the mounting mechanism 992 may include an aperture or an integrated nut formed on each side of the Y connector for joining the torso and leg skeleton segments of the skeleton frame 904 (see FIG. 24).

Figure 34A:
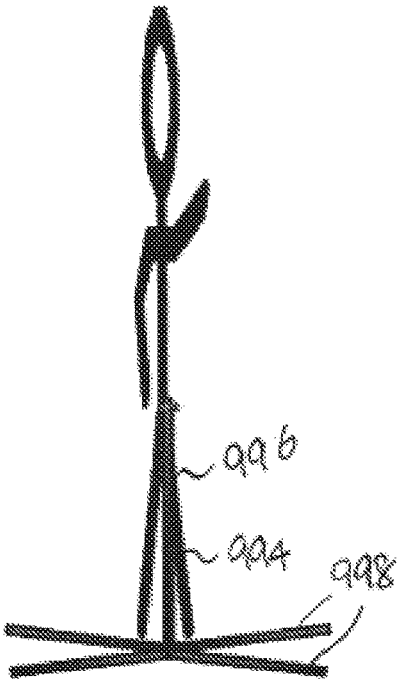
FIGS. 34A, 34B, and 34C illustrate schematically mounting stands used for the information conveying apparatus of FIGS. 24, 29, 30, 31, and 32.
Figure 34B:
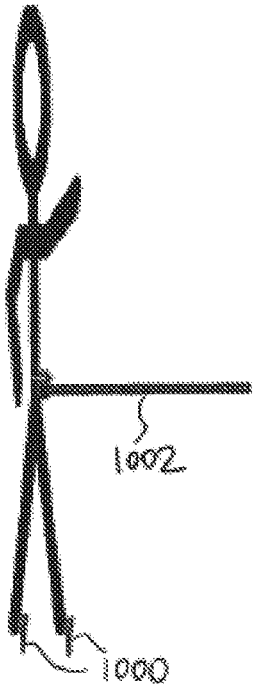
Figure 34C:
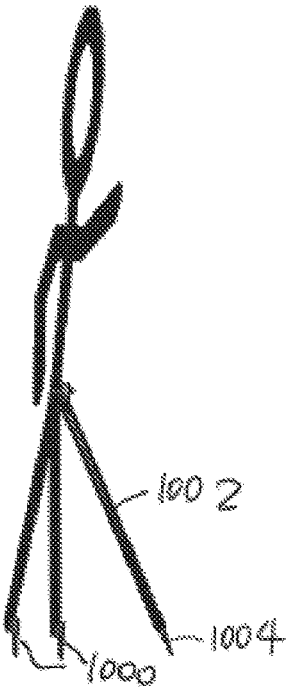

With reference to FIG. 34A, a mounting stand 994 for supporting the stick figure in an upright position may include vertical member 996 with one end joined to the mounting bracket 990, 992 and two horizontal cross members 998 supporting the other end of the vertical member 996. The stick figure structure may be supported off the ground surface. With reference to FIGS. 34B and 34C, the feet of the stick figure structure may be supported by foot stakes 1000, and the torso of the stick figure structure may be supported by a mounting stick 1002 pivotally joined thereto by the mounting bracket 990, 992. The mounting stick 1002 may further include a stake 1004 joined thereto. In another implementation, the vertical upright shaft is extended upward beyond the waist to either neck or head height. This allows for attachment point of the stick figure in two locations (waist and neck) ensuring security and stability. This feature is especially useful for inflatable version without integrated base.

Figure 35:
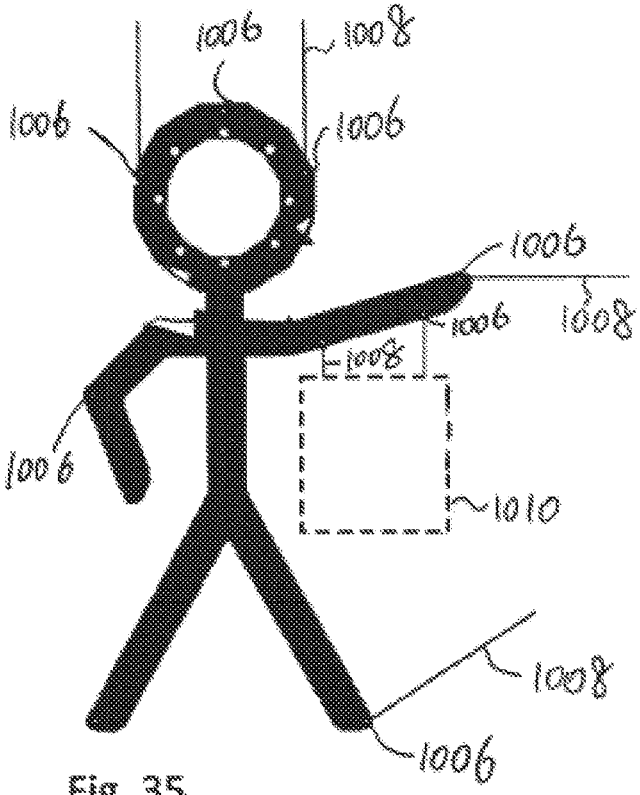
FIG. 35 illustrates schematically a hanging mechanism used for the information conveying apparatus as described herein.

In some implementations, instead of supporting the stick figure on a ground surface, the upright position of the stick figure may be maintained by hanging. With reference to FIG. 35, the stick figure covering may include one or more mounting holes, grommets, snaps, or similar securing elements 1006 arranged near the periphery of the covering material. The securing elements 1006 may be arranged at the upper head, elbow, and arm ends for hanging of the stick figure, or at the feet ends for tying down the stick figure for hanging additional signage using cables, wires, ropes, chains, bands, or any suitable hanging mechanism 1008. In some implementations, the extended arm of the stick figure may include one or more securing elements 1006 arranged near its lower edge portion. Similar hanging mechanisms 1008 may be used for attaching to the extended arm for additional signage 1010.

Figure 36A:
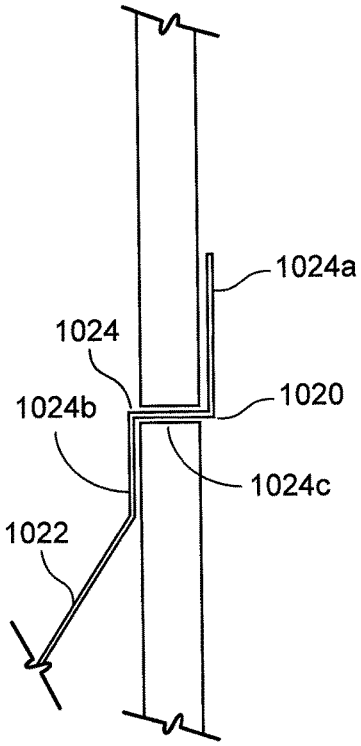
Figures 2, 36A:
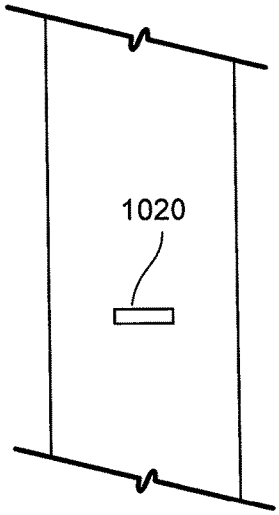
Figures 1, 36A:
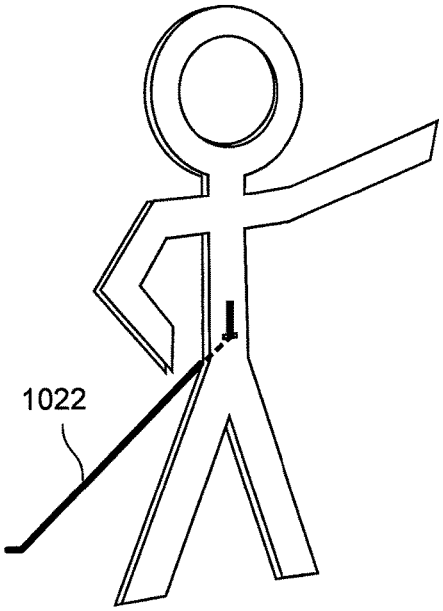
Figure 36B:
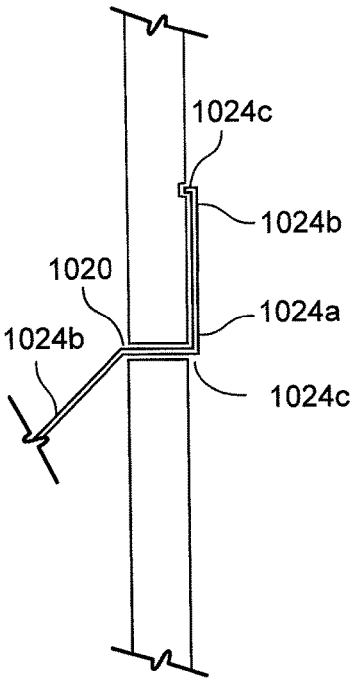
Figure 36C:
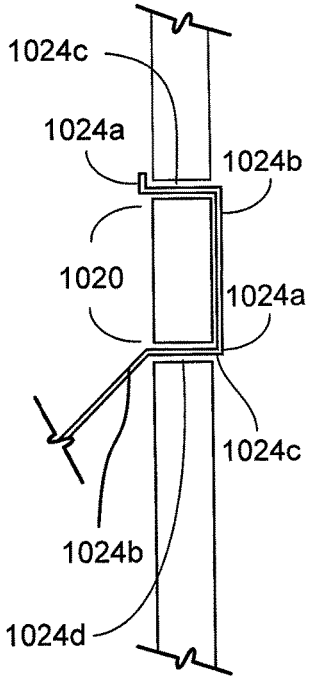

With reference to FIGS. 36A, 36A-1, 36A-2 and 36B, another exemplary ways of supporting the stick figure at its waist will be described. The stick figure structure, according to any example as described herein, may include one or more transverse slots 1020 formed in the torso member near its waist. An elongated stand 1022 for supporting the stick figure structure may include a step member 1024 configured to engage the stick figure structure through the one or more slots 1020. The step member 1024 may include one more steps, each of which may be positioned through one of slots 1020 and engaged thereto. Each step may include an upper portion 1024*a* and a lower portion 1024*b* vertically offset from the upper portion 1024*a* and joined to the upper portion 1024*a* by a horizontal portion 1024*c*. To engage the torso member, the upper portion 1024*a* may be positioned against a portion of the surface of the torso member that is adjacent and above the slot 1020. The lower portion 1024*b* may be positioned against a portion of the opposite surface of the torso member that is adjacent and below the slot 1020. The horizontal portion 1024*c* may be positioned through the slot 1020. The upper and lower portions 1024*a*, 1024*b* may be configured to be parallel to the surface portions of the torso member for close engagement. In some examples, at least the lower portion 1024*c* may be angled away from the surface of the torso member (see FIG. 36C). The step may include an extended horizontal portion 1024*d* for secured engagement.

Figure 39A:
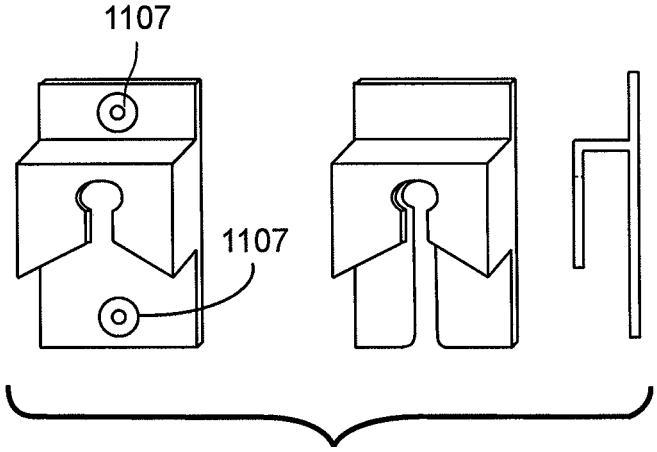
FIGS. 39A-C illustrates various methods of attaching a material to the information conveying apparatus of FIG. 37A.
Figure 39B:
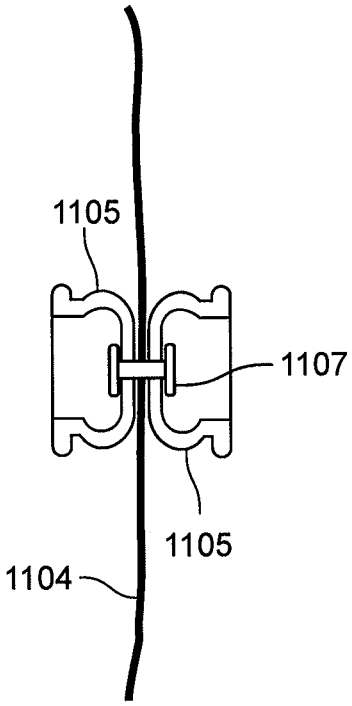
Figure 39C:
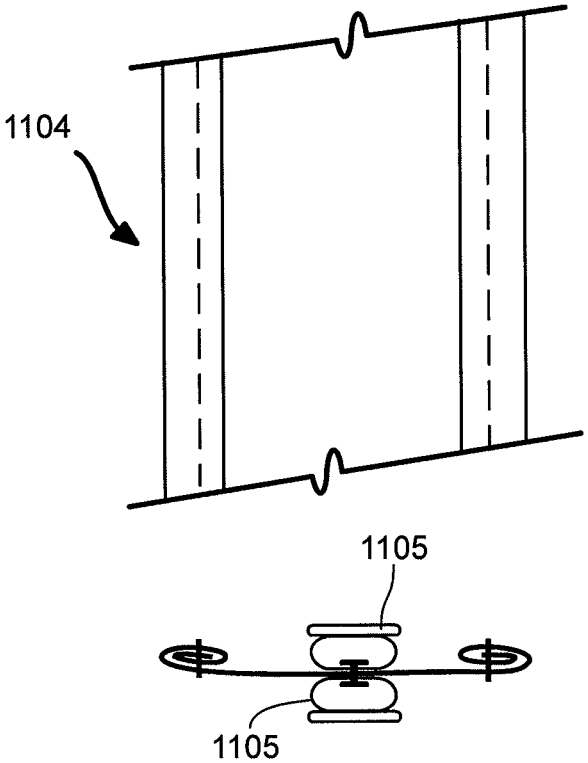
Figure 40A:
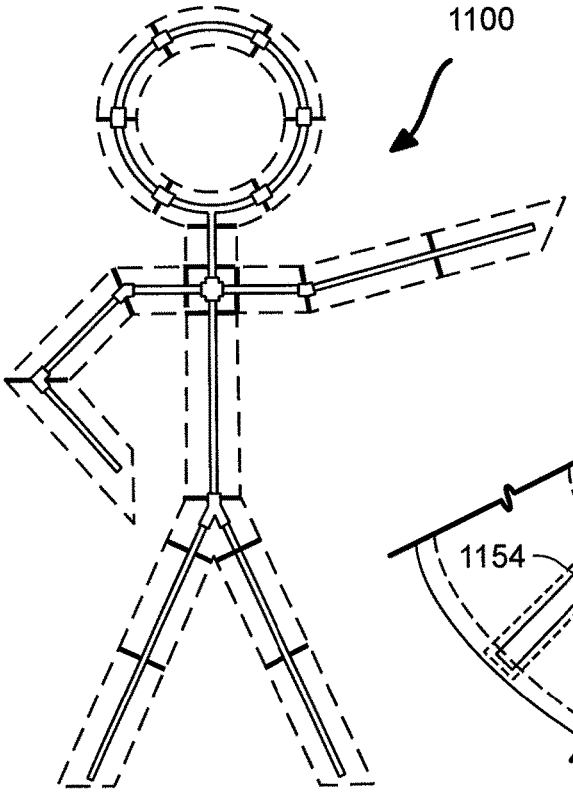
FIGS. 40A-40E illustrates an alternative embodiment of a frame structure of the information conveying apparatus of FIG. 37A.
Figure 40B:
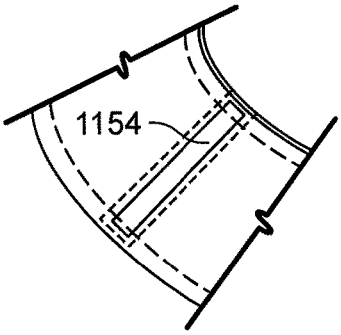
Figure 40B:
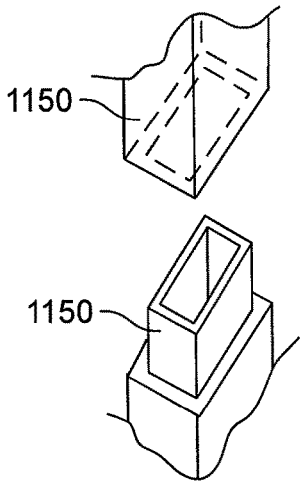
Figure 40C:
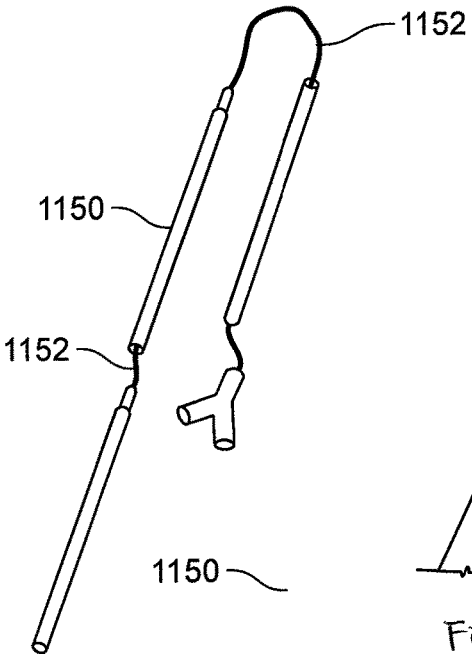
Figure 40D:
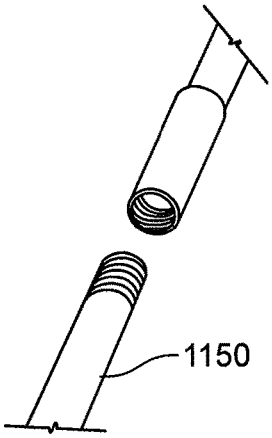
Figure 40E:
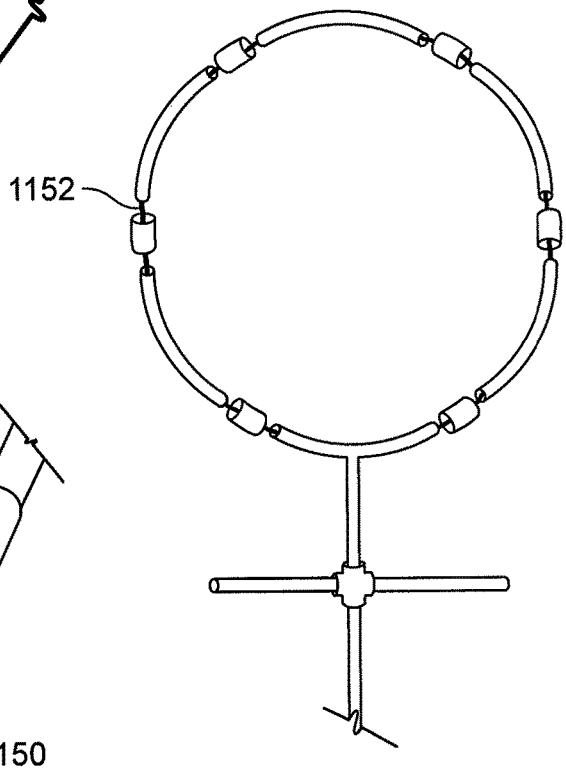

With reference to FIGS. 37A, 37B, 37C, 37D, and 37E, the stick figure structure 1100 may include a frame structure 1102 similar to the skeleton frame 904 described above with reference to FIG. 25. Different from the skeleton frame 904 where each segment may be detachably joined by connectors of particular shapes and orientations, the various segments of the frame structure 1102 may be pivotably joined together using screws, bolts, rivets, and any other suitable connection mechanism in a manner similar to how various members of the stick FIG. 700 may be connected as described above with reference to FIGS. 17A and 17B. A flexible material layer 1104, in a stick figure shape similar to those described above, may be attached to the frame structure 1102 near the chest area of the stick FIG. 1100 or the cross section of the torso segment 1106 and the shoulder segment 1108 of the frame structure 1102 by fasteners, snaps 1105 (see FIGS. 39A and 39C), rivets 1107 (see FIGS. 39A-39B), gluing, adhering, stapling, welding, or any suitable connection mechanism. The flexible layer 1104 may include one layer attached to one side of the frame structure 1102. The flexible layer 1104 may include two layers attached to both sides of the frame structure 1102. The two layers may be releasably attached to each along their edge portions. Generally, the figures depict various embodiments to show how to attach, detach, fold or roll up fabric that attaches to the frame to make the outlining shape as shown by the dotted lines.

Figures 37A, 37B, 37C, 37D, 37E:
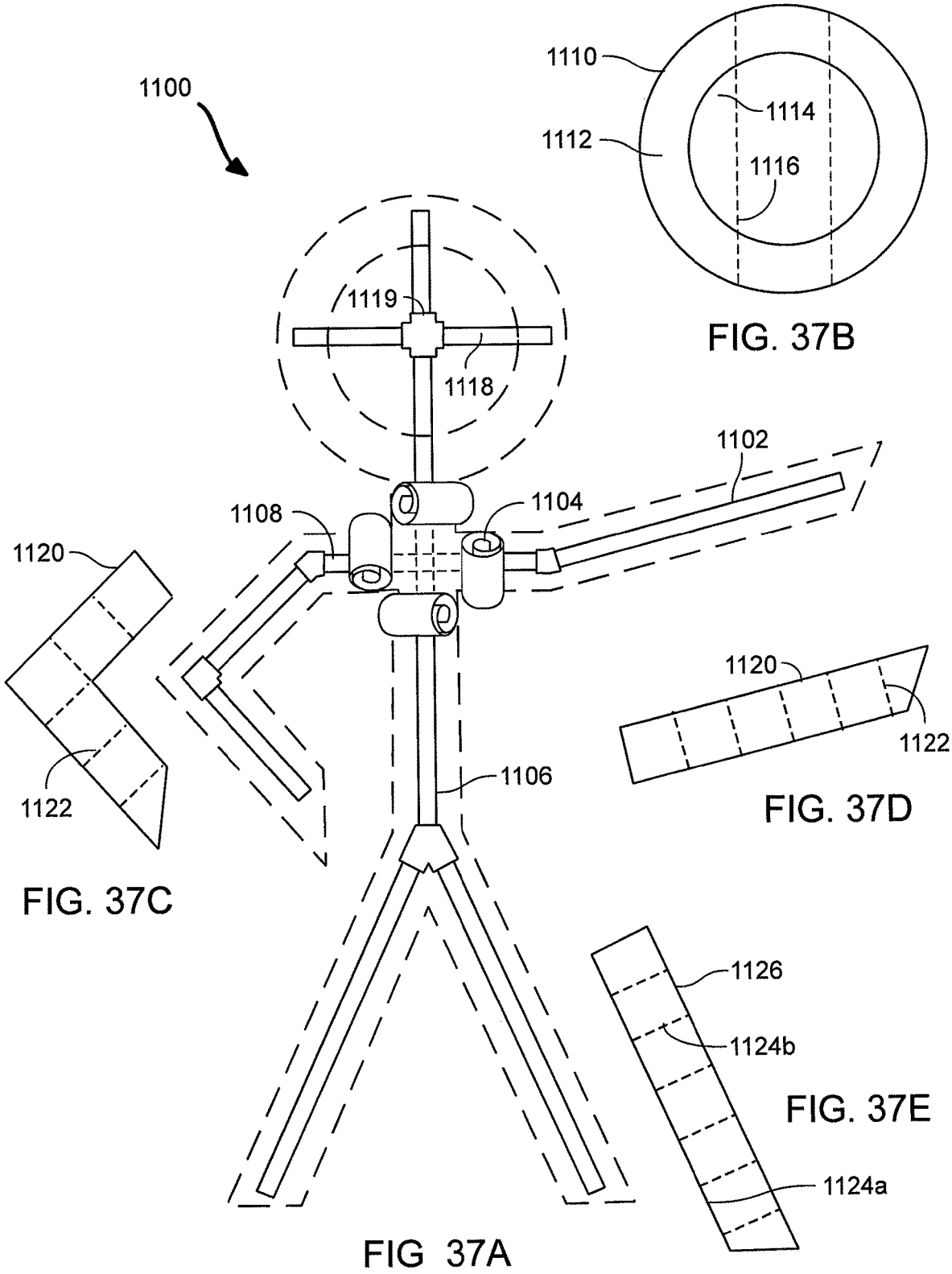
FIGS. 37A, 37B, 37C, 37D, and 37E illustrate another embodiment of an information conveying apparatus.
Figure 38:
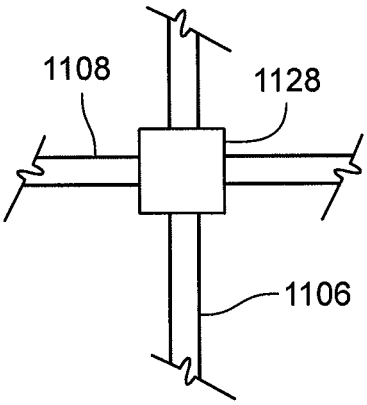
FIG. 38 illustrates a support member for use with the information conveying apparatus of FIG. 37A.

When not in use, the various segments of the frame structure 1102 may be pivoted and folded towards the center or to be aligned with the torso segment 1106 in a manner similar to how the stick FIG. 700 may be folded as described above with reference to FIG. 18A, and the flexible layer 1104 may be rolled up or folded towards the chest area of the stick FIG. 1100 for storage or transportation. With reference to FIG. 37B, the head 1110, defined by a circumferential band 1112 and a center portion 1114 (usually of different colors), may be folded along two or any suitable number of vertical folding lines 1116 towards the extension of the torso segment 1106, and then rolled towards the chest area of the stick FIG. 1100 where the flexible layer 1104 may be joined to the frame structure 1102. The horizontal segment 1118, with which the extension of the torso segment 1106 may define the frame structure of the head area, may be pivoted about the joint 1119 to align with the torso segment 1106. With reference to FIGS. 37C and 37D, the arms 1120 (including the shoulder portions) may be folded from each hand towards the chest by any suitable number of times along the folding lines 1122 cross the arms 1120. With reference to FIG. 37E, one of the two legs 1124*a*, 1124*b* may be first folded over towards the other one of the legs 1124*a*, 1124*b* so that the two legs 1124*a*, 1124*b* may overlap each other. The overlapped legs 1124*a*, 1124*b*, as well as the lower portion of the torso 1126, may then be folded or rolled up towards the chest area. Although it is described herein that the head 1110 and the arms 1120 may be folded first due to enlarged area of the head 1110 or the non-linear extension of the arms 1120, they may simply be rolled up without following particular folding lines. In some implementations, a rigid or semi-rigid plate 1128 may be attached to the cross section of the torso and shoulder segments 1106, 1108 of the frame structure 1102 to provide an enlarged support platform, to which the flexible layer 1104 may be attached (see FIG. 38).

When the flexible layer 1104 is rolled out from the chest area to form the stick FIG. 1100, the head 1110, arms 1120, legs 1124 and torso 1126 may be joined to the adjacent segments of the frame structure 1102 using snaps, rivets, or any suitable connection mechanism.

With reference to FIGS. 40A-40E, the stick figure structure 1100 may include a frame structure 1102 similar to the skeleton frame 904 described above with reference to FIG. 25. Different from the skeleton frame 904 and in contrast to FIG. 37, the structure 1100 is made out of round or square pipe 1150 instead of flat strips. These pipe parts 1150 can be held together much like a camping tent that has a connecting string 1152 so that the parts stay together in order between or from the joints. The pipe 1150 may also include fabric stiffeners 1154 at one or more joints.

Figure 41A:
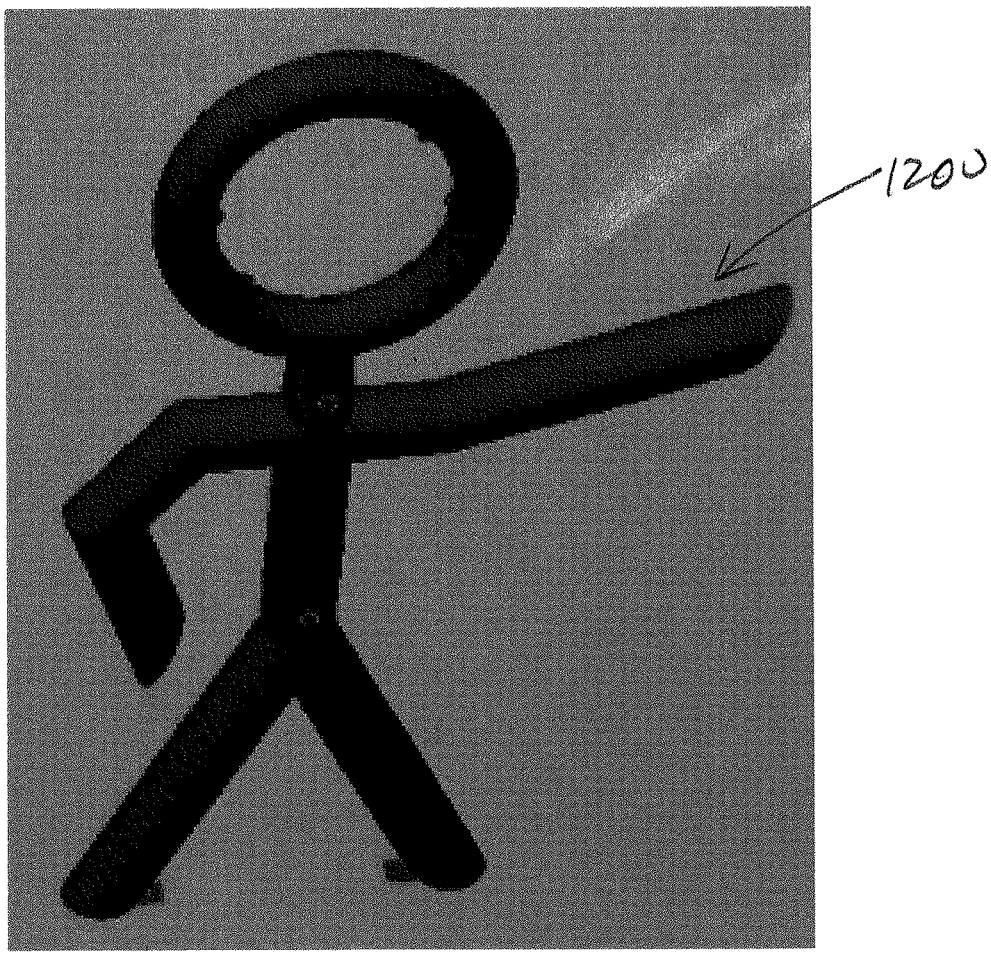
FIGS. 41A and 41B illustrate schematically different views of another embodiment of an information conveying apparatus.
Figure 41B:
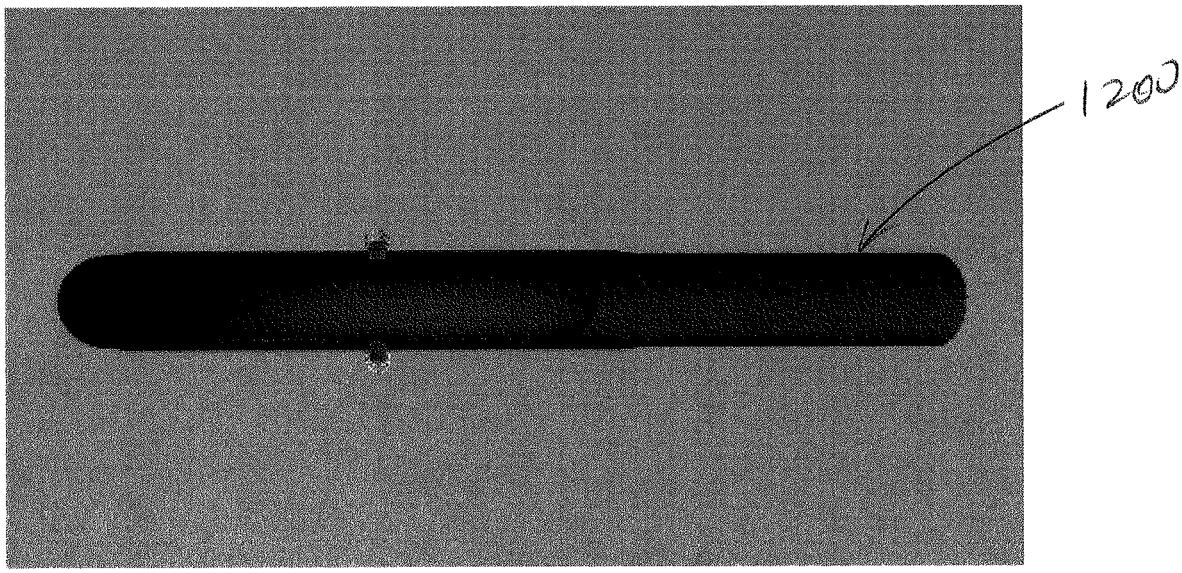

With reference to FIGS. 41A and 41B, another embodiment of the stick figure structure 1200 may be created by using an inflatable body that blows up to form a stick figure shape. Alternatively, the stick figure structure 1200 may be a hollow rigid material like plastic, fiberglass, aluminum, etc. built in clam-shell pieces that are glued, seamed or snapped together.

The inflatable body may include one or more valves, such as a Schrader valve, a Leafield valve, a $CO_2$ valve, and so on, for filling the structure. The inflatable body may also include one or more pressure release valves to prevent over fill. The valves may be positioned on the bottom of the feet or placed high up so that the valves are not easily reached, which may limit, restrict or minimize unauthorized access. The inflatable body may be filled using pumps, blowers, compressors, canisters, cartridges, or other suitable fill mechanisms.

With reference to FIGS. 42A, 42B, 42C, and 42D, the inflatable stick figure structure may be supported by a support base 1202 and secured thereto. The support base 1202 may include a cross connector 1204 joining four elongated support members 1206 forming a cross support base 1202. Two opposing ends 1208 of the support base 1202 may include a first support mechanism 1210 for supporting and joining to the torso of the stick figure structure 1200 at the waist location. The first support mechanism 1210 may include a strap or a wire 1212, one end of which is joined to one of the opposing ends 1208 and the other end of which may include a buckle or a clip 1214. The buckle or the clip 1214 may be joined to a mating buckle or a D ring 1216 configured at the waist of the stick figure structure 1200. The strap or the wire 1210 may be elastic and/or may include a length dimension to remain taut when connected to the stick figure structure 1200. The other two opposing ends 1218 of the support base 1202 may be spaced apart at a distance corresponding to the distance between the feet of the stick figure structure 1200 and may include a second support mechanism 1220 for supporting and joining to the feet of the stick figure structure 1200. The second support mechanism 1220 may include friction pads, which may create sufficient friction to limit or prevent the feet member from movement. Alternatively, the stick figure structure 1200 may be configured with a foot strap at the distal end of each leg member. The foot strap may include an eyelet for passing therethrough a connection mechanism for securing the leg members to the support base 1202. Other suitable support elements may be contemplated for the first and/or second support mechanisms 1210, 1220. One or more of the opposing ends 1208 of the support base 1202 may include pivotable tails 1222 (see FIG. 42D) that may extend perpendicular to the elongated cross members 1206 and provide side to side stability to the support base 1202.

Figure 42A:
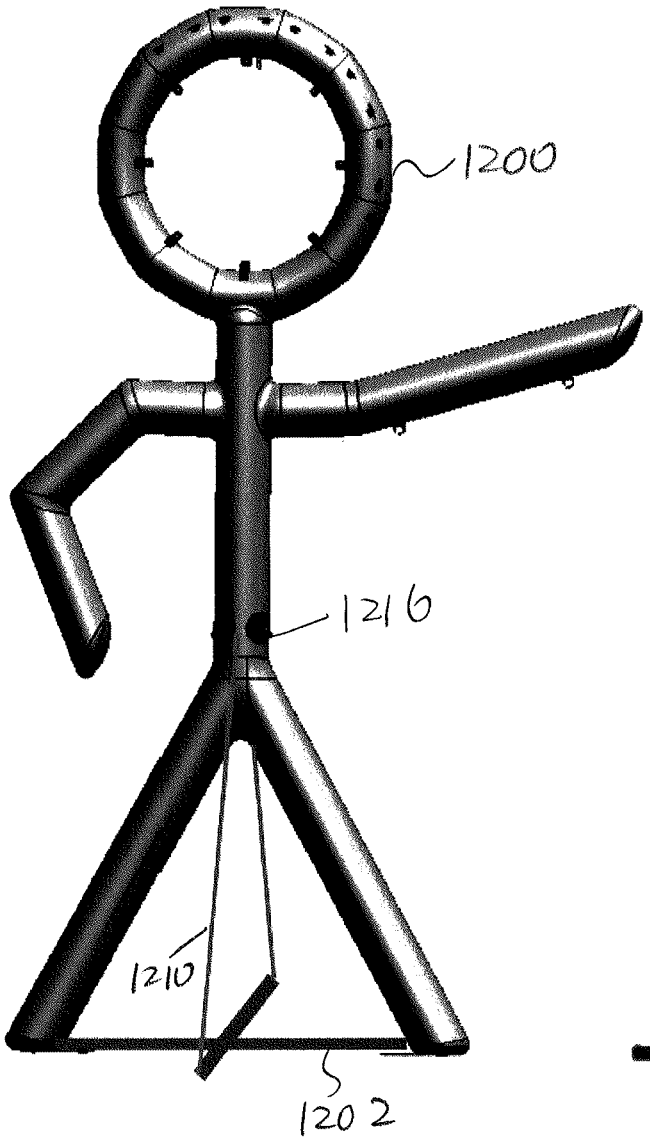
FIGS. 42A, 42B, 42C, and 42D illustrate schematically a support base used for the information conveying apparatus of FIG. 41A.
Figure 42B:
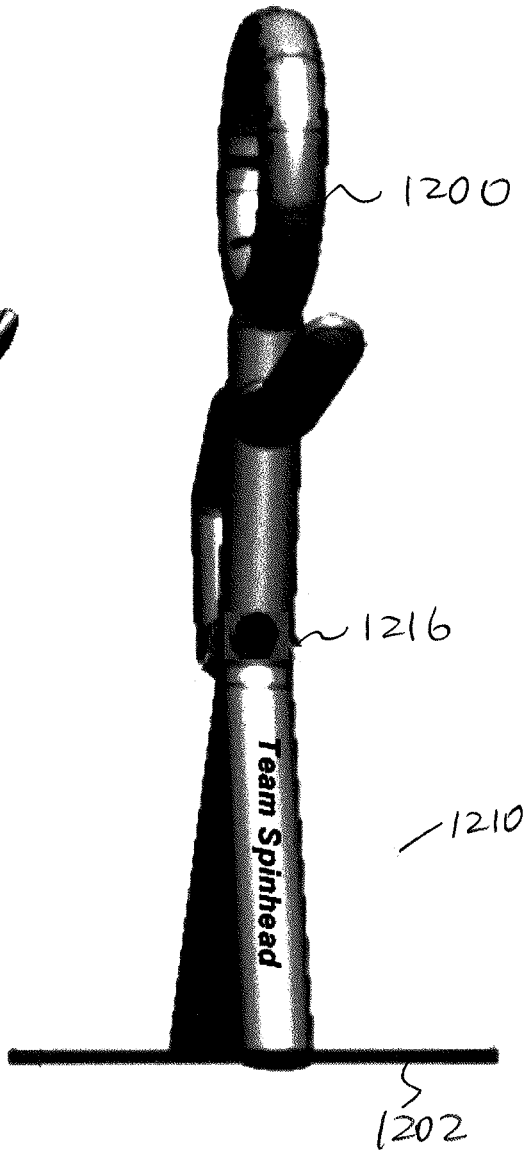
Figure 42C:
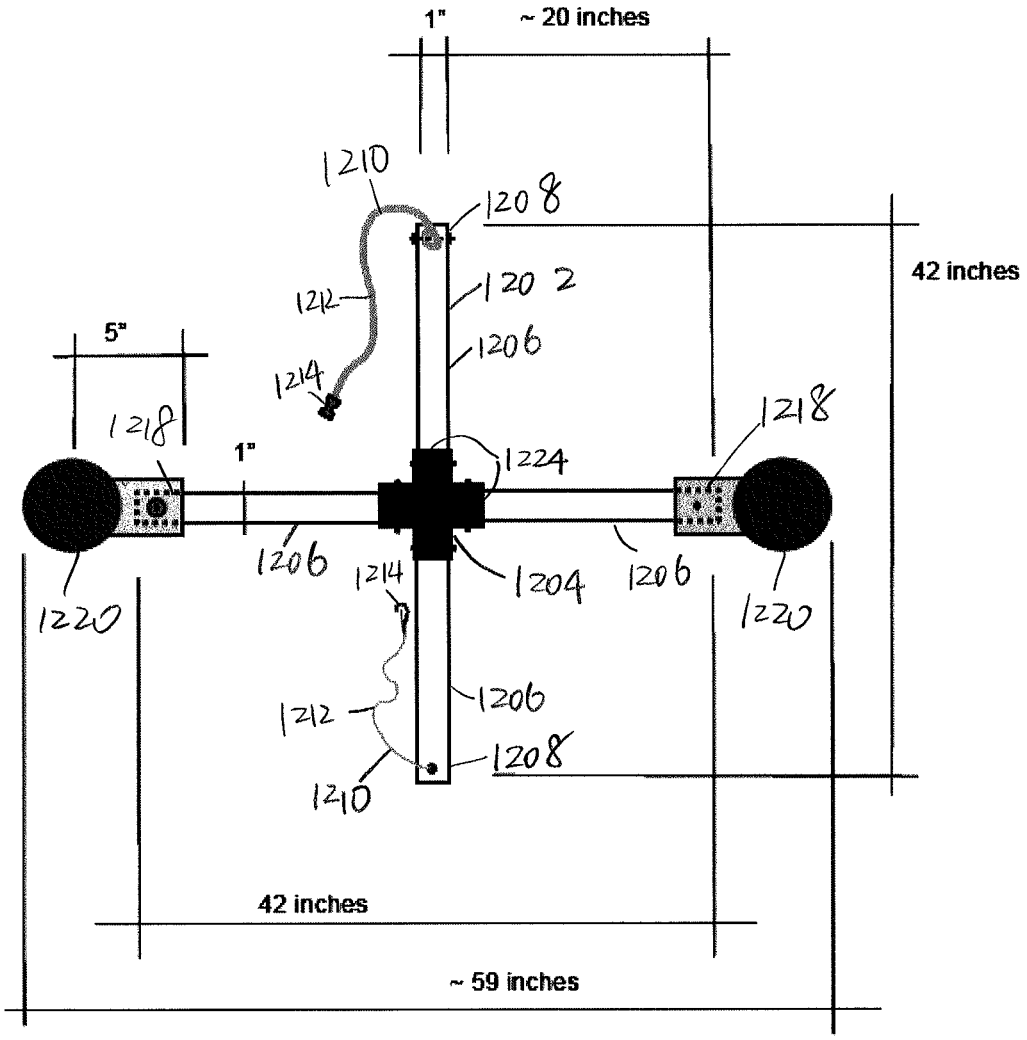
Figure 42D:
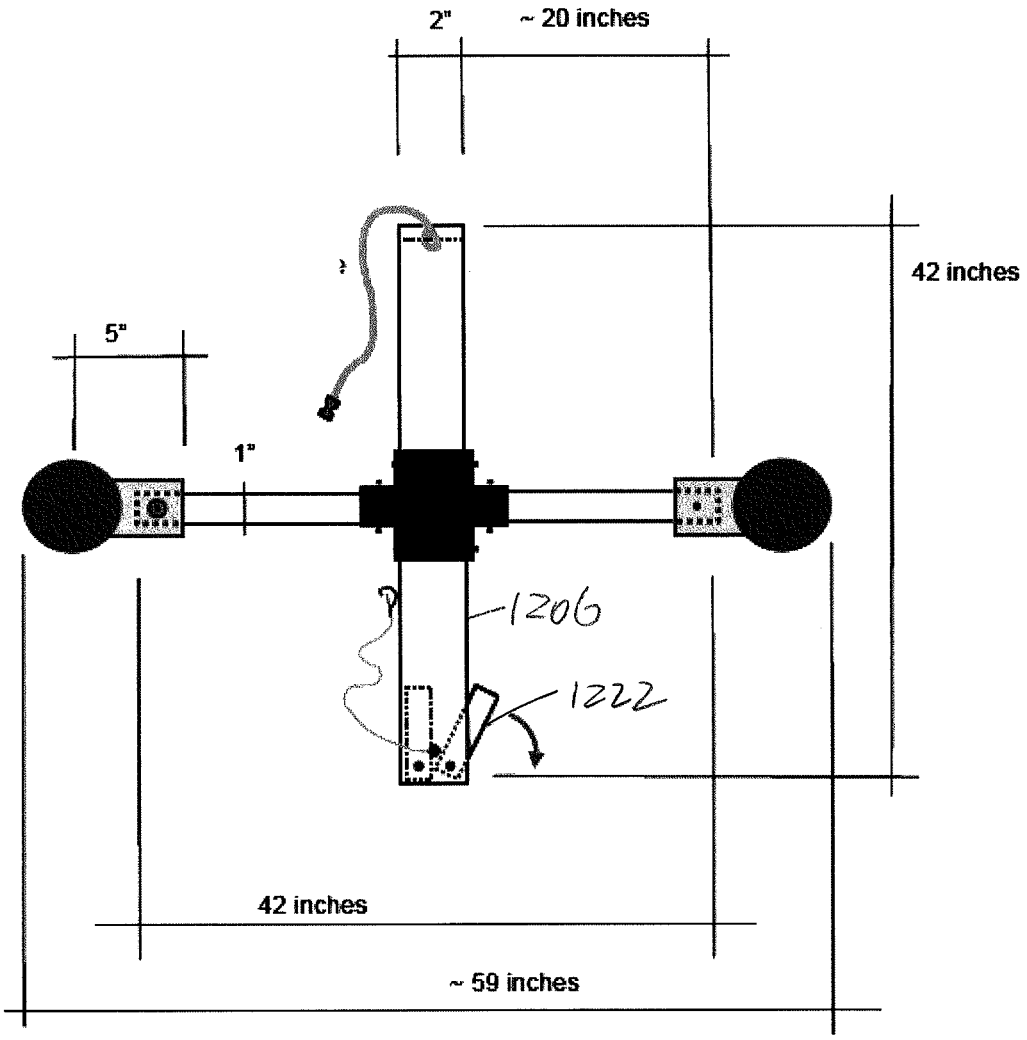

In continuing reference to FIG. 42C, the cross connector 1204 may include channels that may define openings or receptacles 1224 each configured to received therein an end portion of one of the four elongated support members 1206. The channels and/or the receptacles 1224 may include a square, rectangular, circular, triangular, or any suitably-shaped cross section. The end portions of the elongated support members 1206 may be slid into the receptacles 1224 and secured thereto by friction, glue, adhesive, welding, screw, rivets, or any suitable connection mechanism. When not in use, the elongated support member 1206 may be removed out of the receptacles 1224 of the connector 1204 and stored.

With reference to FIGS. 43A, 43B, 43C, 43D, and 43E, in some examples, the channels or at least the receptacles 1224 of the cross connector 1204 may include inverted U-shaped cross sections. Each of the elongated support members 1206 may be pivotably joined to the cross connector 1204 by a pivotal pin 1226. Each of the receptacles 1224 of the connector 1204 may further include one or more apertures 1228 formed on either side of the U shape. The end portion of the elongated support member 1206 may be formed with at least one aperture that may be aligned with one of the apertures 1228 formed at the cross connector 1204. A locking pin may be positioned through the aligned apertures. By selectively aligning the apertures formed in the connector 1204 and the elongated support member 1206 and locking the two with locking pins, the support base 1202 may be maintained in an opened position (FIG. 43A) or a folded position (FIG. 43B). With reference to FIG. 43C, each receptacle 1224 of the connector 1204 may include only one set of apertures 1228 configured for locking the support base 1202 in the opened position. With reference to FIGS. 43D and 43E, folding base 1202 includes preset notches used to lock in storage or transport positions. When releasing the notch by pin (see FIG. 43C), tab (see FIG. 43D) or slide (see FIG. 43E), the leg is able to swing freely between notches.

Figure 44A:
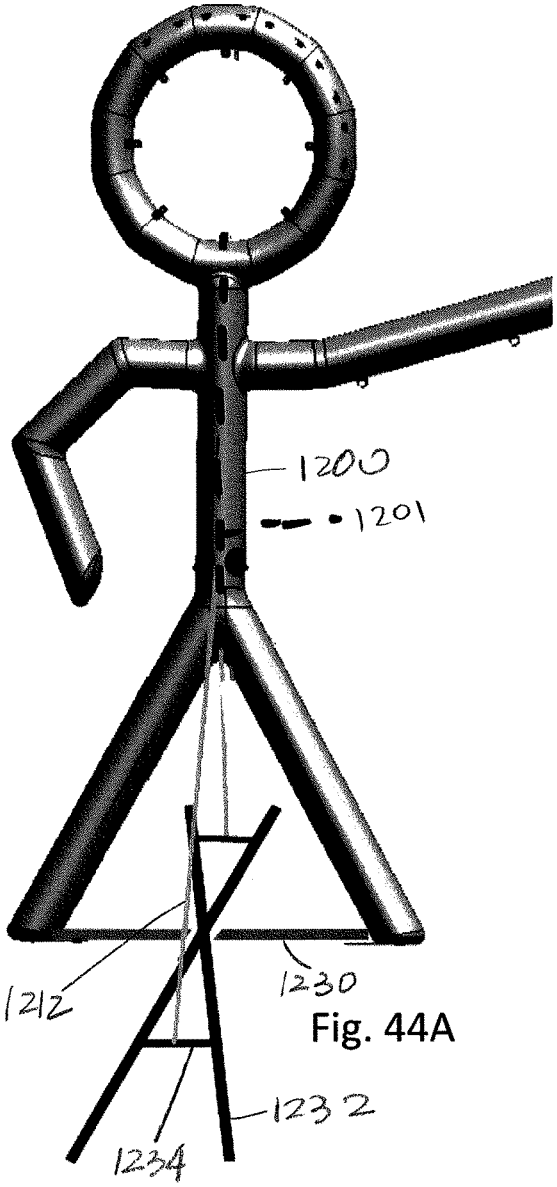
FIGS. 44A, 44B, and 44C illustrate schematically yet another support base used for the information conveying apparatus of FIG. 41A.
Figure 44B:
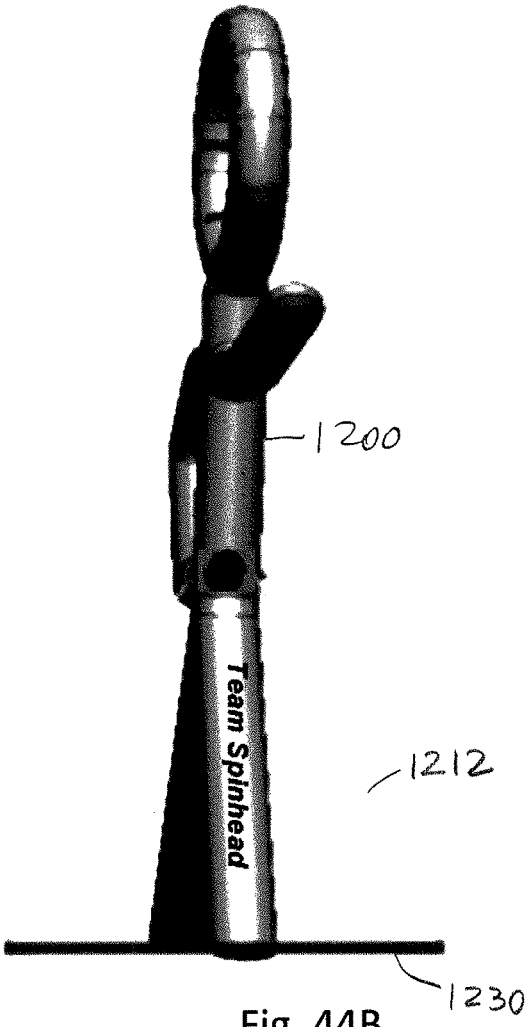
Figure 44C:
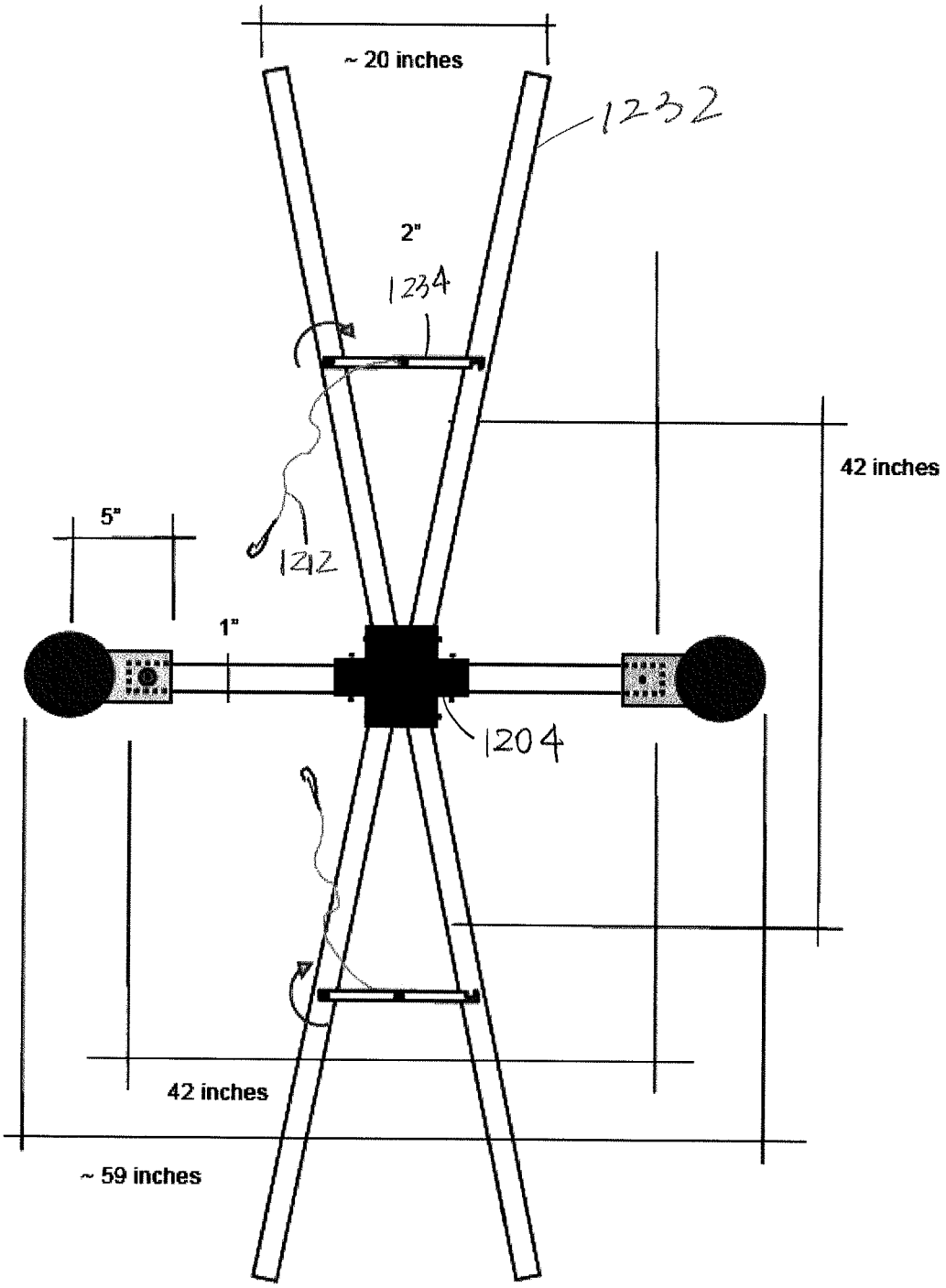

With reference to FIGS. 44A, 44B, and 44C, a different support base 1230 may be provided. Each of the support members 1206 that may connect to the waist of the stick figure structure 1200 by a wire or strap 1212 in FIG. 42C may be replaced by an A-shaped support structure. The A-shaped support structure may include two elongated support members 1232 connected to the central connector 1204 and one cross member 1234 joining the middle portions of the two elongated support members 1232. The strap or wire 1212 for connecting to the waist of the stick figure structure 1200 may be joined to the middle portion of the cross member 1234. In another implementation, the strap or wire 1201 may extend upward to attach at the neck by passing the vertical rod of the base structure through an attached ring structure, e.g., D-shape, square or round. The ring structure is preferably metal so that the attachment is stronger.

Figure 45A:
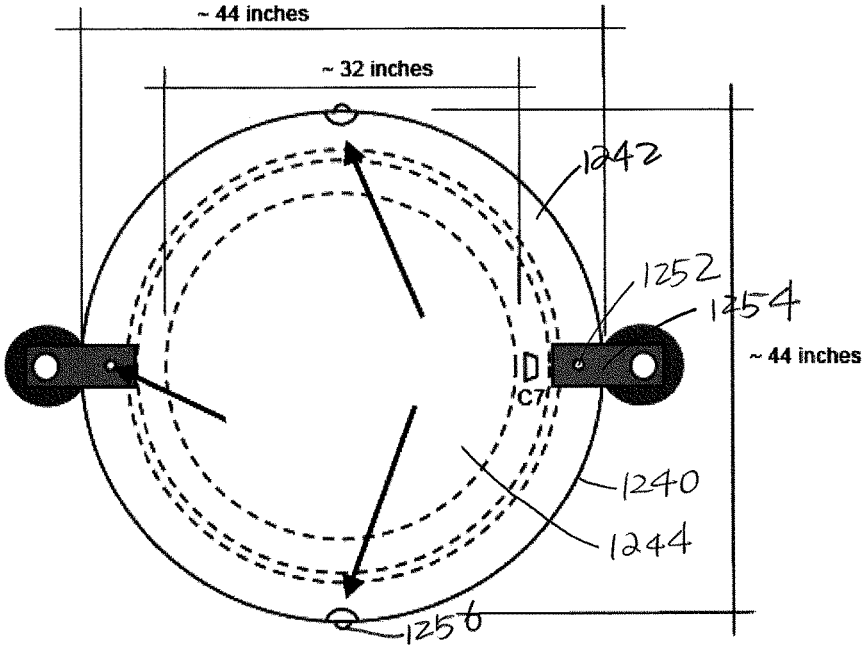
FIGS. 45A, 45B, 46A, 46B, 47A, 47B, 48A, 48B, and 49 illustrate schematically embodiments of various inflatable support base used for the information conveying apparatus of FIG. 41A.
Figure 45B:
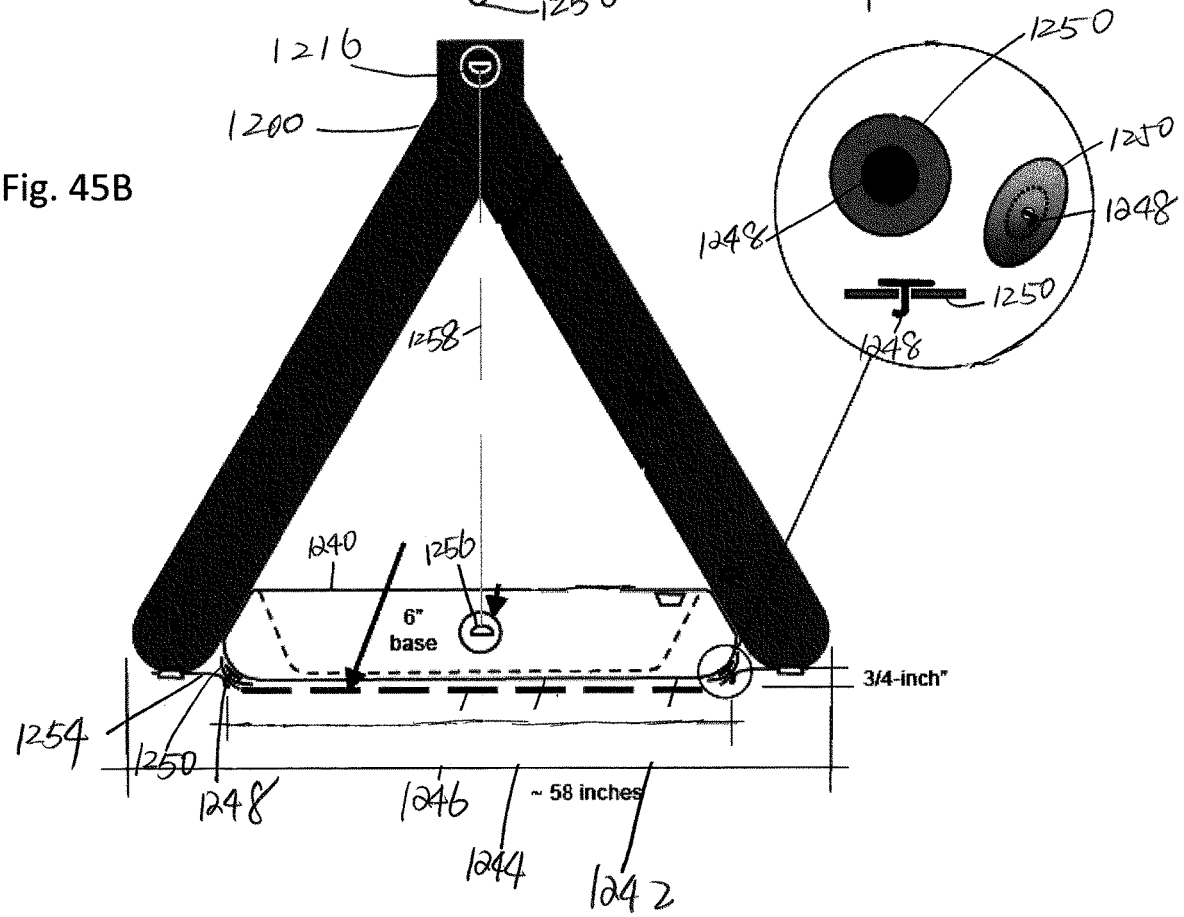

With reference to FIGS. 45A and 45B, the stick figure structure 1200 may be supported by an inflatable support base 1240. The inflatable support base 1240 may include an inflatable peripheral member 1242 defining a circle and a non-inflatable flat member 1244 disposed within the peripheral member 1242 and joined thereto. The inflatable peripheral member 1242 may include a round, triangular, square, rectangular, trapezoidal, or any suitably shaped cross section. The bottom side of the peripheral member 1242 and the bottom side of the flat member 1244 may collectively define the bottom surface of the support base 1240. The bottom surface of the support base 1240 may be formed of nylon material and may include a thick urethane epoxy coating 1246 for durability against abrasions, wear, and tear.

The support base 1240 may include two connection members 1248 positioned at two opposing portions of the inflatable peripheral member 1242 near the bottom thereof. The connection members 1248 may be joined to the inflatable peripheral member 1242 by connection patches 1250. Each of the connection members 1248 may be configured with a hook or a peg (see FIG. 46A) for passing through an eyelet 1252 in the foot strap 1254 for securing the leg members of the stick figure structure 1200 to the support base 1240. The size of the inflatable support base 1240 and the placement of hook members 1248 may be configured for a tight fit between the base 1240 and the leg members of the stick FIG. 1200. The support base 1240 may further include two opposing ring members 1256, such as D rings, positioned at two opposing peripheral portions of the inflatable peripheral member 1242 in between the connection members 1248. Each of the ring members 1256 may be joined to one end of a string or cable 1258. The other end of the string or cable 1258 may be releasably joined to a D ring configured at the waist of the stick FIG. 1200 using a clip or any other suitable mechanism.

Figure 46A:
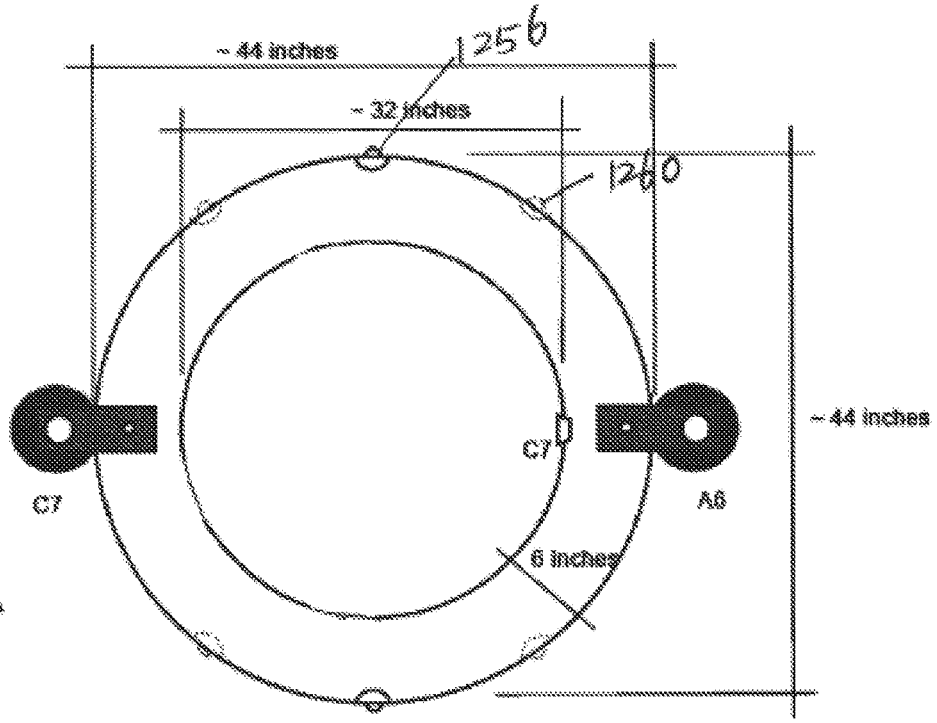
Figure 46B:
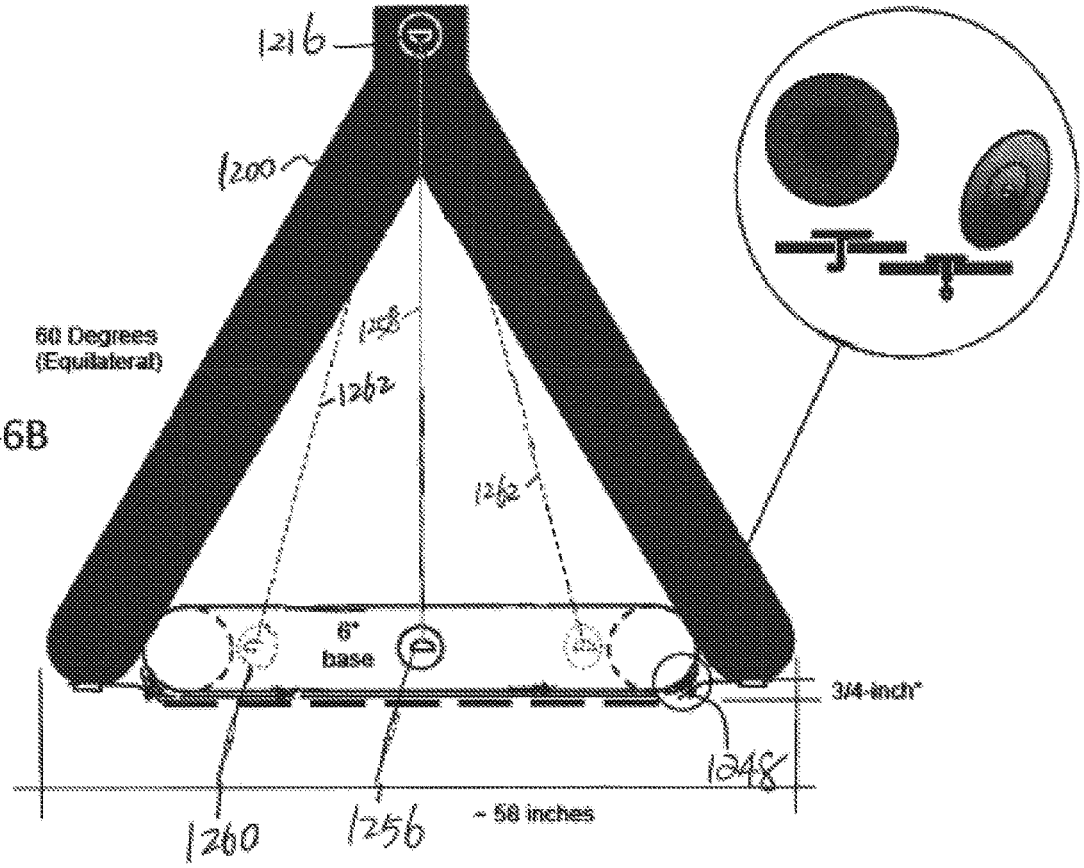

Weight may be added to the support base 1240 by filling the inflatable member with sand or water so as to hold the support base 1240 in place. Sand, water, or other weight elements may also be placed on top of the center flat member 1244. With reference to FIGS. 46A and 46B, to provide additional stability to the stick figure structure 1200, another four ring members 1260 may be arranged around the periphery of the inflatable base 1240. The six ring members 1256, 1260 and the two connection members 1248 may be spaced apart at 45 degree angular intervals. Three adjacent ring members 1256, 1260 may connect to a common D ring 1216 configured at the waist of the stick figure structure 1200 by three cables or wires 1258, 1262. The other three adjacent ring members 1256, 1260 may connect to another common D ring 1216 configured on the opposite side of the waist of the stick figure structure 1200.

Figure 47A:
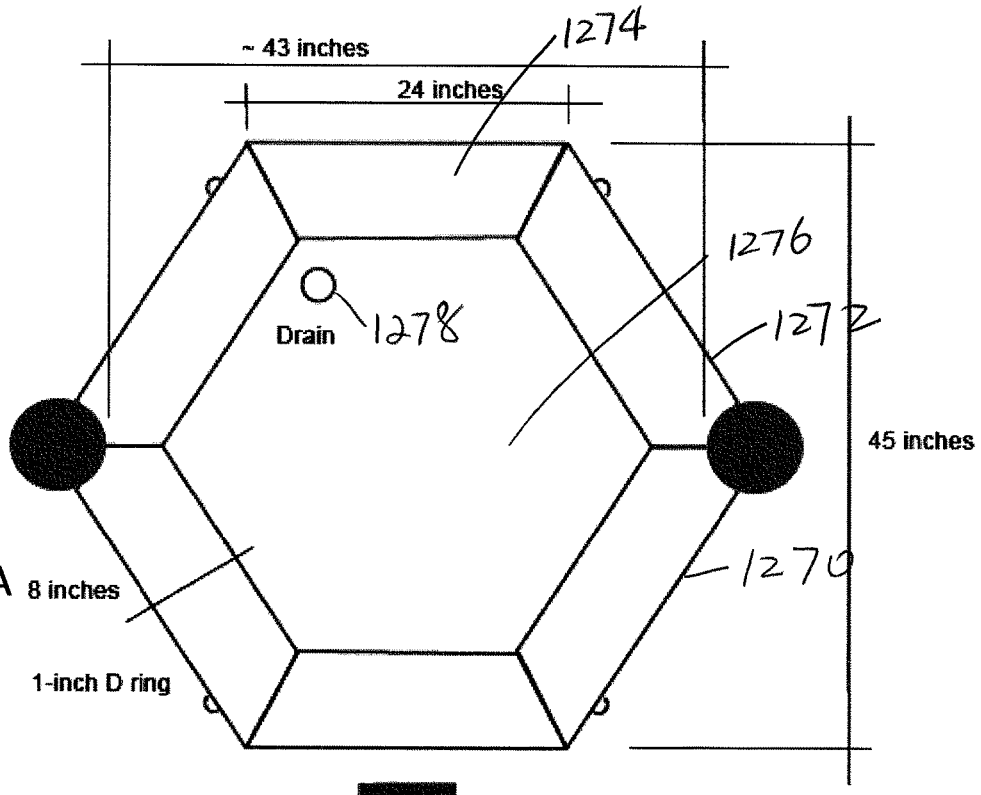
Figure 47B:
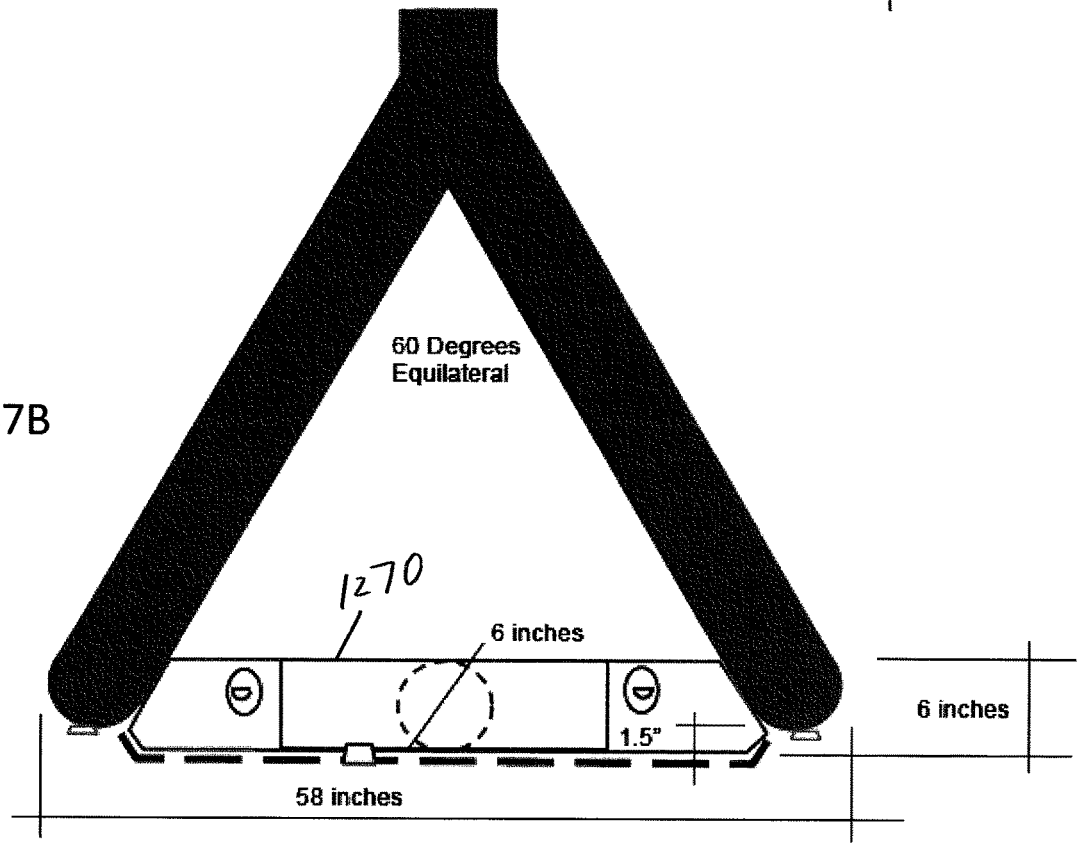
Figure 48A:
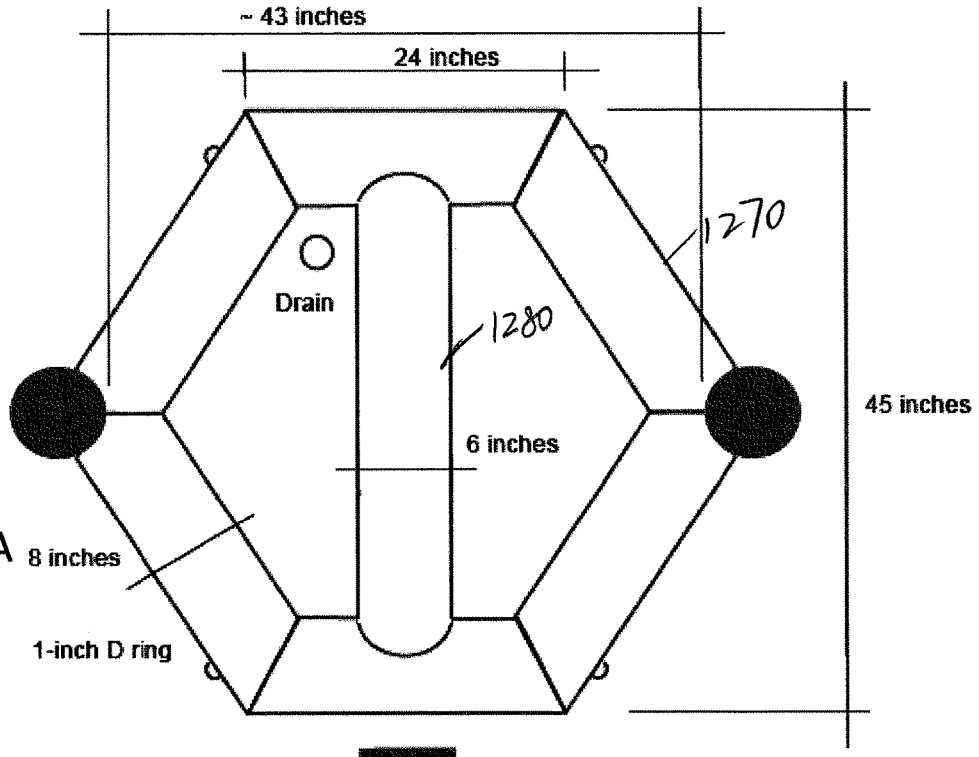
Figure 48B:
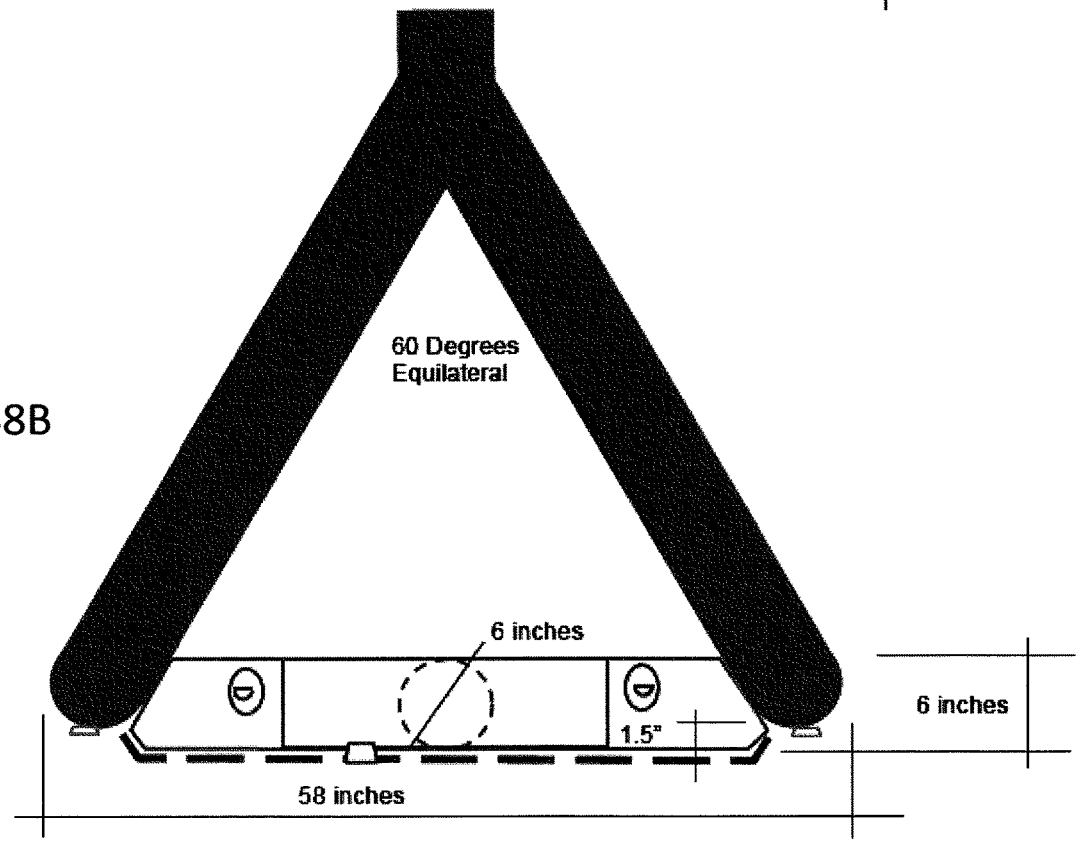
Figure 49:
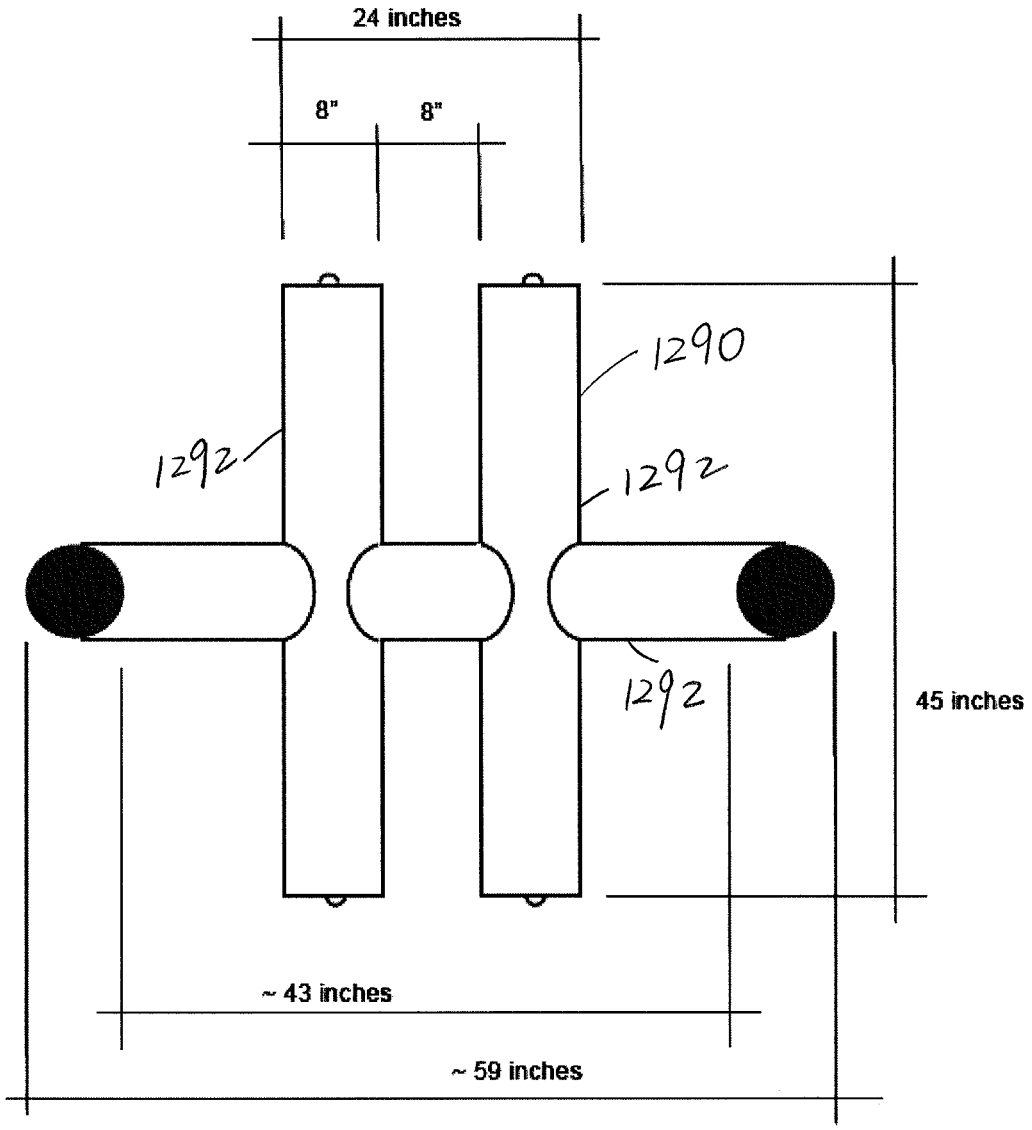

With reference to FIGS. 47A and 47B, another inflatable support base 1270 may include an inflatable peripheral member 1272 formed by inflatable segments 1274 and a center non-inflatable flat member 1276 disposed within the peripheral member 1272 and joined thereto. The inflatable segments 1274 may be in fluid communication with each other or may be segregated from each other. The flat member 1276 may be configured with a drain hole 1278. With reference to FIGS. 48A and 48B, the inflatable support base 1270 may include a center inflatable segment 1280 crossing the support base 1270 and joining two opposing inflatable segments 1274 for added strength. With reference to FIG. 49, the inflatable support base 1290 may not include a peripheral member, rather segments of inflatable members 1292 may be arranged in a cross manner to form the support base 1290.

Figure 50A:
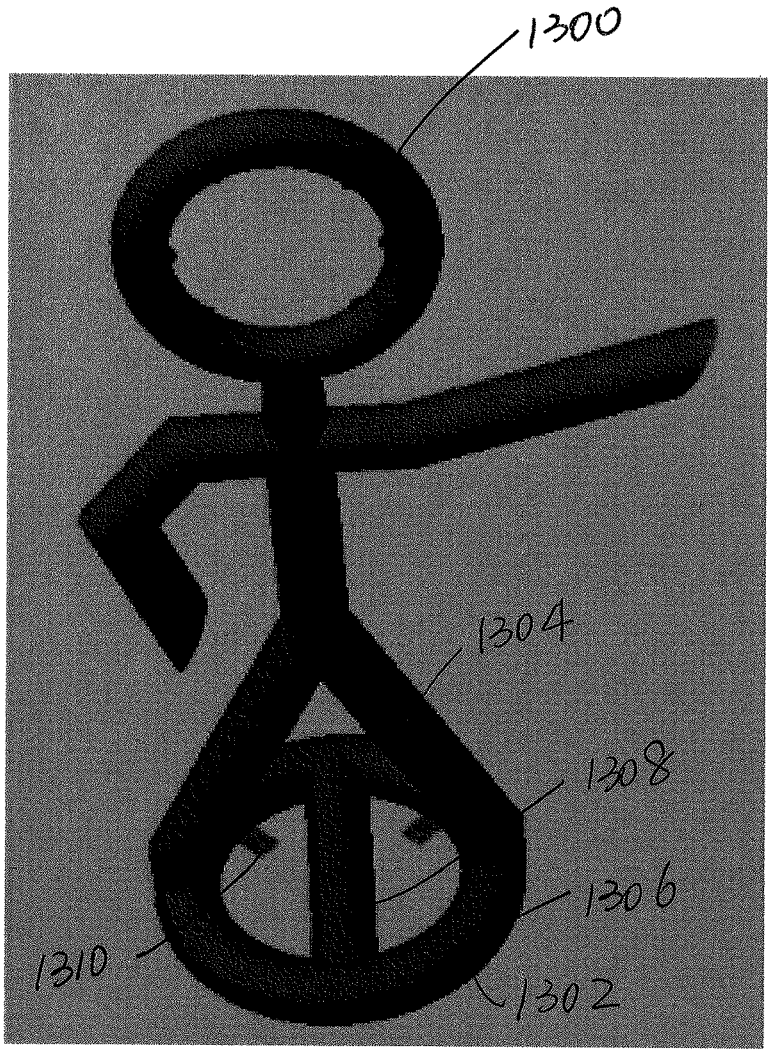
FIGS. 50A and 50B illustrate schematically different views of yet another embodiment of an information conveying apparatus.
Figure 50B:
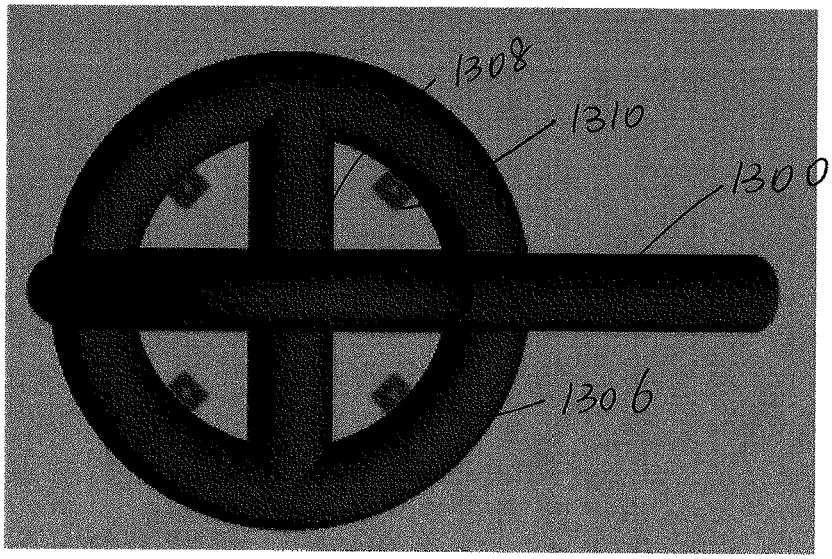

With reference to FIGS. 50A and 50B, the inflatable stick figure structure 1300 may include an integrated, integral or monolithically formed inflatable support base 1302 connected to the leg members 1304. The integrated inflatable support base 1302 and the stick figure structure 1300 may or may not be in fluid communication with each other. The inflatable support base 1302 may include a round tubular member 1306 with a diameter corresponding to the span of the leg members 1304 of the stick figure structure 1300. The support base 1302 may further include a straight segment of a tubular member 1308 across the diameter of the round member 1306 and oriented perpendicular to the span of the leg members 1304 of the stick figure structure 1300. The support base 1302 may further include one or more tie-down tabs 1310 arranged along the inner periphery of the round inflatable member 1306.

Figure 51A:
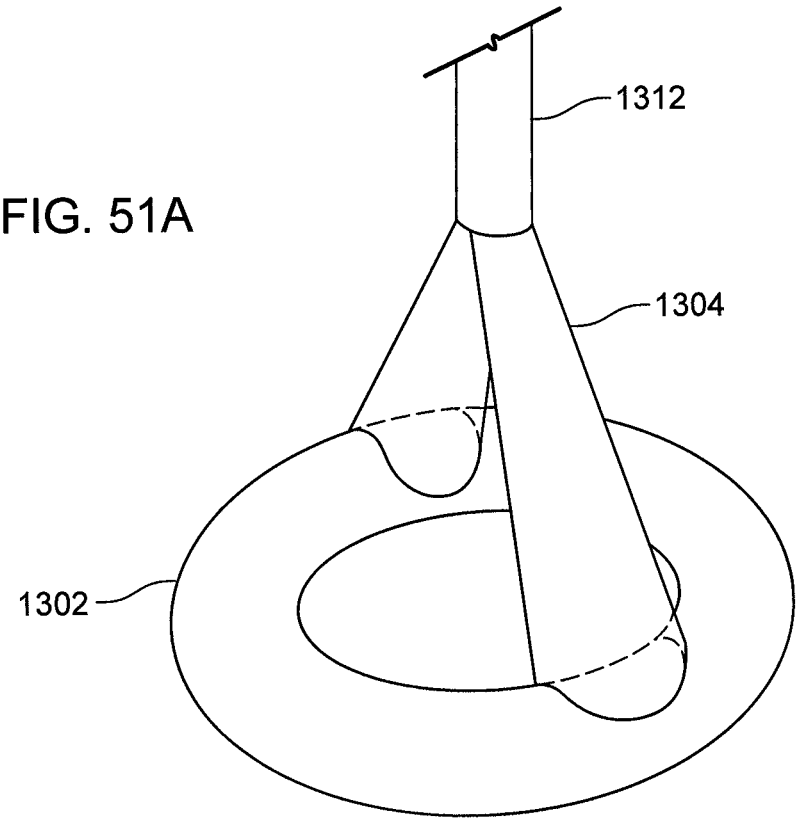
Figure 51B:
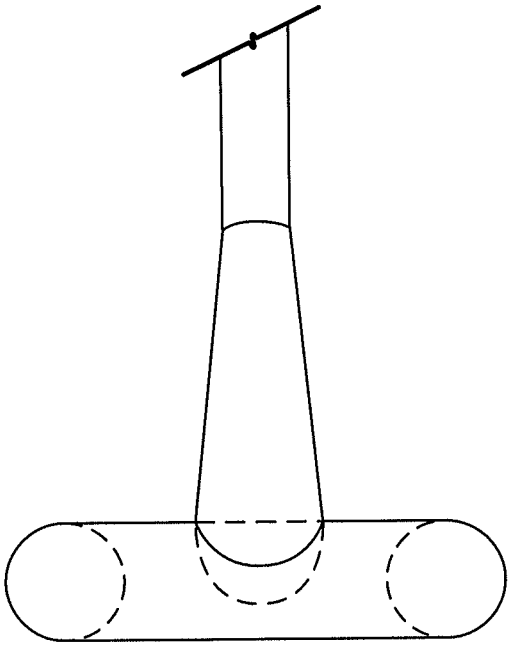
Figure 51C:
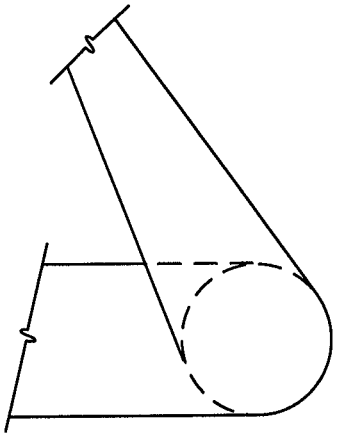

With reference to FIGS. 51A, 51B, and 51C, the stick figure structure 1300 may include tapered leg members 1304 monolithically formed or integrated or integral with the support base 1302. The leg members 1304 may or may not be fluid communication with the support base 1302. The leg members 1304 may include gradually increased diameter from the end joined to the torso member 1312 to the distal end joined to the support base 1302. The greater diameter of the leg members 1304 near the support base 1302 may create a greater connection line or connection area between the leg members 1304 and the support base 1302. In some embodiments, support base 1302 may be a solid seamed base or a solid seamed base may be added to support base 1302 such that the base could be filled with water, sand, dirt, rock, etc. as a stabilizing element for maintaining upright positioning.

Advantageously, the "bell bottom" or oval shaped foot attachments (as opposed to round cross section typically of same diameter across its length) provide an added attachment area and the shape serves like an integrated buttress support to minimize or eliminate the bending of the vertical upright at the attachment point. Generally, this design feature provides a means to stabilize the back and forth movement of the upright. Added strength is provided by air pressure.

Figure 52A:
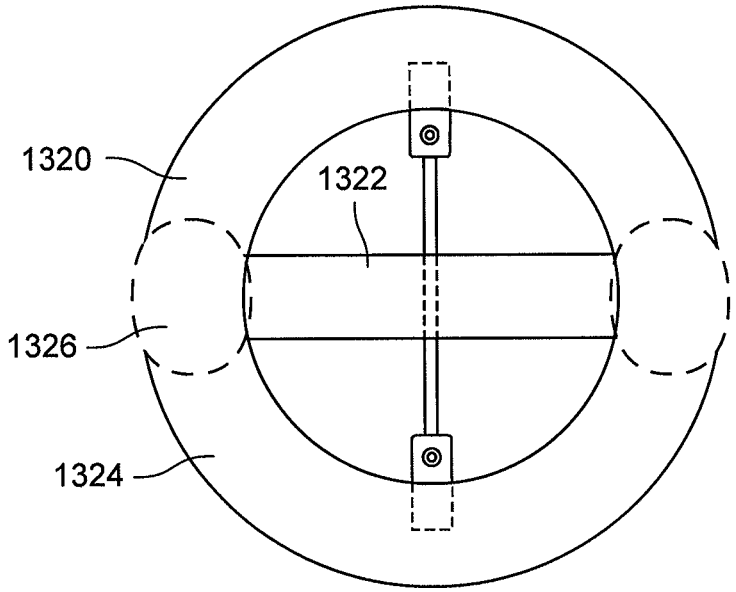
Figure 52B:
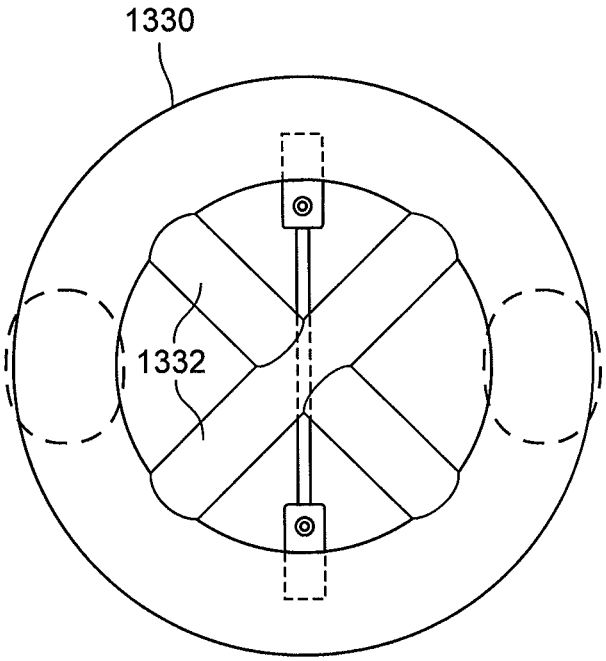
Figures 1, 52B:
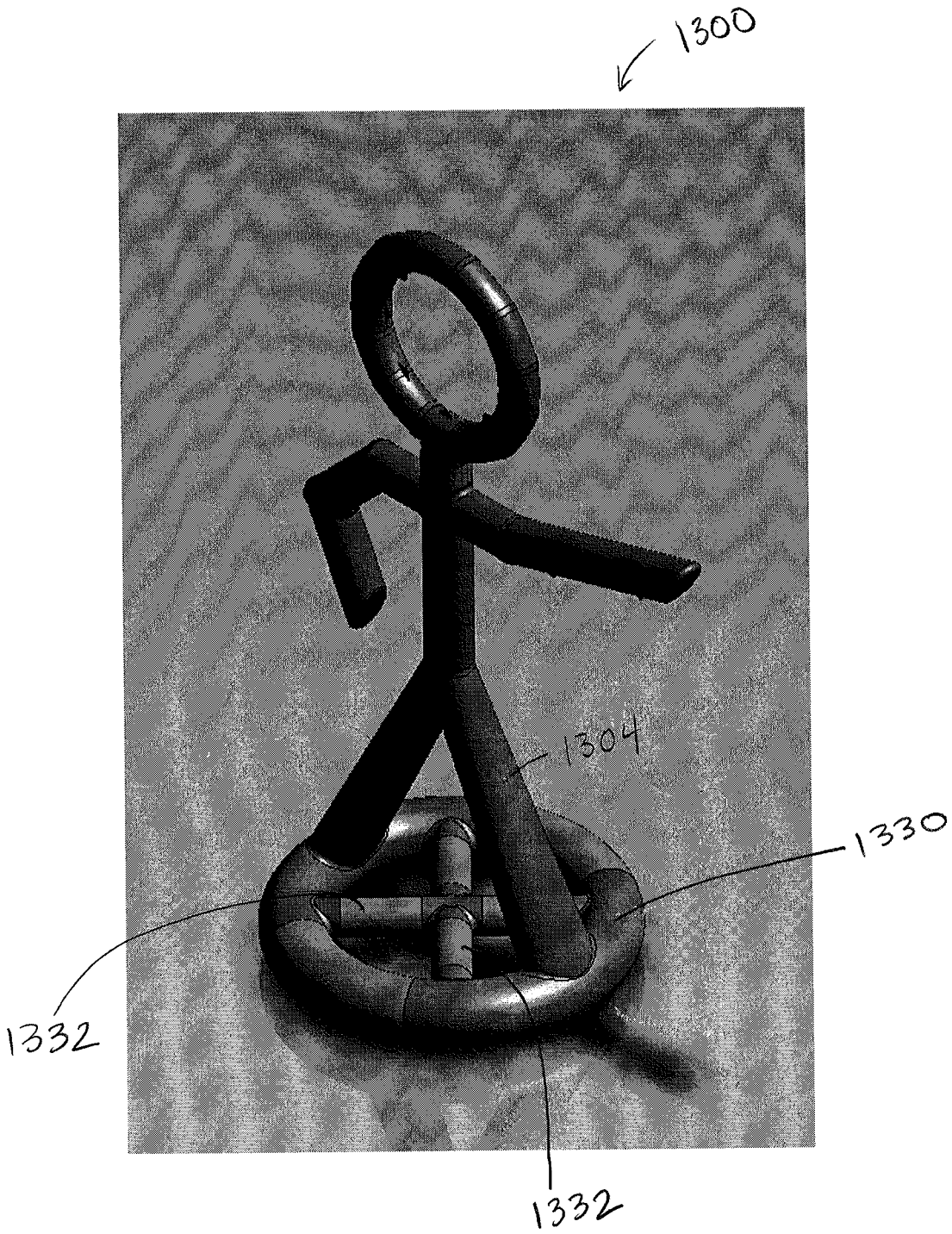
Figures 2, 52B:
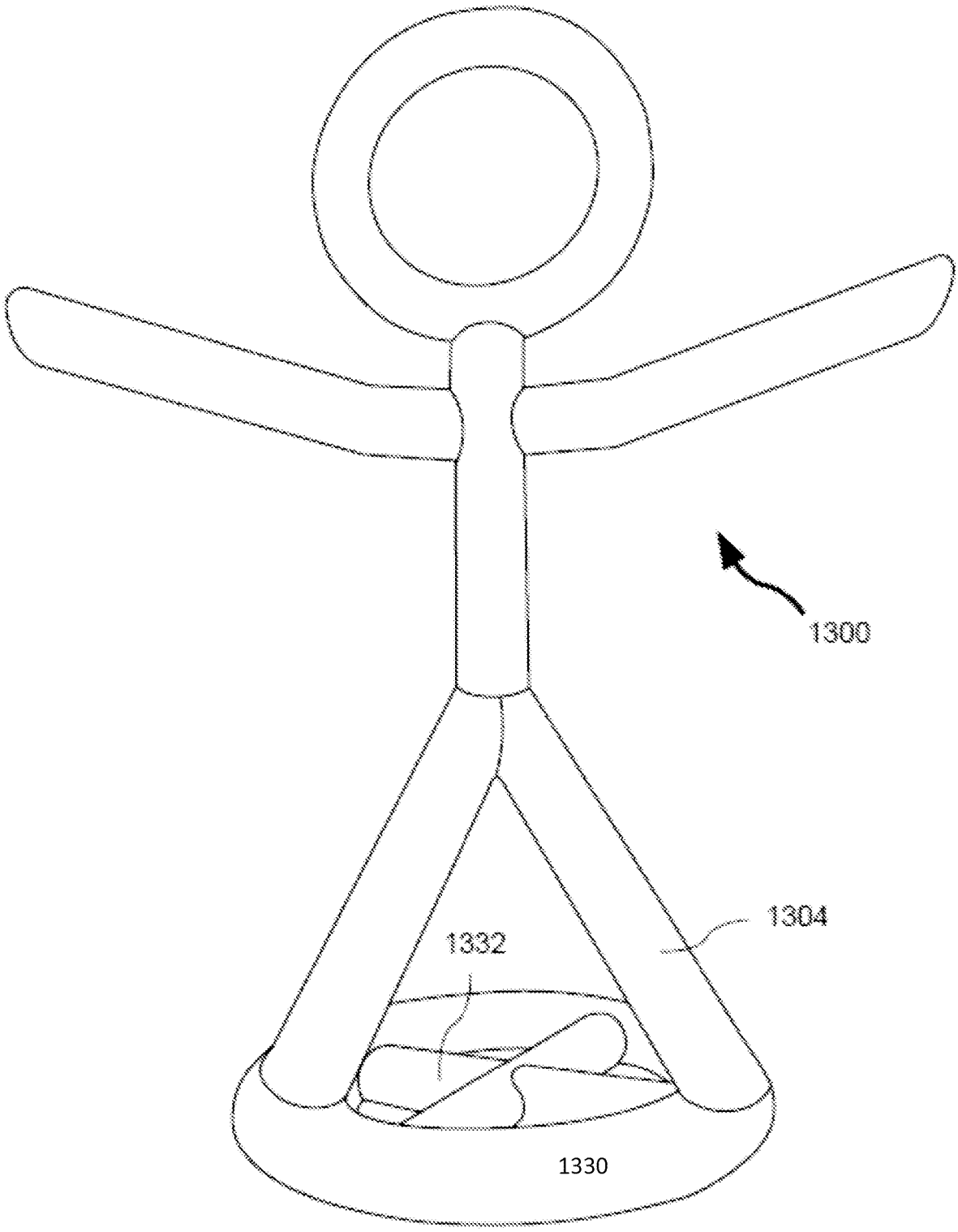
Figure 52C:
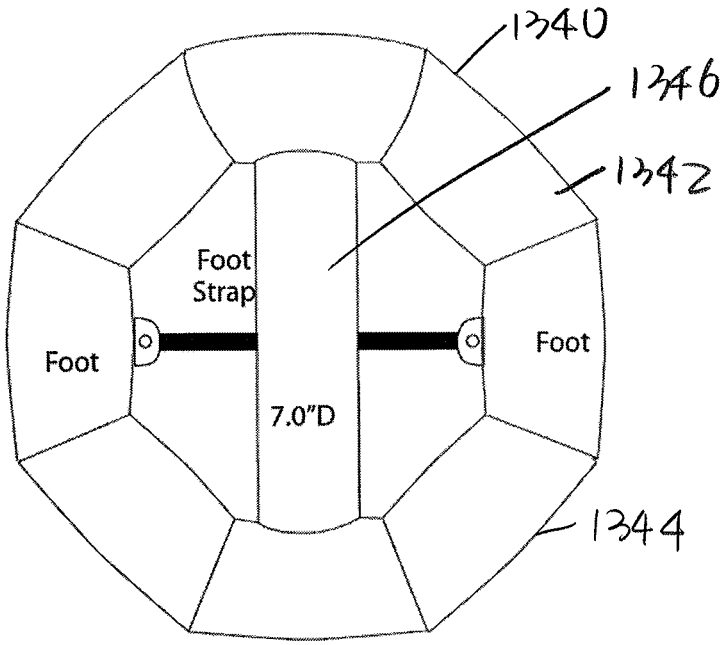
Figure 52D:
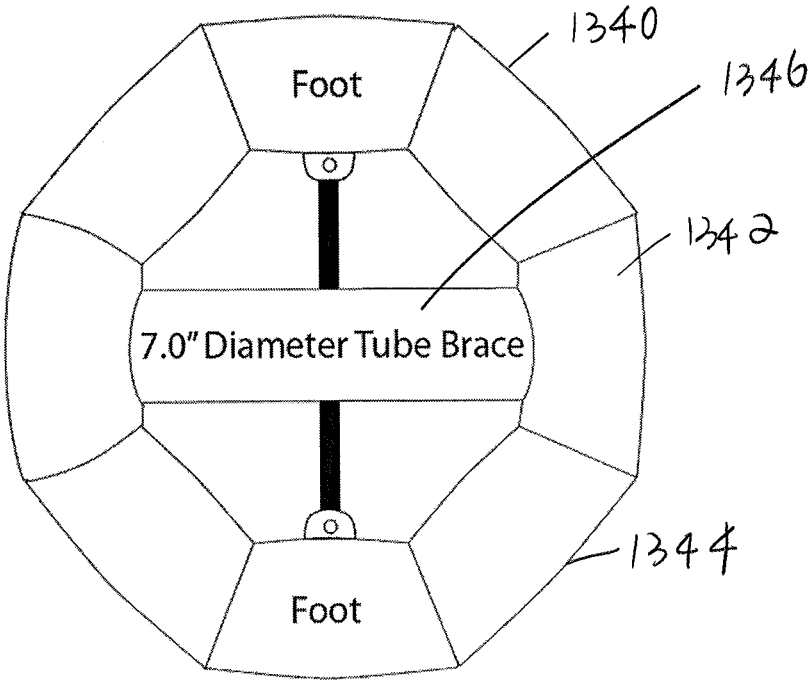
Figure 52E:
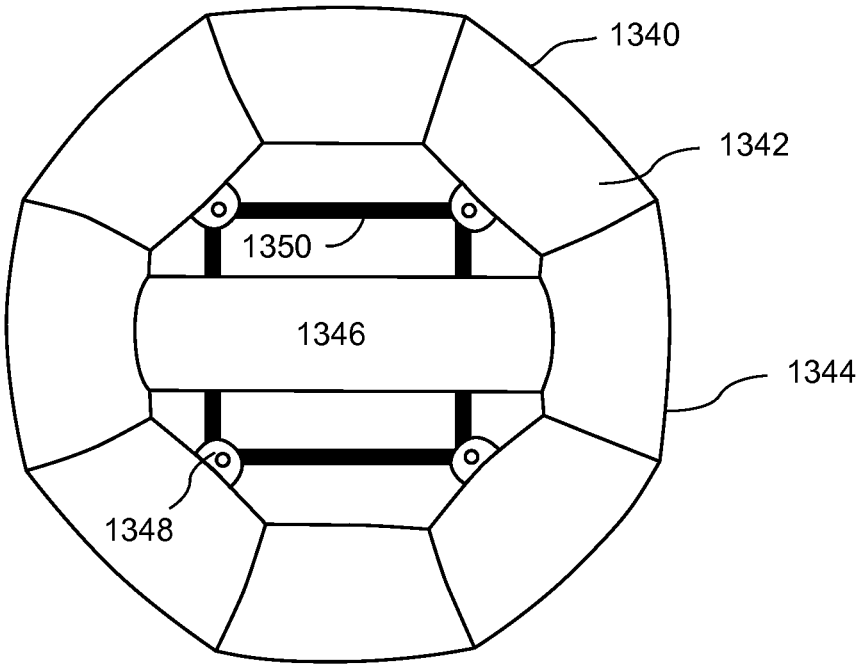
Figure 52F:
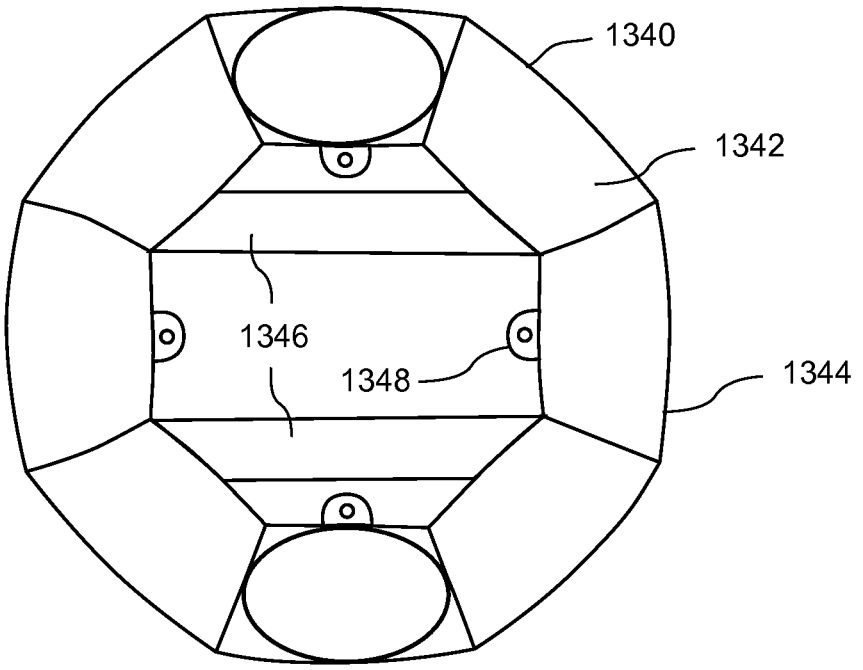

With reference to FIG. 52A, another inflatable support base 1320 may include one straight segment of inflatable member 1322 joined to the round inflatable member 1324 and positioned parallel to the span of the leg members or foot members 1326 as shown. With reference to FIGS. 52B and 52B-1 and 52B-2, another integrated, integral or monolithically formed inflatable support base 1330 may include two segments of inflatable tubes 1332 arranged in a cross configuration. With reference to FIGS. 52C, 52D, 52E, 52F and 53, other integrated inflatable support bases 1340 may include segments of inflatable tubes 1342 forming a peripheral inflatable member 1344 and one or more center inflatable segments 1346 arranged parallel or perpendicular or at any suitable angle with respect to the span of the leg members. The integrated support base 1340 may include one or more pairs of tie-down tabs 1348 and tie-down straps 1350 may be joined between two tabs. The single or multiple tubes keep the round base from bending or folding at the feet and adds rigidity to the base structure. The straps provide some added strength and/or rigidity but are more included so that a weighted object (i.e.: Sandbag or rubber) could be placed on top of the strap to help affix the inflatable to the ground surface. With reference to FIG. 52B-1, the added weighting would be plated atop the inflatable parts, hence the added layer or surface treatment (i.e.: different colored 1332 shapes on top of "X" and donut as well as bottom) to minimize potential material cuts or punctures. All of these bases have the option for straps and eyelets for affixing to ground using stakes or other attachment/tie-down means. With reference to FIG. 52B-2, the arms of the apparatus may be configured in an outstretched manner in order to convey a warning rather than a direction. For example, such an embodiment may be used in a school crossing zone.

The inflatable stick figure and/or the inflatable base may be made of a flexible plastic material, such as Tarpaulin coated with PVC, or any other suitable material. Portions, segments, or the entirety of the inflatable stick figure and/or the inflatable base may be formed by gluing or heat-sealing material onto itself or another piece of material to form tubes. Heat seal strips may be used for joining pieces of material together or placed over material joints for security and/or reinforcement. Additional inner and/or outer support layers may be used for added strength. Internal or external circular members may be mounted at the joint for reinforcement. Such circular members may also be used to hold or route internal or external lighting elements. The material for forming the inflatable stick figure structure may be opaque, translucent, clear, and/or tinted to let internal light shine through. The inflatable stick figure structure may be inflated by filling in air or any suitable mixture of gaseous element. The deflated stick figure may be compressed and rolled up into a compact size for easy storage and transportation. The inflatable is a rigid, sealed or closed air system. The shape remains constant without significant change in air or gaseous pressure. There is no circulating fan or pump to keep the apparatus inflated and somewhat rigid by captivation. Changing the shape requires a different design shape that is seamed and sealed.

Figures 53, 53A, 53B:
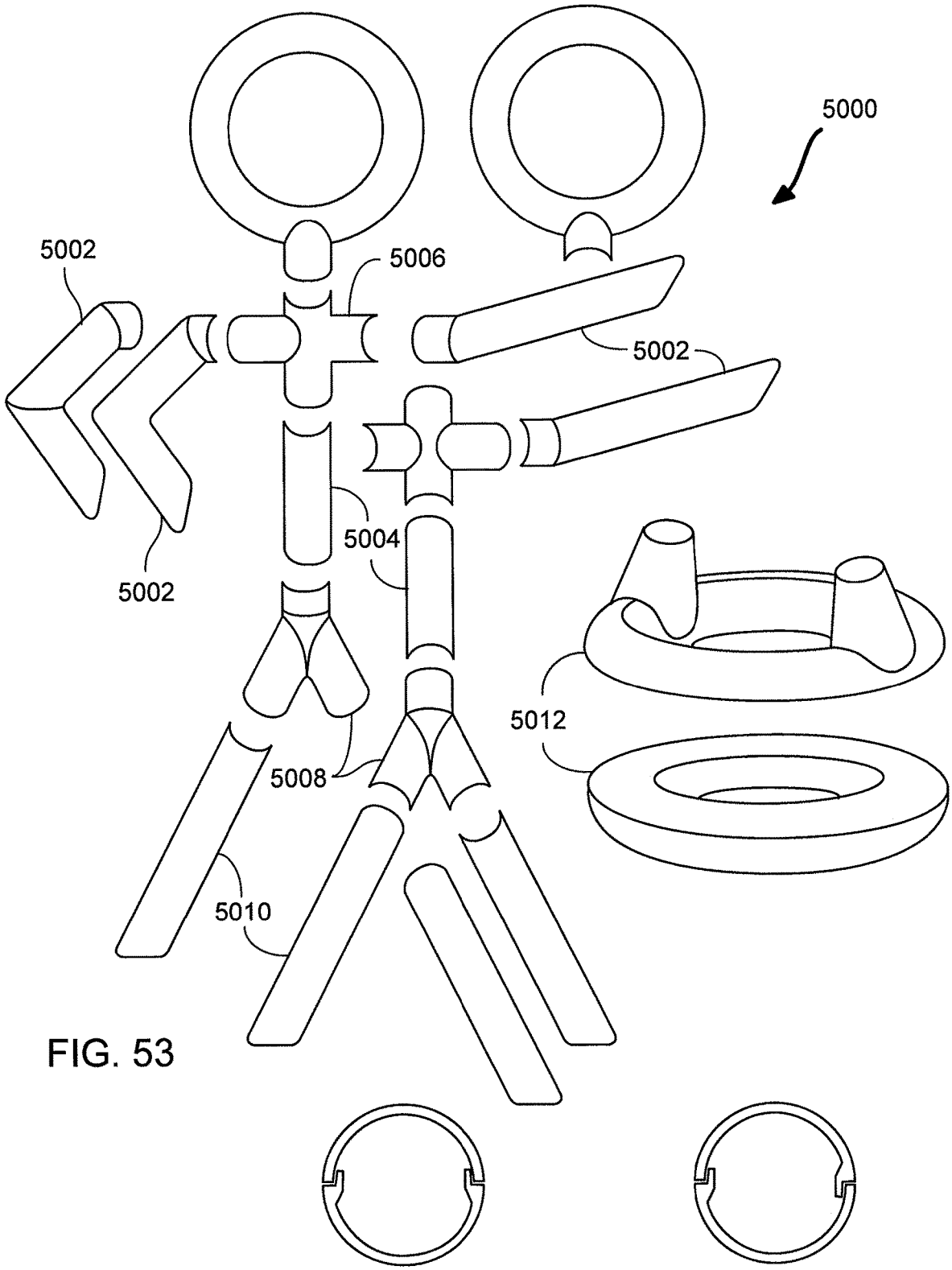
FIGS. 53, 53A and 53B depict a method of manufacturing an information conveying apparatus.

Referring now to FIG. 53, a method of manufacturing an information conveying apparatus is depicted. In this embodiment, the information conveying apparatus is made of rigid plastic parts that are mirror images for front and back. The individual component parts, e.g., head 5000, arms 5002, torso 5004, upper connector 5006, waist 5008, leg 5010 and base 5012 are joined together in a clamshell-like manner using snap, seam, glue or welding mechanism as indicated in FIG. 53A-B, which depict a molding process that produces the joining mechanism on one side of the mold (FIG. 53A) or both sides of the mold (FIG. 53B). The apparatus may be made with or without its own base and may be made of plastic, aluminum, fiberglass, Kevlar, etc., depending on the desired strength, aesthetics and exposure to natural elements. Also, by varying the type of plastic utilized (transparent, translucent or opaque), this allows the apparatus to be illuminated from within so that the apparatus can be used at night or in varying lighting conditions. It can glow in one or more changing colors and intensity to ensure directions or warnings are available at all times.

In various embodiments, the manufacturing process may include a method where the component parts are molded or shaped separately as mirror images and then glued, snapped or fused together. In an alternative embodiment, each side is molded together and joined by an integrated hinge which may be made of a more pliable material (e.g., different plastics or engineered shaping). In an alternative embodiment, the component parts receive a secondary treatment or molding process for joining or the joining mechanism may be a separate part that attaches to and holds the individual component parts together.

The inflatable stick structure may be able to shed wind, rain, snow, sleet, ice, dust, dirt, etc. due to its tubular structure and surface flexibility. It may not catch wind as a large, flat surface, rigid sign. Despite its air rigidity, it may still give a little or be movable in wind and/or weather conditions. The inflatable stick figure structure is lightweight and easy to move or transport. Inflatable stick figure structures are described herein as examples of tubular stick figure structures. A tubular stick figure structure may also be made out of solid pipe material.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An information conveying apparatus, comprising:

an upper portion configured to convey information to an observer, the upper portion comprising a head member defining a central opening;

a head insert;

one or more connecting elements coupled to the head member for receiving the head insert, the one or more connecting elements each having a first end and a second end, wherein the first end is coupled to the head member and the second end receives the head insert to position the head insert in a spaced apart configuration from the head member thereby creating a gap between an inner peripheral surface of the head member and an outer peripheral surface of the head insert;

a lower portion operably coupled to the upper portion; and an inflatable support base coupled to the lower portion, wherein the lower portion at least partially supports at least the upper portion of the apparatus to maintain a substantially upright position with respect to a surface, and wherein:

the upper portion further comprises a torso member including a first end and a second end, and the head member is joined with the torso member near the first end of the torso member, the lower portion comprises at least two leg members, the at least two leg members are joined with the torso member near the second end of the torso member and extend from the torso member, and the apparatus further comprising at least one arm member, the at least one arm member is joined with the torso member between the first and second ends of the torso member and extends from the torso member.

2. The information conveying apparatus of claim 1, wherein the upper portion and the lower portion form an integral body or are formed from a single piece of material.

3. The information conveying apparatus of claim 1, wherein the upper portion is coupled to the lower portion by a fastening mechanism selected from the group consisting of hinges, screws, adhesives, stapling, molding, welding or stitching.

4. The information conveying apparatus of claim 1, wherein the head member comprises a tubular structure.

5. The information conveying apparatus of claim 1, wherein the one or more connecting elements are positioned on and extend from an internal circumference of the head member.

6. An information conveying apparatus comprising a stick figure structure, the stick figure structure comprising:

an elongated torso member including a first end and a second end;

a head member operably joined to the first end of the torso member, the head member comprising a ring member defining a central opening;

a head insert;

one or more connecting elements coupled to the head member for receiving the head insert, the one or more connecting elements each having a first end and a second end, wherein the first end is coupled to the head member and the second end receives the head insert to position the head insert in a spaced apart configuration from the head member, thereby creating a gap between an inner peripheral surface of the head member and an outer peripheral surface of the head insert;

a first arm member and a second arm member operably joined to either side of the torso member between the first and second end of the torso member;

a first leg member and a second leg member operably joined to the second end of the torso member; and an inflatable support base coupled to the first leg member and the second leg member.

7. The information conveying apparatus of claim 6, wherein the stick figure structure is an inflatable body.

8. The information conveying apparatus of claim 6, wherein at least one of the elongated torso member, head member, the first arm member, the second arm member, the first leg member and the second leg member comprises a front and back piece joined together.

9. The information conveying apparatus of claim 6, wherein the stick figure structure defines an integral body.

10. The information conveying apparatus of claim 6, wherein the elongated torso member is coupled to at least one of the head member, the first arm member, the second arm member, the first leg member and the second leg member by a fastening mechanism selected from the group consisting of hinges, screws, adhesives, stapling, molding, welding or stitching.

11. The information conveying apparatus of claim 6, wherein at least one of the elongated torso member, the head member, the first arm member, the second arm member, the first leg member and the second leg member is configured to convey information to an observer.

12. An information conveying apparatus comprising an inflatable stick figure structure, the inflatable stick figure structure comprising:

a head insert;

an elongated torso member including a first end and a second end;

a head member operably joined to the first end of the torso member, the head member defining a central opening;

one or more connecting elements coupled to the head member for receiving the head insert, the one or more connecting elements each having a first end and a second end, wherein the first end is coupled to the head member and the second end receives the head insert to position the head insert a distance from the head member thereby creating a gap between an inner peripheral surface of the head member and an outer peripheral surface of the head insert;

a first arm member and a second arm member operably joined to either side of the torso member between the first and second end of the torso member;

a first leg member and a second leg member operably joined to the second end of the torso member; and an inflatable support base coupled to the first leg member and the second leg member.

13. The information conveying apparatus of claim 12, wherein the elongated torso member is coupled to at least one of the head member, the first arm member, the second arm member, the first leg member and the second leg member by a fastening mechanism selected from the group consisting of hinges, screws, adhesives, stapling, molding, welding or stitching.

14. The information conveying apparatus of claim 12, wherein at least one of the elongated torso member, the head member, the first arm member, the second arm member, the first leg member and the second leg member is configured to convey information to an observer or includes one or more attachment members configured to display information to an observer.

15. The information conveying apparatus of claim 12, wherein the inflatable support base comprises a round tubular member with a diameter corresponding to the span of the leg members.

16. The information conveying apparatus of claim 15, wherein the inflatable support base further comprises at least one of: a straight segment traversing the diameter of the round tubular member, and one or more tie-down tabs, and one or more weight elements configured to add stability.

17. The information conveying apparatus of claim 12, wherein the inflatable support base comprises an inflatable peripheral member formed by inflatable segments and a center non-inflatable flat member disposed within the peripheral member and joined thereto.

18. The information conveying apparatus of claim 12, wherein at least one of the elongated torso member, the head member, the first arm member, the second arm member, the first leg member and the second leg member is adapted to illuminate.

* * * * *